United States Patent [19]

Norwood

[11] Patent Number: 4,916,617

[45] Date of Patent: Apr. 10, 1990

[54] CONTROLLER FOR WELL INSTALLATIONS

[75] Inventor: William L. Norwood, San Antonio, Tex.

[73] Assignee: Delaware Capital Formation, Wilmington, Del.

[21] Appl. No.: 146,272

[22] Filed: Jan. 20, 1988

[51] Int. Cl.[4] ..... E21B 43/12

[52] U.S. Cl. ..... 364/422; 437/624.2; 437/552.7; 437/551; 166/53; 166/64

[58] Field of Search ..... 364/422, 421, 132; 166/53, 65 R, 372, 314, 305.1, 66, 66.4, 64; 251/137, 140; 137/625.64, 624.15, 552.7, 624.2, 240, 312, 315, 551; 73/431; 361/395, 399

[56] References Cited

U.S. PATENT DOCUMENTS

| | | | |
|---|---|---|---|
| 4,150,721 | 4/1979 | Norwood | 166/53 |
| 4,267,885 | 5/1981 | Sanderford | 166/53 |
| 4,352,376 | 10/1982 | Norwood | 166/64 X |
| 4,410,038 | 10/1983 | Drapp | 166/53 |
| 4,532,952 | 8/1985 | Norwood | 137/312 X |
| 4,636,934 | 1/1987 | Schwendemann et al. | 364/422 X |
| 4,685,522 | 8/1987 | Dixon et al. | 166/64 X |

*Primary Examiner*—Jerry Smith
*Assistant Examiner*—Steven G. Kibby
*Attorney, Agent, or Firm*—Mueller and Smith

[57] ABSTRACT

A controller for gas-oil well installations which is microprocessor driven and compiles a datalog which is accessible locally for operator use. Customized microprocessor control for a given well installation is available on a practical basis by resort to the employment of a program approach utilizing bit-string patterns selected from a relatively large sequence of predefined well installation operational parameters or variables which have been identified. The masking and pattern recognition approach permits the handling of relatively large amounts of data and greatly simplifies the customization of well programming. This programming facility permits remote alteration of programs either by telephonic communication or by networking of a plurality of controllers within a given oil field. The programming feature is complemented by the utilization of a variable opening control over a motor valve.

17 Claims, 36 Drawing Sheets

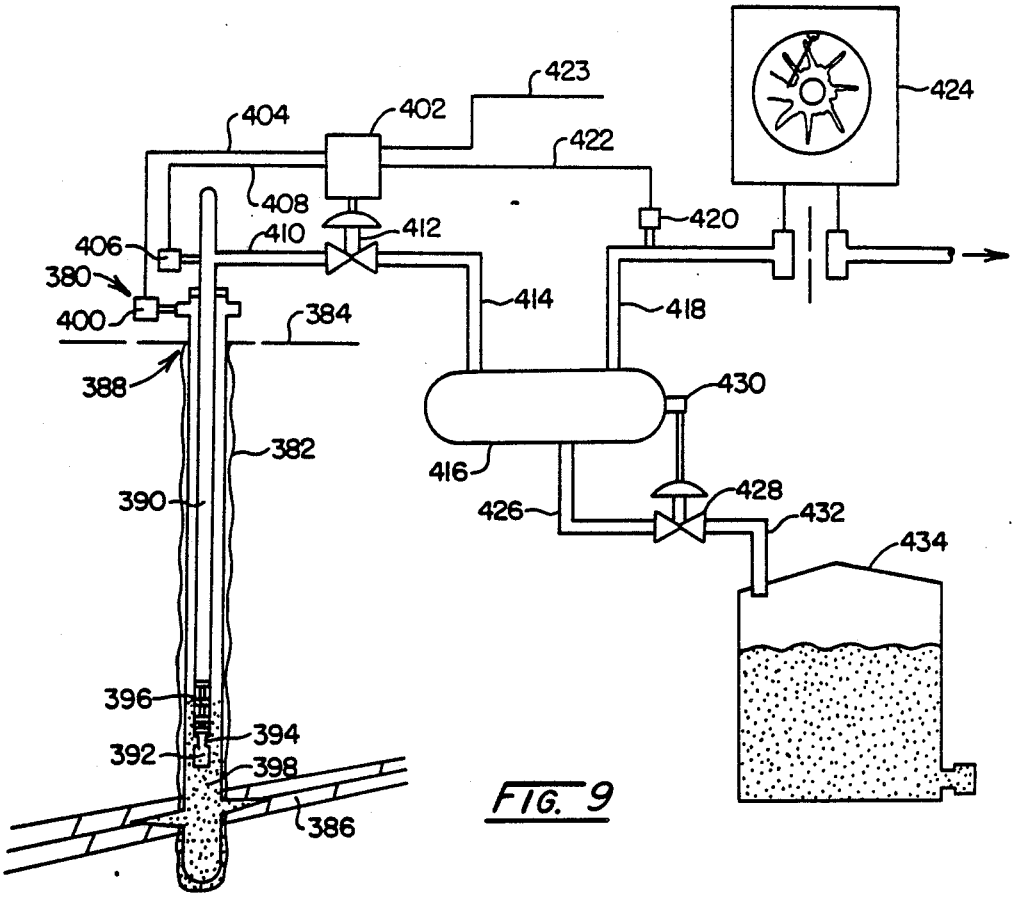
FIG. 9
FIG. 10A
SAMPLE OUTPUT
| TIME FROM INITIAL TURN ON | POSITION % OF FULL TRAVEL |
|---|---|
| 1 MIN. | 5 % |
| 3 MIN. | 10 % |
| 5 MIN. | 15 % |
| 7 MIN. | 25 % |
| 10 MIN. | 50 % |
| 20 MIN. | OFF |
FIG. 10B
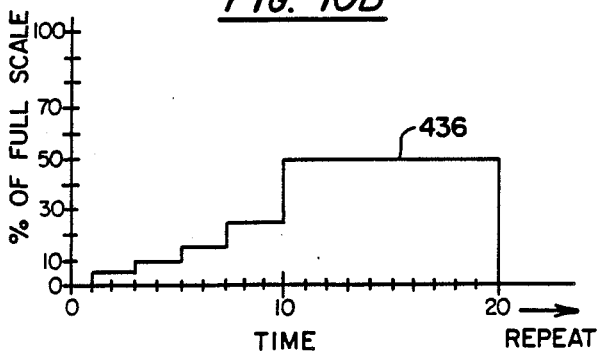

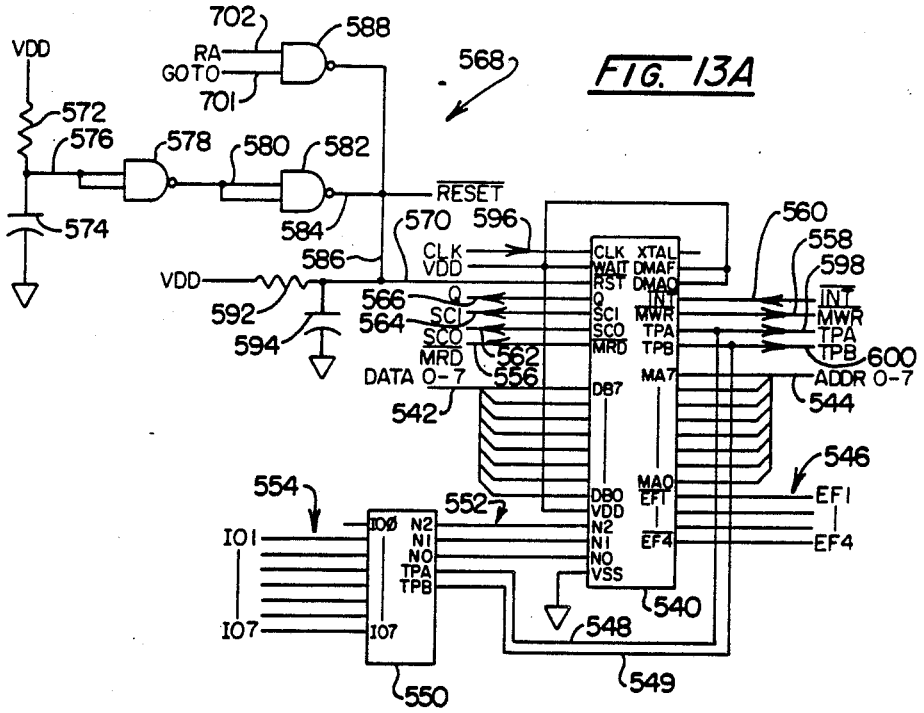
FIG. 13A
VDD
RA
GOTO
702
588
701
568
572
576
578
580
582
574
584
RESET
570
596
586
CLK
VDD
VDD
592
594
566
564
Q
SCI
SCO
MRD
DATA 0-7
562
556
542
CLK XTAL
WAIT DMAF
RST DMAO
Q INT
SCI MWR
SCO TPA
MRD TPB
DB7
MA7
DB0
VDD
N2
N1
N0
VSS
MA0
EF1
EF4
560
558
598
INT
MWR
TPA
TPB
600
ADDR 0-7
544
546
EF1
EF4
554
552
IO1
IO7
IOØ
N2
N1
N0
TPA
TPB
IO7
540
548
549
550
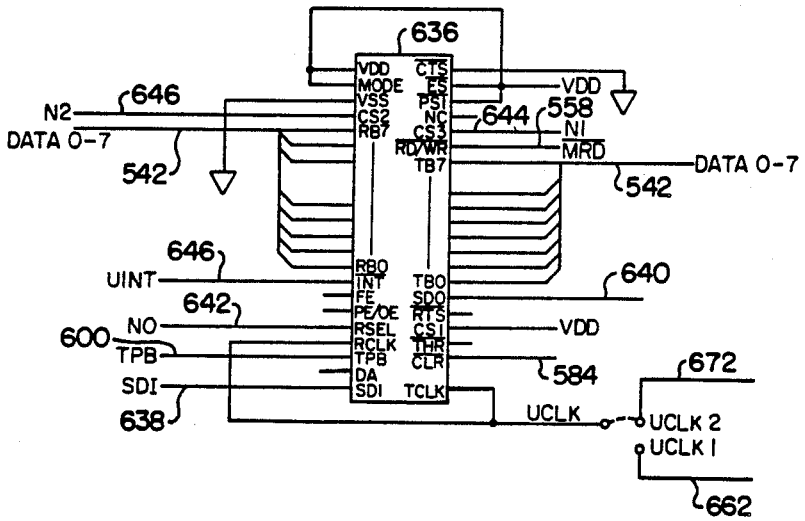
636
VDD
MODE
VSS
CS2
RB7
CTS
ES
PSI
NC
CS3
RD/WR
TB7
VDD
N2
DATA 0-7
646
542
644
558
NI
MRD
DATA 0-7
542
646
UINT
642
600
NO
TPB
SDI
638
RB0
INT
FE
PE/OE
RSEL
RCLK
TPB
DA
SDI
TB0
SDO
RTS
CSI
THR
CLR
TCLK
640
VDD
584
672
UCLK
UCLK 2
UCLK 1
662

PROGRAM
STATUS DEFINITION
TEST
VAR 1
VAR 2
1130
Z T9
Z T10
Z T11
Z T12
C CSG CSGLO
C CSG CSGHI
C LINE LINELO
C LINE LINEHI
C CTDIF CTDLO
C CTDIF CTDHI

STATUS
1132
AND
MASK
1134
MASKED
STATUS
1136
RESPONSE NO.
PATT. NO. 1
MASK PATTERN
01
1138
PATT. NO. 2
MASK PATTERN
1140
02
1142
PATT. NO. 3
MASK PATTERN
1144
01
1146
RESPONSES
1148
PROCESS CVN
1150

FIG. 23B

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| | | | | | | | | | | | | | | | | | | | | | | | | | | | |
| | | | | 3B | 3A | 3F | 3E | 43 | 42 | | | | | | | | | | | | | | | | | | |
| 9E | 9F | A0 | 03 | 03 | 03 | 05 | 05 | 0B | 0B | 01 | 02 | 04 | 08 | 40 | 50 | 77 | 78 | 79 | 30 | 31 | | | | | | | |
| 01 | 01 | 01 | 02 | 02 | 02 | 02 | 02 | 02 | 02 | 03 | 03 | 03 | 03 | 01 | 01 | 01 | 01 | 01 | 01 | 01 | | | | | | | |
| | | | CSGLO | CSGHI | LINELO | LINEHI | CTDLO | CTDHI | | | | | | | | | | | | | | | | | | | |
| Z | Z | Z | Z | Z | Z | Z | Z | Z | Z | P | P | P | P | Z | Z | Z | Z | Z | Z | Z | | | | | | | |
| T10 | T11 | T12 | CSG | CSG | LINE | LINE | CTDIF | CTDIF | INP1 | INP2 | INP3 | INP4 | SV2 | SV3 | ACT1 | ACT2 | ACT3 | SONT | SOFFT | | | | | | | | |
| | | | | | | | | | | | | | 1 | | 1 | | 1 | | | | | | | | | | 80 02 A0 |
| | | | | | | | | | | | | | 1 | | 1 | | 1 | | | | | | | | | | 80 02 A0 01 |
| | | | | | | | | | | | | | 1 | | | 1 | 1 | | | | | | | | | | 80 02 60 |
| | | | | | | | | | | | | | 0 | | | 1 | 1 | | | | | | | | | | 80 00 60 02 |
| | | | | 1 | | | 1 | | | | | | 1 | | 1 | | | | | | | | | | | | 04 82 80 |
| | | | | 1 | | | 0 | | | | | | 1 | | 1 | | | | | | | | | | | | 04 02 80 01 |
| | | | | | | | | 1 | | | | | 1 | | | | | | | | | | | | | | 00 42 00 |
| | | | | | | | | 1 | | | | | 0 | | | | | | | | | | | | | | 00 40 00 03 |
| | | 1 | | | | | | | | | | | 1 | | | | 1 | | | | | | | | | | 10 02 20 |
| | | 1 | | | | | | | | | | | 1 | | | | 0 | | | | | | | | | | 10 02 00 04 |
| | | | | | | | | | 1 | | | | 1 | | | | | | | | | | | | | | 00 22 00 |
| | | | | | | | | | 1 | | | | 0 | | | | | | | | | | | | | | 00 20 00 05 |
| | 1 | | | | | | | | | | | | 1 | | | 1 | | | | | | | | | | | 20 02 40 |
| | 1 | | | | | | | | | | | | 0 | | | 0 | | | | | | | | | | | 20 00 00 02 |
| | | | | | | | | | | | | | | 1 | | | | | | | | | | | | | 80 01 00 |
| | | | | | | | | | | | | | | 0 | | | | | | | | | | | | | 80 00 00 06 |
| | | | | | | | | | 1 | | | | | 1 | | | | | | | | | | | | | 00 21 00 |
| | | | | | | | | | 1 | | | | | 0 | | | | | | | | | | | | | 00 20 00 06 |
| | | | | | | 1 | | | | | | | | | 1 | | | | | | | | | | | | 01 00 80 |
| | | | | | | 1 | | | | | | | | | 1 | | | | | | | | | | | | 01 00 80 07 |
| | | | | | | | | | | 1 | | | | | 1 | | | | | | | | | | | | 00 10 80 |
| | | | | | | | | | | 1 | | | | | 1 | | | | | | | | | | | | 00 10 80 07 |
| 1 | | | | | | | | | | | | 1 | | | 1 | | | | | | | | | | | | 00 04 80 |
| 1 | | | | | | | | | | | | 1 | | | 1 | | | | | | | | | | | | 00 04 80 08 |
| | | | | | | | | | | | | | 1 | | 1 | | | | | | | | | | | | 40 02 80 |
| | | | | | | | | | | | | | 0 | | 0 | | | | | | | | | | | | 40 00 00 02 |
| | | | | | 1 | | | | | | | | 1 | | 1 | | | | | | | | | | | | 02 02 80 |
| | | | | | 0 | | | | | | | | 0 | | 1 | | | | | | | | | | | | 00 00 80 08 |
| | | | | | | | | | | | | 1 | | | 1 | | | | | | | | | | | | 00 04 80 |
| | | | | | | | | | | | | 1 | | | 1 | | | | | | | | | | | | 00 04 80 08 |
| | | | | | 1 | 1 | | | | | | | | | 1 | | | | | | | | | | | | 03 00 80 |
| | | | | | 1 | 0 | | | | | | | | | 0 | | | | | | | | | | | | 02 00 00 09 |
| | | | | | 1 | 1 | | | | | 1 | | | | 1 | | | | | | | | | | | | 03 08 80 |
| | | | | | 1 | 0 | | | | | 1 | | | | 0 | | | | | | | | | | | | 02 08 00 09 |
| | | | | | | | | | | | | | | | | | | 1 | | | | | | | | | 00 00 10 |
| | | | | | | | | | | | | | | | | | | 1 | | | | | | | | | 00 00 10 0C |
| | | | | | | | | | | | | | | | | | | | 1 | | | | | | | | 00 00 08 |
| | | | | | | | | | | | | | | | | | | | 1 | | | | | | | | 00 00 08 0D |

MASK

RESPONSE

PATTERN

FIG. 27
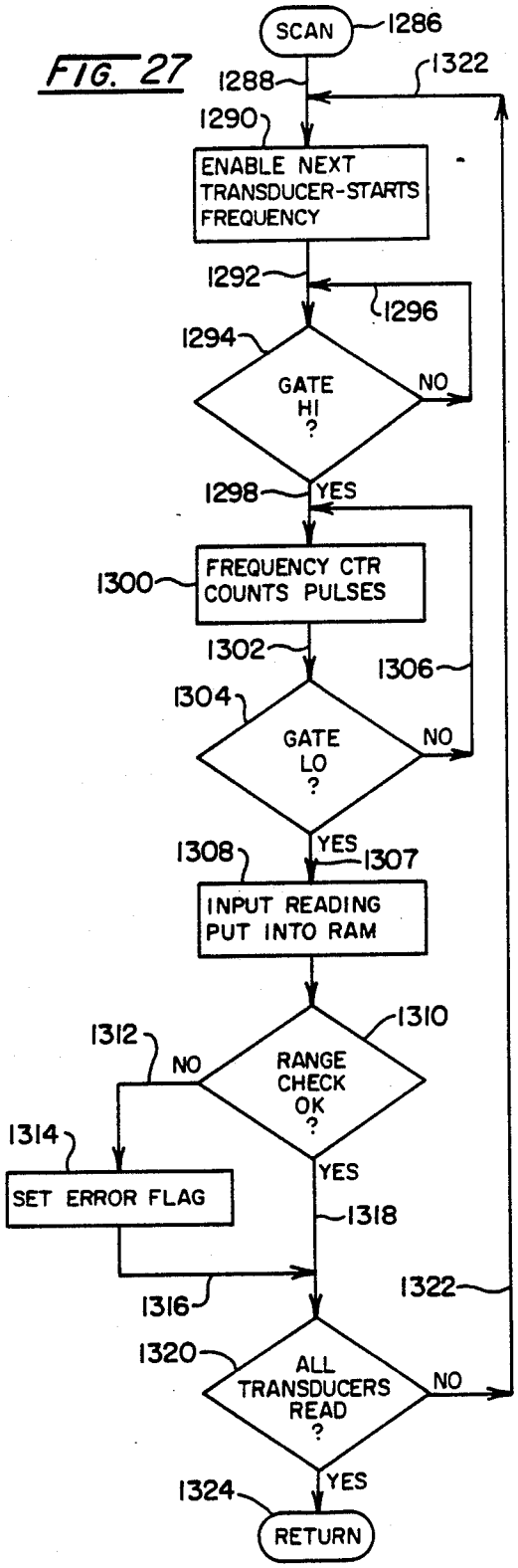
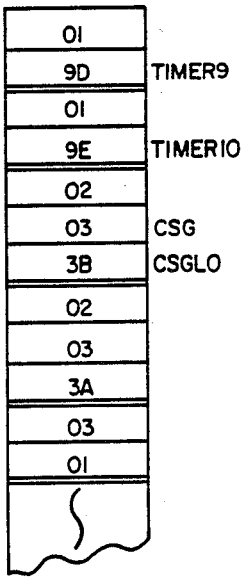
FIG. 28B

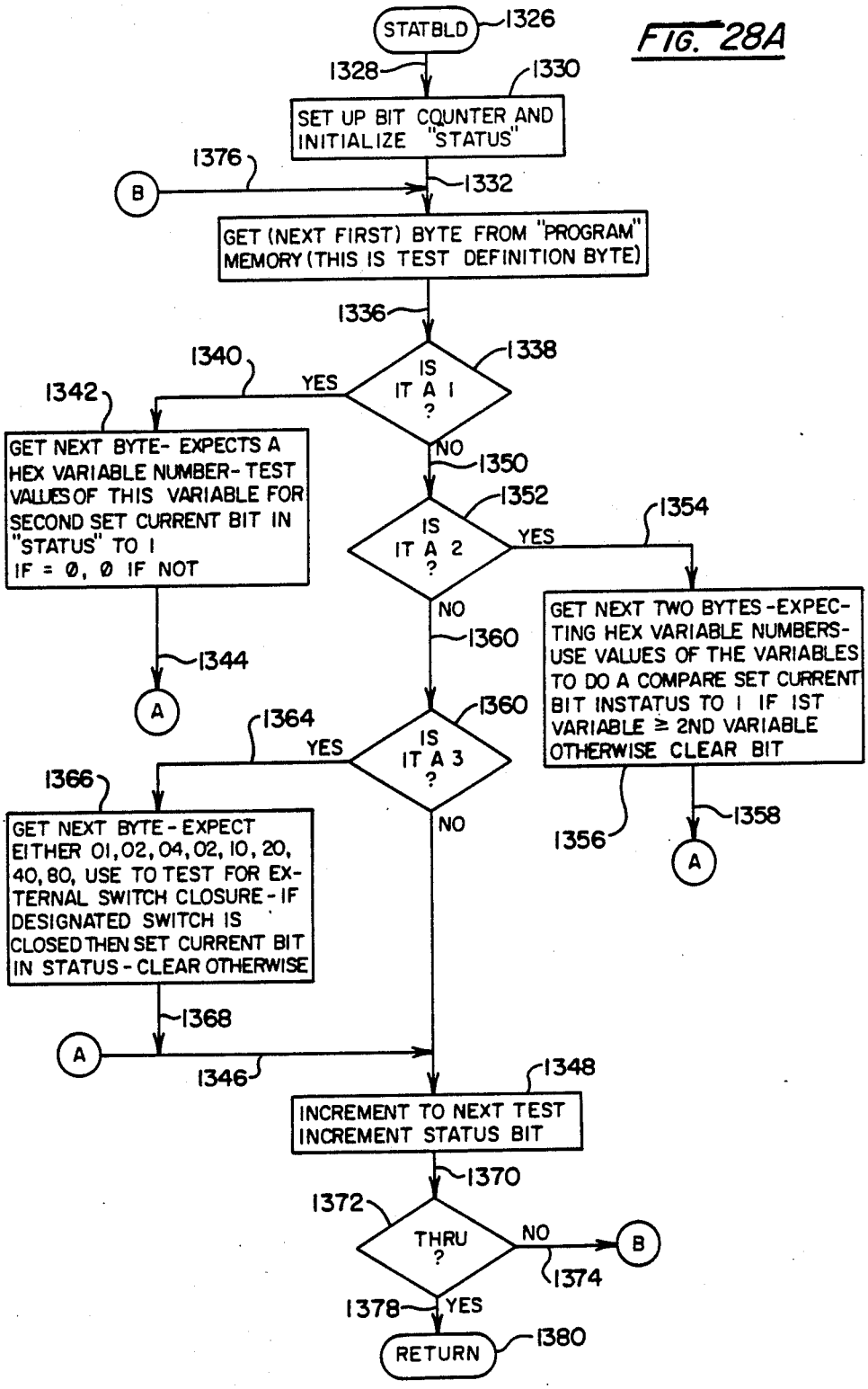
FIG. 28A
STATBLD
1326
1328
1330
SET UP BIT COUNTER AND INITIALIZE "STATUS"
1376
B
1332
GET (NEXT FIRST) BYTE FROM "PROGRAM" MEMORY (THIS IS TEST DEFINITION BYTE)
1336
1338
IS IT A 1 ?
1340
YES
1342
GET NEXT BYTE- EXPECTS A HEX VARIABLE NUMBER- TEST VALUES OF THIS VARIABLE FOR SECOND SET CURRENT BIT IN "STATUS" TO 1 IF = Ø, Ø IF NOT
1344
A
NO
1350
1352
IS IT A 2 ?
YES
1354
GET NEXT TWO BYTES-EXPECTING HEX VARIABLE NUMBERS- USE VALUES OF THE VARIABLES TO DO A COMPARE SET CURRENT BIT INSTATUS TO 1 IF 1ST VARIABLE ≥ 2ND VARIABLE OTHERWISE CLEAR BIT
1356
1358
A
NO
1360
1360
IS IT A 3 ?
1364
YES
1366
GET NEXT BYTE - EXPECT EITHER 01, 02, 04, 02, 10, 20, 40, 80, USE TO TEST FOR EXTERNAL SWITCH CLOSURE - IF DESIGNATED SWITCH IS CLOSED THEN SET CURRENT BIT IN STATUS - CLEAR OTHERWISE
1368
A
1346
NO
1348
INCREMENT TO NEXT TEST INCREMENT STATUS BIT
1370
1372
THRU ?
NO
B
1374
1378
YES
RETURN
1380

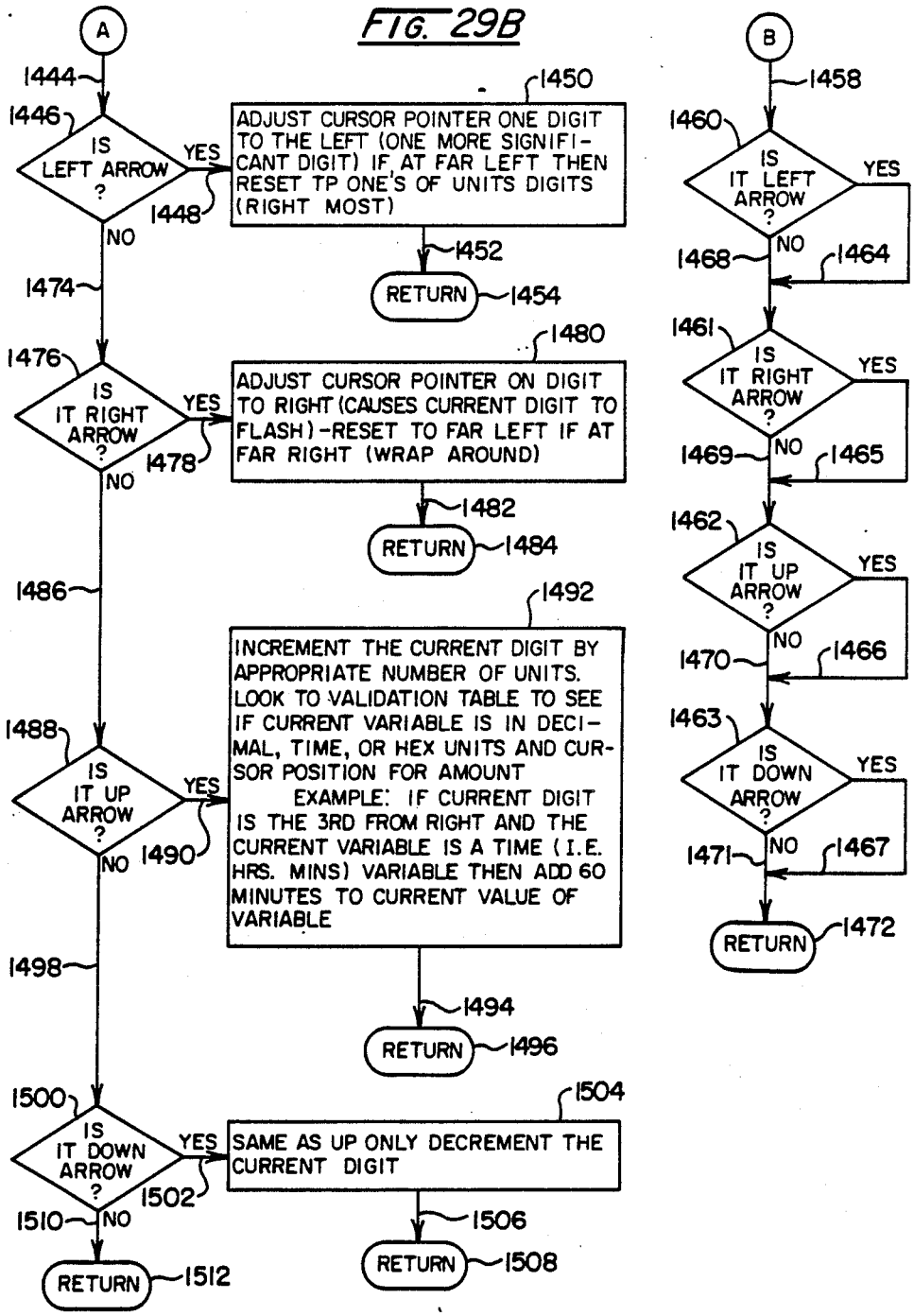
FIG. 29B
A
1444
1446
IS LEFT ARROW ?
YES
1448
NO
1450
ADJUST CURSOR POINTER ONE DIGIT TO THE LEFT (ONE MORE SIGNIFICANT DIGIT) IF AT FAR LEFT THEN RESET TP ONE'S OF UNITS DIGITS (RIGHT MOST)
1452
RETURN
1454
1474
1476
IS IT RIGHT ARROW ?
YES
1478
NO
1480
ADJUST CURSOR POINTER ON DIGIT TO RIGHT (CAUSES CURRENT DIGIT TO FLASH)-RESET TO FAR LEFT IF AT FAR RIGHT (WRAP AROUND)
1482
RETURN
1484
1486
1488
IS IT UP ARROW ?
YES
1490
NO
1492
INCREMENT THE CURRENT DIGIT BY APPROPRIATE NUMBER OF UNITS. LOOK TO VALIDATION TABLE TO SEE IF CURRENT VARIABLE IS IN DECIMAL, TIME, OR HEX UNITS AND CURSOR POSITION FOR AMOUNT
EXAMPLE: IF CURRENT DIGIT IS THE 3RD FROM RIGHT AND THE CURRENT VARIABLE IS A TIME (I.E. HRS. MINS) VARIABLE THEN ADD 60 MINUTES TO CURRENT VALUE OF VARIABLE
1494
RETURN
1496
1498
1500
IS IT DOWN ARROW ?
YES
1502
NO
1504
SAME AS UP ONLY DECREMENT THE CURRENT DIGIT
1506
RETURN
1508
1510
RETURN
1512
B
1458
1460
IS IT LEFT ARROW ?
YES
1464
NO
1468
1461
IS IT RIGHT ARROW ?
YES
1465
NO
1469
1462
IS IT UP ARROW ?
YES
1466
NO
1470
1463
IS IT DOWN ARROW ?
YES
1467
NO
1471
RETURN
1472

UPLOG
1860
1862
1864
IS |CSG-LLCSG| ≥ DIFF| ?
YES
NO
1870
1872
PLACE CSG & TIME OF DAY INTO LOG
1874
1876
UPDATE PTR TO NEXT LOG LOCATION
1878
1866
1868
THROUCH ?
NO
YES
1880
1882
INCREMENT TO NEXT TRANSD.
1884
1886
1888
EXT. SWITCH CHANGE ?
YES
NO
1892
1894
PLACE EXTERNAL INTO DATA LOG WITH T/D
1896
1890
1898
VALVE CHANGE ?
YES
NO
1904
1906
PLACE VALVE STATUS INTO D.C.
1908
1900
RETURN
1902

PROCVN
1940
1942
1944
IS V1POS = STATV1
NO
YES
1948
1950
STEP MOTOR IN OR OUT AS REQUIRED; UPDATE POSITION STATUS.
1946
1952
1954
IS V2POS= STATV2 ?
NO
YES
1958
1960
IS V2POS = 1 ?
YES
NO
1966
1962
1968
1964
PULSE V2 OFF UPDATE V2POS
PULSE
PULSE V2 ON UPDATE V2POS
PULSE
1956
1965
1970
1972
IS V3POS= STATV3 ?
NO
YES
1976
1978
IS V3POS = 1
NO
YES
1980
1986
1982
1988
PULSE V3 ON UPDATE V3POS
PULSE
PULSE V3 OFF UPDATE V3POS
PULSE
1974
1990
1984
A

CONTROLLER FOR WELL INSTALLATIONS

BACKGROUND

The production of natural gas and crude petroleum is carried out with a broad range of techniques generally involving any of a variety of pumping systems or non-pumping, "gas lifting" techniques. With the latter techniques, wells are produced on a periodic basis such that gas pressures, whether artificially or naturally induced, are permitted to build at the well as liquid accumulates therein. These liquids, which in most cases will include oil and salt water, are expelled by pressurized natural gas as the well is opened. The resultant "slug" of expelled liquid is directed into separation and collection facilities, separated gas conventionally being directed to a "sales" line for distribution by a utility. Achieving optimum production from a well requires an evaluation of many operational parameters such as casing pressure, tubing pressure, line pressure, as well as trends which those parameters exhibit over several periods of production. Production histories of the wells generally are unique, no two wells exhibiting the same performance characteristics or "signatures" and those signatures are seen to vary as the wells age. Failure to properly evaluate these well characteristics and control accordingly, may result in a "loading up" condition wherein liquids over-accumulate in the well to exhibit static pressure levels beyond the energy capabilities of the natural gas production reservoir which may be available to effect their removal. Such failures may be quite expensive to correct.

In the past, a procedure called "intermitting" was employed to produce a well wherein a mechanical clock controller, operating in a limited but repeating time cycle, periodically opened and closed the well. To aid the operator in devising the on-off schedule for a well, typically 7-day, two pen recorder charts were then and are now employed to record casing pressure and tubing pressure such that the operator could observe any pertinent trends upon visiting the well head. The mechanical controller long used for intermitting procedures had many drawbacks. It required frequent winding and thus often was neglected during adverse weather conditions as well as when located at remote and difficult-to-access well locations. Such crude, purely timed production techniques additionally limited the operator's capability for achieving a more optimal control.

Production control approaches have been taken by major oil producers which employ elaborate parameter monitoring coupled with equally elaborate communications which achieved a control dialogue with a centralized computer control facility. The economics associated with such network controls necessitated their use with large oil pockets, for example those encompassing more than 100 wells. For such installations, the communications links extend, for example, over distances as lengthy as 100 miles. Experience with these elaborate control systems has witnessed the vulnerability of elaborate communication systems to break-down as well as the down time propensities of computers. These problems have lead to a further need for "stand-alone" systems which will maintain an acceptable well operation in the presence of loss of centralized controls.

Smaller, independent well operators cannot afford the above-noted elaborate and expensive centralized control approaches as well as the important supporting technical personnel required for them. Generally, the independent operator must work with those untrained in the technical sphere and, thus, control equipment must be readily understood, reliable and simple. However, the smaller entities have improved well head control by resort to improved stand alone controllers coupled with each well head. For example, an electronic controller capable of operating over extended time periods under battery power was successfully introduced to the industry under the trade designation "DIGITROL". Described in U.S. Pat. No. 4,150,721 by W. L. Norwood, this controller provides not only a simplified control adjustment procedure but, importantly, a time cycle interruption feature accommodating conditions where the cyclical timing system should be overriden and subsequently reinitiated on an automatic basis.

These improved performance capabilities of the pioneer electronic controller later were considerably expanded with the introduction of a microprocessor driven programmable controller described in U.S. Pat. Nos. 4,352,376 and 4,532,052 by Norwood. With the logic capabilities of the microprocessor, the latter controllers are capable of significantly expanded combinational logic performance for tailored control over a given well head. However, these devices were called upon in many instances for specialized performance for given well heads, a requirement calling for recompiling programs and the like, a task generally found to be beyond the capacities of smaller independent operators.

A need exists for a stand alone controller which is readily programmable to meet an extended range of control conditions and which additionally contributes the function of the two pen recorder chart to show data representing well performance as well as the trends of that performance over predetermined periods of time. Additionally, it is desirable that some form of networking be made available for the smaller independent operator such that remote well head installations which normally are difficult to access may be remotely communicated with by systems within the realm of practical economics.

Very often to improve the production capabilities of a well, the tubing strings therein incorporate a plunger lift device. With such devices, when the well is shut in, the plunger is situated in the lowermost portion of the tubing string. As natural gas pressure develops within the well during this shut-in interval, the slug of liquid accumulates in the tubing string above the plunger. At an optimum point in time, the well is opened via a motor valve assembly coupled to the tubing string and a surge of pressure occurs functioning to move the slug of liquids into the separation and collection facilities and the gas cap into the sales line of the buyer. While the surge pressure involved in plunger lift is helpful in terms of fluid expulsion, the pressure surges are considered detrimental by gas purchasers, orifice meters and the like being driven off chart without some form of protection. To accommodate for the needs of the gas buyer, operators often will avoid plunger lift procedures or curtail full production through the employment of chokes and the like to restrict this pressure surge of capped gas. Gas-oil markets also influence techniques of production. In some cases, the market for this product is curtailed and it is desirable to shut-in or close the wells for an extended period, for example three weeks. Opening the wells following this interval may result in similar forms of high pressure surges which are detrimental to the system.

SUMMARY

The controller of the instant invention is relatively small, having essentially the same size as the electronic controllers earlier introduced but with greatly enhanced, stand-alone controlling capability or "power." This highly versatile control capability is gained without the severe penalty of requiring conventional customized computer programming for each well installation, a requirement which would preclude its economic practicability for small or moderately sized gas-oil operators. While centrally based mainframe computer facilities have been developed for large gas-oil field installations, such approaches are impractical for smaller oil field operators. Customization of control for each well, however, is realized by the instant controller through resort to the employment of a local computer operational approach utilizing bit-string patterns selected from a relatively large sequence of predefined "variables" or gas-oil field parameters which have been identified to a somewhat exhaustive extent. The masking and pattern matching classification approach both greatly simplifies the handling of the large amount of data necessarily involved and enhances customized programming for wells. Also, recognizing that an effective control of gas-oil well installations requires a periodic, "hands on" visitation and on-site control by experienced oil well operators, the controller of the invention functions to treat and log the type of information considered important for such visitation. This information heretofore was provided by the ubiquitous two-pen recorder which, characteristically, charted seven-day histories of casing pressuring and tubing pressure. The chart developed by the recorders permits on-site observation of pressure trends, cycling activity and relative values or differentials of these pressure parameters to evaluate performance as it occurs from time to time in the lifespan of a well. This information now returns in the form of a preanalyzed data log available to the operator at the well or at a convenient accessing location. The function of the two-pen recorder becomes emulated, but with improved information. In effect, the instant controller intertwines the heuerestic technology of the experienced well manager with an unconventional expert system of data analysis based upon pattern recognition rather than the involved reasoning associated with conventional programs. This highly efficient management of a rather large amount of data is complemented by an efficient and simplified readout at the controller for the operator's use.

Simplified customization of the control program of the controller also permits a unique variable opening control over motor valves associated with a well head or where desired. This permits the controller to accommodate for surges as, for example, may be encountered in plunger lift systems without adversely affecting the production efficiency of the well. Further, this variable control over a motor valve, when combined with the expanded processing power of the controller, may be employed for sophisticated pressure regulation purposes, a feature heretofore generally unavailable on a practical basis.

Another feature of the invention is to provide a controller for use in conjunction with the control of well installations wherein control components regulating the production of fluid hydrocarbons are selectively actuated in response to control inputs and wherein monitoring devices provide inputs representing operational parameters of the well installations. The controller includes an input responsive to the operational parameter inputs for providing parameter state conditions and a communicator for providing selectable parameter control conditions. An output of the controller is responsive to output control signals for deriving the control inputs asserted to the control components. A memory is provided for retaining a predetermined sequence of values for control state variables, groupings of mask variable selection sequences, pattern control conditions, and response data corresponding with the sequence of pattern control conditions. The controller includes a processor which is responsive to the pattern state conditions and the parameter control conditions for generating control state variable values for retention by the memory. The processor further is responsive to the control state variable values and the mask variable selection sequences to derive corresponding sequences of masked control state variable values and additionally is responsive to compare the masked control state variable values with the pattern control conditions and, in the presence of correspondence therebetween, to access the response data. The processor is responsive to the accessed response data to derive output control signals used by the output.

Another feature of the invention is to provide a method for controlling the operation of the fluid hydrocarbon producing well having a valve connected between a tubing string and a sales line and monitors providing operating parameter readouts. The method includes the steps of scanning the monitors on a predetermined periodic basis and recording the values of the readouts thereof in conjunction with a sequence of variables in memory; testing the values with predetermined operational criteria to generate an ordered sequence of binary current status values and recording them as part of the sequence of variables; periodically masking the memory retained values of the sequence of variables to derive a masked status as a binary sequence; comparing the masked status with a predetermined pattern provided as a binary sequence for coincidence therebetween; altering predetermined ones of the binary current status values in response to a coincidence to derive revised binary status values; and processing the revised binary status value by altering the state of the valve to conform with the binary status values.

Other objects of the invention will, in part, be obvious and will, in part, appear hereinafter. The invention, accordingly, comprises the apparatus and method possessing the construction, combination of elements, arrangement of parts and steps which are exemplified in the following detailed description.

For a fuller understanding of the nature and objects of the invention, reference should be had to the following detailed description taken in connection with the accompanying drawings.

BRIEF DESCRIPTION OF THE DRAWINGS

FIG. 9 is a sectional schematic view of a well installation with components shown sectionally and out of scale and employing a variably controlled motor valve;

FIGS. 10A and 10B are a tabulation and graph showing a performance arrangement for the variable opening motor valve of the well installation of FIG. 9;

FIGS. 13A–13G provide a schematic representation of one control circuit employed with the controller of the invention;

FIG. 23B is a tabulation showing a pattern and mask binary sequence developing one control arrangement employable by the controller of the invention;

FIG. 27 is a flow diagram of a SCAN subroutine employed by the controller of the invention;

FIG. 28A is a flow chart of a STATBLD routine employed with the controller of the invention;

FIG. 28B is an exemplary memory map associated with the control program of the controller of the invention;

FIGS. 29A–29B comprise a flow diagram of the keypad and display servicing routine employed with the controller of the invention;

DETAILED DESCRIPTION

Figure 1:
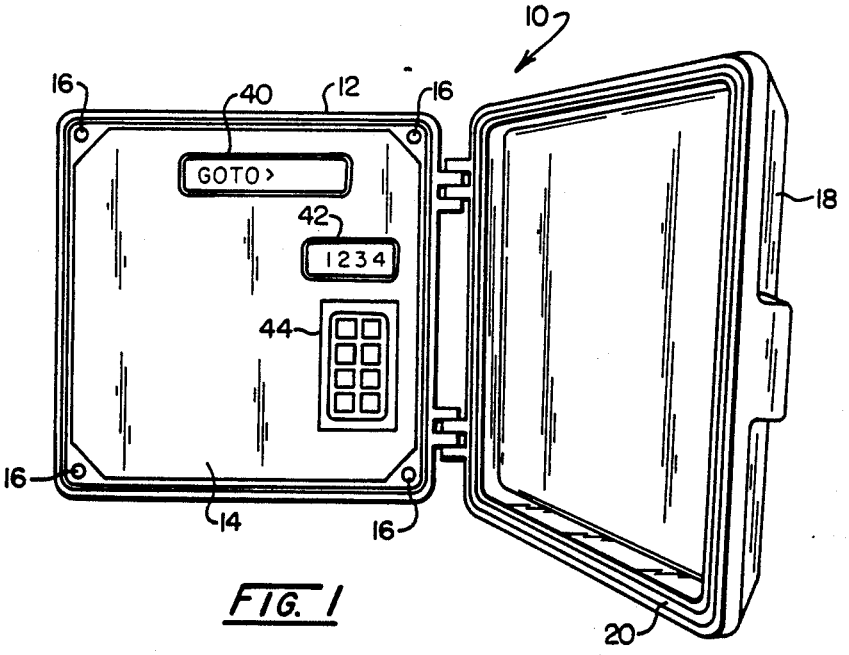
FIG. 1 is a pictorial representation of the front portion of a controller according to the invention.
Figure 2:
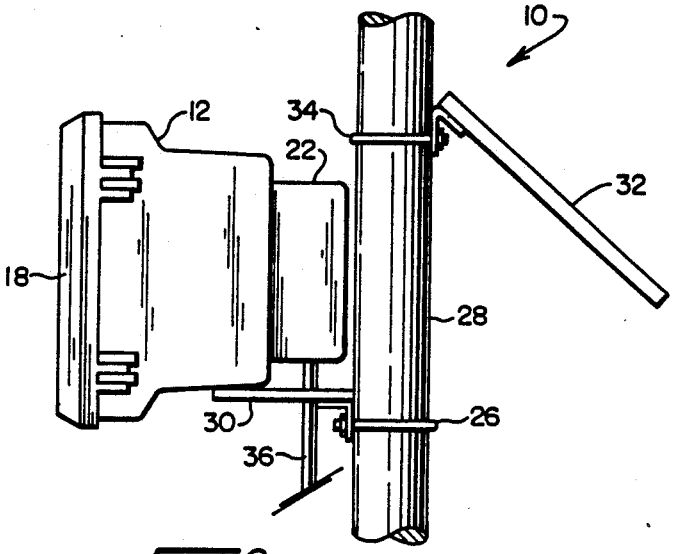
FIG. 2 is a side elevational view of the controller of the invention.

Referring to FIGS. 1 and 2, the overall structure of the controller of the invention is revealed generally at 10. The controller 10 is contained within a highly secure water-tight housing, inasmuch as the environment within which it is called upon to perform often will be quite severe. This housing is, for the most part, configured as described in U.S. Pat. No. 4,532,052 by Norwood, issued Aug. 6, 1985, and assigned in common herewith. The housing is formed having a principal housing component 12, the forward portion of which is seen in FIG. 1 to support a circuit housing or module 14. Module 14 is retained in place, for example, by screws as at 16 located at corners thereof and, in addition to carrying the circuitry of the controller 10, also functions to enclose an internal cavity within the principal component 12. A hinged front cover is shown at 18 which hingedly closes over the front or operational surface of the module 14 in water-tight secure fashion against housing component 12. The water-tight integrity of the arrangement is assured through the use of an O-ring seal 20 positioned within a corresponding groove within the inward surface of the front cover 18. Both the housing component 12 and cover 18 preferably are formed of an impact resistant fiber reinforced thermosetting resinous material and closure of the cover 18 may be maintained by an over-center latching device (not shown). FIG. 2 reveals a housing 22 for retaining rechargeable batteries as well as a bracket arrangement for retaining the device 10 in position including U-bolt 26 coupled to a supporting pole or the like 28 and further supporting a bracket 30 attached to housing component 12. Recharging of the batteries within the housing 22 is carried out by a solar panel 32 attached to the pole 28 by U-shaped bracket 34. Panel 32 may be provided, for example, as a Model G100 marketed by Arco Solar, Inc., a subsidiary of Atlantic Richfield Company, Chatsworth, Calif. Access conduit interconnection with the controller 10 is represented in general schematic fashion at 36. Because of the relatively extended number of control parameter inputs as well as, for example, valve controlling and switching outputs, the use of a solar activated power supply in conjunction with a rechargeable battery power supply becomes advantageous. However, as the description of controller 10 unfolds, it will be seen that energy conservation is achieved through the expendient of employing only temporary energization of transducers and the like in the course of the controlling function.

The access conduiting as represented schematically at 36 generally will lead to parameter measuring transducers, reading such variables as casing and tubing pressure, sales line flow and the like as well as to communication lines. Requisite operational flexibility has been seen to be obtained through providing a capacity for eight such transducers which function to transmit to the controller 10 in digital fashion at signaling frequencies. Such an arrangement considerably simplifies parameter readout transmission, for example over distances of about 300 feet. The device 10 also can be coupled with up to eight switch-type readouts providing binary data as to a given switch conditions. Additionally, outputs are provided for controlling either two variable output valves or up to four on-off or latching solenoid driven valves as heretofore commonly have been employed for control. Further, a plurality of controllers may be networked by employing common telephone line, for example, of distances from about 1500 to 6000 feet between installations. This communications feature also will be seen to incorporate a modem and resultant telephone access to a remote facility for monitoring and control.

Each controller 10 performs in conjunction with a predetermined listing of control, status, and communication parameters or variables which may number, for example, up to 256. These variables are treated in a highly efficient, expert computer system in accordance with any of a broad variety of custom control algorithms and in addition to conventional oil well control parameters such as pressure differentials and the like will include status information such as calendar information, time of day, seven-day and 24-hour averages, trends and the like. The flexibility of the controller 10 with this variable listing approach is such that it may be employed with wells ranging from the simplest to control to those requiring highly elaborate logic to achieve production. Further, the device may be employed to control such oil field auxiliary devices such as compressors and the like. In general, it will be seen that the lengthy variables list may be arranged in convenient subsets or "menus" suited for various forms of programs.

Because of the extensive number of variables treated in each stand-alone controller 10, a data management architecture will be seen to have been developed which is atuned to the needs of the oil field operator. In particular, the operator is given the kind of information normally required for the controlling function at the well head. This information will include the same form, albeit improved, as, for example, will have been developed by seven-day, two-pen charts and the like. In this regard, a "data log" is retained by the device which may be accessed by the operator in the course of well analysis during periodic visitations. Because of the needs of the operator, the readouts of device 10 are simple and access to the variables is made correspondingly simple, large multi-key structures being avoided and simple scrolling and command approaches being employed.

Returning to FIG. 1, the face of the device is shown to include an 8-digit liquid crystal display (LCD) message display or (alpha) readout 40 and a corresponding, 4-digit data display or (beta) readout 42. These readouts perform in conjunction with a communicator provided as a small 8-key keypad represented generally at 44. Looking additionally to FIG. 3, this keypad 44 is represented in magnified fashion, the keys being identified at 46–52. The variables of a given menu or subset of the variable listing can be sequentially scrolled or accessed by actuation of a dual function key 46 labelled "DOIT". Upon depression of key 46, a given variable title will be displayed at display 40, while the numerical value of that variable will displayed at output 42. Thus, where the variable is time of day, that title will appear at display 40 and the time of day will appear at display 42. Where the variable is one changeable at the site of controller 10, the image or value readout at display 42 will oscillate or "wink" to apprise the operator that the variable is changeable. To carry out such change, right and left arrow keys shown respectively at 48 and 49 are depressed by the operator to move the cursor of the display 42 as represented by a flashing digit either to the right or left. When the cursor is so located, then the numerical value of that digit may be changed by pushing an up arrow key 50 or down arrow key 51. The DOIT key 46 will increment through a given menu, and when depressed to move from one variable to the next will cause the execution of the control function represented by the earlier changed variable.

Key 47 labelled "GOTO" functions to decrement the display through the list of variables and, in particular, permits the operator to select and "jump" to a desired variable readout. This is carried out by depressing the GOTO key 47 whereupon the message "GOTO" will be displayed at display 40 and the number of the current variable within the scrolling list will appear at display 42. By manipulating the variable number at display 42 utilizing keys 48–51, the desired variable for display may be accessed and then displayed by depression of key 46. Not all variables need be accessible by the system, certain of such variables being reserved for management use including diagnostics and the like. Generally, all other variables are displayable by the operator manipulation of the keypad 44. Where an end of a given subset or menu of variables is reached, the last such variable therewithin will be a "load menu" function which permits the operator to access the other menus or variable subsets of the system. There may be, for example, 16 of such subsets of menus of the variables.

In addition to reading out pertinent variable data for a given well from a singular controller 10, that same controller may be employed access and obtain the same readout as well as provide command input to any other controller or controller network within a given oil field installation. Thus, where a well and associated controller are positioned in a relatively inaccessible location, the operator will be capable of access from a conveniently located controller within the network of the oil field installation. In this regard, each controller is assigned a unique serial number for achieving access. The same access can be provided even more remotely by telephonic communication via a conventional modem arrangement. Preferably, remote communication from location-to-location in a network of controllers is provided by a portable computer which generally is battery powered and hand-held.

To gain some insight into the type of information developed by the above-noted listing of parameters or variables which develop the expansive stand-alone control capability of controller 10, a consideration of typical types of well installations is necessary. Typically, each well will operate on an optimized basis in conjunction with a unique control program. Very often, demands for control production emanate from the marketing aspects of the oil and gas business. Such considerations also will enter into the control program for any given well or oil field installation having many wells. Looking to FIG. 4, an oil field installation incorporating controllers as at 10 is schematically portrayed. Four individual well installations are represented by blocks 56–59 and the number of wells for any given smaller field will vary, reaching, for example, 100 well installations in non-major fields. Accordingly, the number of wells may vary to some value "n" as represented in phantom at 60. A controller as at 10 provides stand-alone control for each of the well installations 56–60 and will be networked in "daisy chain" fashion as represented by communication lines 62–66 commonly joined at line 67 which is seen to branch at line 68 to a telephone linkage with a remote facility as represented by block 70 attached to a symbolic telephone network represented generally at 72. The gas production outputs for each of the well installations 56–60 are coupled by conduit generally referred to as a "sales line" which are respectively represented at 74–78. Lines 74–78 are coupled to a gas pipeline or sales line 80 which is part of a gas collection system. Such sales lines at 80 often are butressed with compressor installations as represented in general at 82. These latter installations may operationally impact upon the performances characteristics of the installations as at 56–60, particularly, during times of shut-down or the like. The controller of the instant invention may be employed to monitor the performance of the compressor installation as represented by transducers 84 and 86 functioning respectively to monitor suction and downstream pressure. In this regard, a controller is represented in the figure at 88 coupled with transducers 84 and 86 via respective lines 88 and 90 and with the network communication line 67 via line 92. The controller 88 may function, for example, to initiate a telephone call to a central office in the event of breakdown of the compressor installation 82.

Where the installations 56–60 are in very remote locations or in very difficult terrain as may be encountered for example in the Appalachian basin or similar areas, the operator may wish to read out important pressure data and the like from a controller at only one accessible well. The networking, which may be provided very simply, for example by 22 gauge telephone wire, gives this flexibility and where, for example five wells are located in difficult terrain during winter conditions, a considerable monitoring man-hour savings can be realized. Monitoring also can be carried out on a more elaborate scale by attachment of a portable computer to the network lines, for example, at a convenient location, for example at branch 92 located near a compressor installation. A tap for such a procedure is represented by block 94. Similar communications taps also are provided with each controller 10. Operator flexibility is considerable in carrying out control from a convenient location to well installations at remote positions. The degree of control made available with the controller of the invention is quite extensive, as will be detailed hereinafter.

Figure 5:
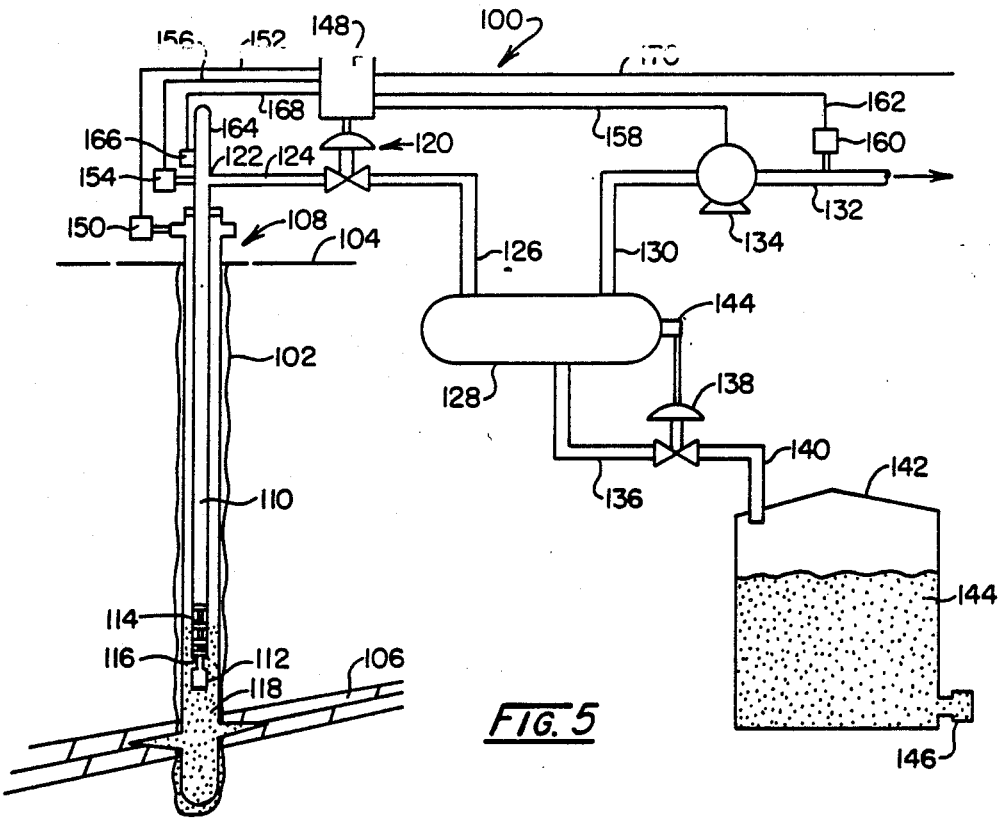
FIG. 5 is a sectional schematic view of one form of a well installation with components shown sectionally and out of scale.

FIGS. 5 through 9 illustrate various well installations which may be encountered in the field. Referring to FIG. 5, a well 100 is seen to include an elongate casing 102 which extends through the terrestial surface 104 to a strata 106. Strata 106 is present as porous rock over which an impervious cap is located. The resultant formation serves as a form of pressurized reservoir for oil, gas, water and the like. While the techniques for penetrating strata 106 with casing 102 vary from one installation to another, generally, the outer surface of the casing is sealed with conventional cementing procedures. Access to the strata or formation 106 following the placement of the seal may be provided utilizing a variety of techniques, for instance, controlled explosions or the like. Surface control over the well 100 is maintained from a well head 108 extending above surface 104. Head 108 incorporates appropriate hangers and seals which serve to support a tubing string 110 which extends from the vicinity of well head 108 to an open lower end 112 situate in the vicinity of the lower level of casing 102. In some installations, a plurality of tubing strings 110 are utilized, each extending to a predetermined geologic formation to evolve production at that location. The figure further reveals the presence of a plunger 114 near opening 112. This device is prevented from moving through the opening 112 by a constriction 116. With the plunger lift arrangement, well installation 100 is operated on a cyclical basis, being "shut in" for an interval during which gas pressure gradually elevates within casing 102 which gradually migrates through the tubing string 110 above plunger 114, such liquid being represented at 118. Such an accumulation is typically referred to as a "slug" of fluid and the extent of the slug within tubing 110 may be determined with respect to the difference in pressure between the casing 102 and tubing 110.

In general operations, a control program for the well 100 will provide, at an appropriate time, for the opening of a motor valve represented schematically at 120. Such opening permits the plunger 114 to be propelled from the lower end of tubing string 110 under the influence of the accumulated gas pressure. If this occurs, the slug of liquid and gas above plunger 114 moves through a horizontal "T" connection 122, a conduit 124, motor valve 120, conduit 126 to the input of a separator 128. Separators as at 128 are provided in a variety of configurations, 128 being depicted as a horizontal tubular device in which gas and liquid mixture enter from conduit 126, whereupon the velocity and directional flow thereof are altered to permit fallout of heavier liquids to the bottom, while gas products enter an outlet represented at conduit 130. Conduit 130 extends to a gas sales line 132 which, for the instant illustration, also is shown having a turbine meter 134 which functions to generate a frequency in proportion to the flow rate of gas passing through it. Another conduit 136 functions to collect the liquids from separator 128 and, upon actuation of another motor valve represented schematically at 138, such liquids are passed via conduit 140 to an oil and water storage facility represented as a tank 142. Valve 138 is seen to be controlled from an assessment of the fluid levels in separator 128 as represented by a level control sensing arrangement 144. Within tank 142, oil representing a valuable product of the installation 100, as well as water as represented at 144 are retained at variable levels, a natural form of separation taking place prior to removal by trucking or the like through a valve as represented at 146.

Control over the installation 100 may be provided by the controller described earlier herein at 10 and represented by block 148 in FIG. 5. Consideration for a desired control program for the well 100 typically will be concerned with a readout of casing pressure as developed by a transducer represented at block 150 having an output lead wire 152 extending to controller 148. Additionally, tubing pressure will be evaluated, for example, by a transducer as represented at block 154 and shown electrically coupled to the controller 148 via line 156. As a basic control, with the input from transducers 150 and 154, producing the well by opening valve 120 can be predicated upon the casing pressure being at least as high as a set point value and the difference between casing and tubing pressure, the latter being measured at transducer 154, being below a predetermined set point. Gas flow quantities as measured at meter 134 may be monitored as represented at line 158 by controller 148 for a variety of purposes. For example, in gas markets, there may be an allocation restriction limiting the quantity of gas purchased per month. Where this occurs, then the information developed from meter 134 becomes a controlling parameter to which the controller 148 will respond. Control over production also may require monitoring of sales line pressure as represented by transducer 160 coupled to sales line 132 and shown electrically coupled to controller 148 via line 152.

Figure 4:
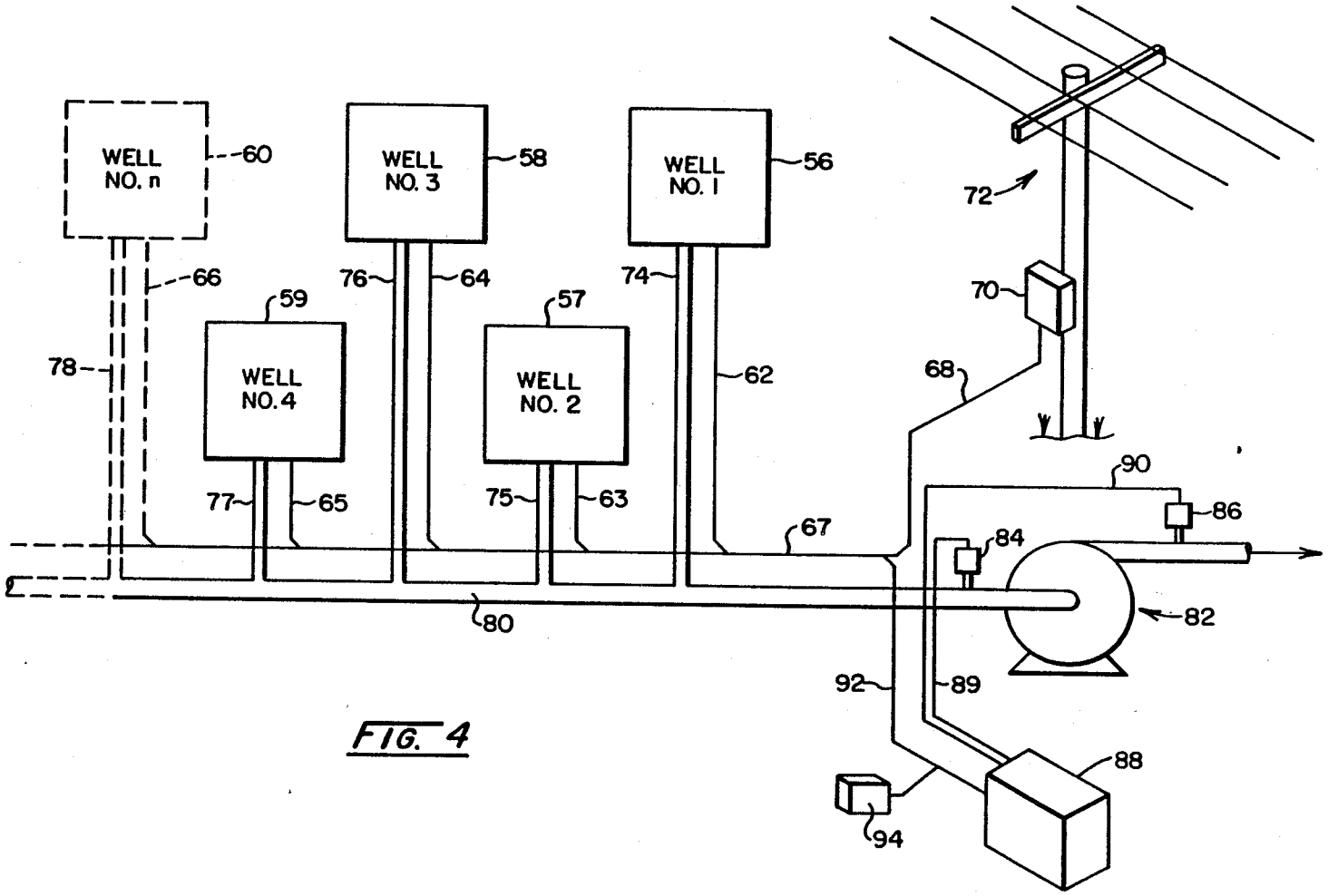
FIG. 4 is a schematic representation of a grouping of well installations employing the controllers of the invention arranged in network communicating fashion.

An additional parameter may, for example, be concerned with the performance of the plunger 114 in concert with a production cycle. As valve 120 is opened to commence such a cycle, the plunger 114 eventually will ascend until reaching a bumper region 164 of tubing string 110. Its arrival at that location may be monitored by a proximity switch or the like as represented at 166 and shown electrically coupled to controller 148 via line 168. Plunger arrival times also may be valuable information for the operator for analysis purposes and may, for example, be logged as data by device 148. Networking controller 148 with other controllers and the like as described in conjunction with FIG. 4 is represented at line 170.

Figure 6:
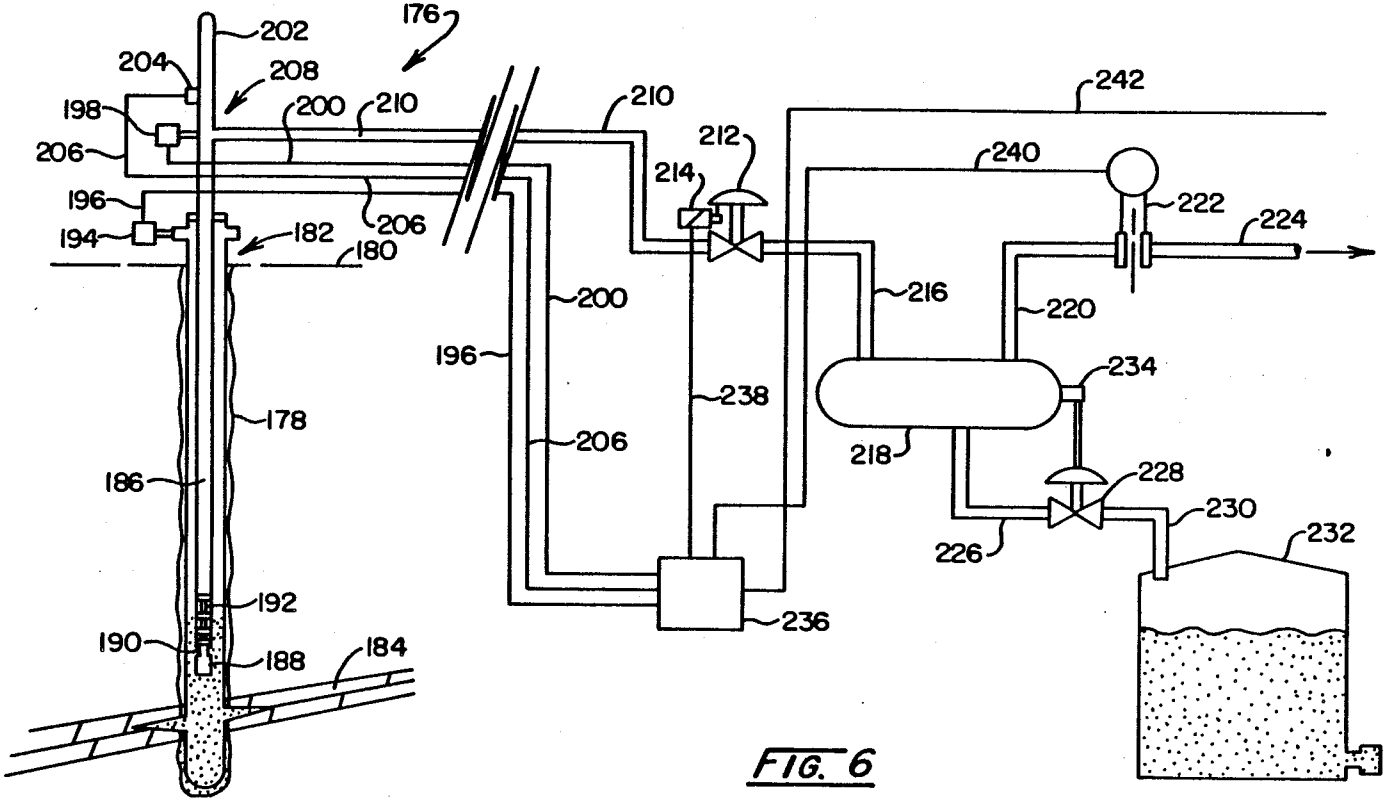
FIG. 6 is a sectional schematic view of another well installation with components shown sectionally and out of scale.

Referring to FIG. 6, a well installation similar to that of FIG. 5 but which may be encountered in mountainous terrain is schematically portrayed. In the figure, the installation 176 is shown to comprise, as before, a casing 178 extending into the terrain 180 from a well head represented generally at 182. Casing 178 is shown invading a strata 184 and includes a tubing string 186 with a lower opening 188 having a constriction at 190 limiting the downward travel of a plunger 192. As before, casing pressure is monitored by a transducer represented at block 194 having a lead line 196 extending therefrom. Tubing pressure is monitored by a transducer represented at block 198 having a transmission line 200 extending thererom and pluger arrival at bumper region 202 of tubing string 186 is monitored by proximity switch 204 having an output represented at line 206. The output of the tubing string 186 is passed through a horizontal T connection 208 to conduits 210. The distance of the well head 182 from the motor valve and associated control for the instant example may be quite extensive, for example, 1500 to 2000 feet. Typically, a motor valve as at 212 is positioned within the sales line conduit 210 at this remote location and is actuated pneumatically in response to a solenoid actuated valve, here represented at 214. As before, the output of motor valve 212 is directed via conduit 216 to a separator facility 218. Gases separated at facility 218 are shown directed via conduit 220 to an orifice meter 222 and thence as represented at conduit 224 to the sales line of a receiving utility or the like. Fluids from separator 218 are shown being directed via conduit 226 to a motor valve 228 and thence via conduit 230 to tank 232. Dump valve 228 typically is controlled from a flow actuated device coupled with separator 218 as represented at 234.

The controller for well installation 176 may be positioned at the location of the separator 218 and tank 232 which would be situated at an accessible location in the mountainous terrain represented by the example. Thus, a controller as described at 10 earlier herein is represented at block 236 coupled to the earlier-described lengthy communication lines 196, 200, and 206. The latter lines may be placed with the piping leading to the well 176 and the lengthy communication involved becomes practical with the installation by virtue of the employment of transducers as at 194 and 198 having frequency related or digital outputs. With the arrangement, motor valve 212 is shown being controlled from solenoid valve 214 via signal line 238 which will be of relatively limited length, for example 20 feet. Orifice meter 222 is shown communicating with controller 236 by line 240 and networking communication for the controller 236 is represented by line 242. Meter 222 functions to measure the flow rate of gas and thus the information supplied via line 240 must be converted by the computational capabilities of controller 236. Because of the distances involved between the motor valve 212 and the well installation 176, the control for such an installation may be based more on timing than the measurement of pressures and the like. Thus, where such cycling is involved, the readouts from such items as transducers 194 and 198 and switches 204 may be employed to develop a data compilation or "data log" for apprising the operator of well performance. As before, this data log, as it relates to the values of casing pressure and tubing pressure, as well as the differentials therebetween and trends and both emulates the earlier two pen chart and supplies additional data for the operator to absorb at the site. Of course, the convenience of controlling remotely from well 176 cannot be overstated.

Figure 7:
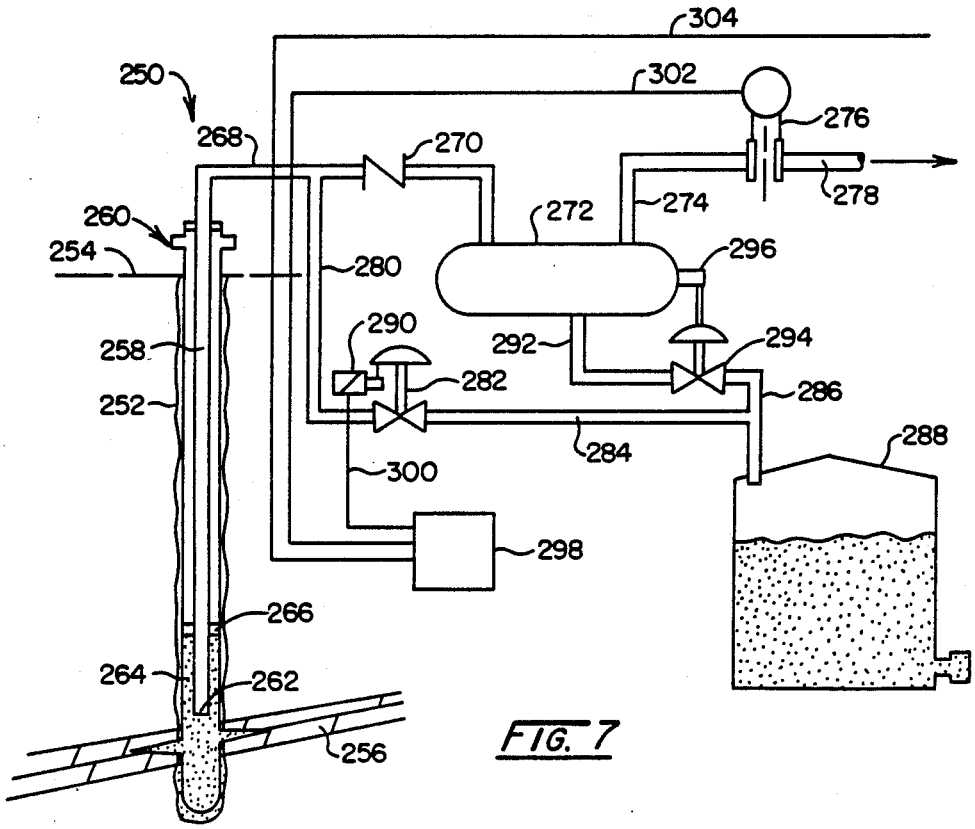
FIG. 7 is a sectional schematic view of still another well installation with components shown sectionally and out of scale.

Referring to FIG. 7, a representation of a relatively young and good or self-cleaning well is provided at 250. Well 250 is shown having a casing 252 extending from terrestrial surface 254 through a strata 256. A tubing string 258 is shown extending from well head 260 to an opening region therein 262 positioned within fluids 264 accumulating in the well. Packing or the like 266 secures the lower end of the tubing string. Plunger lift is not required in this well and thus conduiting 268 is shown extending through a flapper valve 270 to the input of a separator facility 272. As before, the output of the separator facility 272 at conduit 274 is seen to extend to an orifice meter 276. The output of orifice meter conduit 278 extends to or may be considered a sales line. Output conduit 268 is shown extending via conduit branch 280 to a motor valve 282, the output of which at conduit 284 extends to conduit 286 and tank 288. A solenoid actuated valve represented at 290 functions to control motor valve 282. Separator facility 272 is shown coupled to a conduit 292 leading, in turn, to a motor valve 294 functioning as a dump valve to release fluids into tank 288. Control of motor valve 294 is by a float actuated arrangement as at 296 coupled with separator 272.

The controller for well installation 250 is represented at block 298 and is shown having an operational output represented by line 300 for controlling solenoid actuated valve 290, and, in turn, motor valve 282. Additionally, the controller 298 monitors and computes the flow rates determined by orifice meter 276 as represented by line 302. Finally, the controller 298 may be networked with other wells within the field at hand as well as coupled to modems and the like for telephonic communication as represented by line 304. With the arrangement shown, the well 250 eventually will self produce for an interval toward the termination of which fluids will tend to accumulate within the tubing string 258. Such wells, for examples, may be cleared by essentially opening them to atmospheric pressure, in the present instance by opening motor valve 282 to couple the well's output with tank 288. To avoid backflow, the flapper valve 270 is positioned ahead of separator facility 272. Of course, as the well 250 ages, its production in the manner shown may become more difficult and plunger lift or the like will be required to be installed. Controller 298 will be seen to be readily adjusted to accommodate for the variations in control modes and programs, the device being readily adaptable from the simplest of controls with young, good wells to highly complex programs associated with marginal wells.

Figure 8:
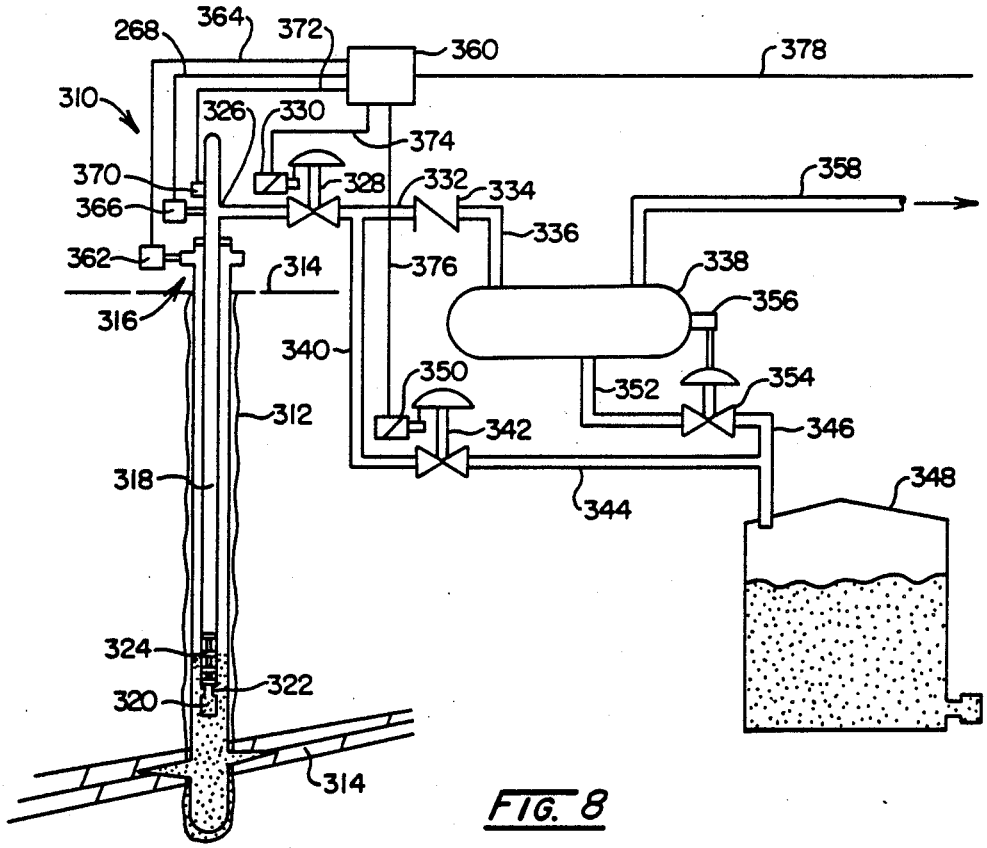
FIG. 8 is a sectional schematic view of another well installation with components shown sectionally and out of scale.

Referring to FIG. 8, a well facility which may be encountered in the field, for example as described in FIG. 4 and which exhibits more mature characteristics calling for more elaborate control procedures is revealed at 310. Well 310 includes a casing 312 extending from the terrestrial surface represented at 314 to invade a strata or the like as at 314. The well head 316 of well 310 also supports a tubing string 318 which extends to a lower opening region 320 having a constriction 322 which prohibits further downward movement of a plugner 324. Tubing string 318 is coupled at a horizontal T 326 to a motor valve 328 which is opened and closed by a solenoid actuated valve represented at 330 and the output thereof is seen to be directed via conduit 332 through a flap valve 334 and conduit 336 to a separator facility 338. Flap valve 334 prevents back flow into the tank when valve 328 is opened. Alternately, the fluids at conduit 332 may be diverted via conduit 340, motor valve 342, conduits 344 and 346 to tank 348. Control for this diversion of fluid to motor valve 342 is carried out by a solenoid actuated valve represented at 350. As before, the separator facility 338 releases fluids via conduit 352 to the tank 348 by the actuation of motor valve or dump valve 354. Valve 354 is so actuated by a level responsive actuator represented at 356. Delivery of gas from the separator facility 338 for introduction to a gas sales line is provided by a conduit 358.

Well 310 may be controlled by the stand-alone controller 10 of the invention, here represented at block 360. Casing pressure is monitored by a pressure transducer represented at block 362 which is associated with controller 360 as represented by line 364. Similarly, tubing pressure may be monitored by a transducer as represented at block 366, the control thereof and readout therefrom being represented by line 368. Plunger arrival may be detected by a proximity switch or the like represented at block 370, the signal output thereof to controller 360 being represented at line 372. Controller 360 also controls solenoid valve 330 as represented at line 374 to, in turn, control motor valve 328. Similarly, the controller 360 controls solenoid valve 350 and, thus, motor valve 342 as represented at line 376. Networking of controller 360 with other controllers in the immediate field as well as providing for telephonic access thereto is represented at line 378. An exemplary control carried out by controller 360 will monitor the casing pressure at transducer 362 as well as the tubing pressure as developed at transducer 366. When the casing pressure reaches a predetermined set point and the casing-tubing pressure difference is below a predetermined set point, then, valve 330 may be actuated to turn on valve 328 and move gas and fluids to separator facility 338. In the event that the noted casing-tubing pressure difference becomes too great during the process, then solenoid valve 350 is actuated to open motor valve 342 in addition to the open valve 328 so as to flow the well to the tank 348. As this occurs, the controller 360 is called upon to monitor the proximity device 370 for the arrival of plunger 324. As that condition occurs, then the valves 328 and 342 would be turned off. For weak wells, sales line pressure might be monitored at conduit 358 to be observed and factored into the control program. In this regard, the controllers as at 360 are readily capable of expanding to accommodate such control features without complex and time consumming reprogramming requirements such that the controller becomes available to smaller oil field operators.

Referring to FIG. 9, another control feature made available with the controller of the invention is revealed in conjunction with a well installation represented at 380. Well 380 is seen to have a casing 382 extending from the terrestrial surface represented at 384 to invade a strata represented at 386. The well head 388 of well 380 supports a tubing string 390 extending to an opening region 392 and having a constriction 394 limiting the downward travel of a plunger 396. Fluid 398 is shown accumulating in the lower region of the well 380. Casing pressure is monitored by a transducer represented at block 400 under the control of a controller as described herein at 10 and represented in FIG. 9 at block 402. Communication with the controller 402 is represented by line 404. Similarly, tubing pressure is monitored by a transducer represented at block 406 and shown electrically associated with controller 402 by a line 408. A horizontal T connection provides coupling of a conduit 410 with the upper region of the tubing string 390 for direction to a motor valve 412 which is controlled by controller 402 to provide a variable degree of opening. The output of valve 412 is directed via conduit 414 to a separator facility 416 having an output at conduit 418 extending or forming part of a sales line. The pressure of this sales line may be monitored by a transducer represented at 420 which is under the control of controller 402 as represented by line 422. Line 423 to controller 402 provides the earlier described communications and networking feature. Conduit 418 also is shown associated with a gas meter 424 of the pen and ink chart type which is employed by gas purchasing entities to determine the amount of gas supplied.

A conduit 426 is shown coupled to the bottom of separator facility 416 extending to a motor valve or dump valve 428 which is controlled with respect to fluid levels in the separator by a float activated device as represented at 430. The opposite side of valve 428 is coupled via conduit 432 to tank 434.

The variable output control achievable by the controller 402 over motor valve 412 serves to provide solution to a dichotomy of opposing gas production and sale considerations. The oil-gas producer has as a goal to generate the maximum amount of saleable gas and oil from the well 380. To achieve this a plunger as at 396 is desired for many wells. Thus, under normal operating conditions, where the motor valve 412 would be open fully at the commencement of a production cycle, a rather large spike of pressure is detected by the gas meter 424 which often will drive the pen therein off scale, a condition referred to as "spiking out". This results in a lost tracking of gas and an undesirable effect on the sales line. As a consequence, many prospective gas purchasers will not purchase gas from a plunger lift type well as at 380 and the operators then are called upon to operate without plunger lift and at lesser levels of production efficiency. With the variable output valve control, arrangement is made such that the well 380 is shut in until casing pressure is at a recovered set point and the casing and tubing pressure difference is within acceptable limits. For the instant application, the well 380 then is opened on a graduating basis, for example, selected from 5% to 50% over a predetermined interval of time, for example 10 or 20 minutes. Thus, the initial pressure surge or pressure head is controlled and by the time the well is, for example 50% open, the high pressure head of gas will already have passed and the well will be flowing its liquids. Further, the plunger 396 may have run by that point in time and the well is flowing gas at a relatively steady rate permitting further opening of the valve 412. Looking additionally to FIG. 10A, a sample output control for the controller 402 based upon the gradual opening of motor valve 412 is portrayed in tabular form. FIG. 10A shows this same tabular form as a graph showing valve opening in stepped graduation then as represented by a curve 436. The controller 402 is capable of providing such valve openings even though a pressure activated motor valve 412 as is common in the instant industry is employed. In this regard, the controller is capable of providing a modulating signal to maintain a given percentage of openings notwithstanding the otherwise altering changes in valve opening due to pressure changes at conduits 410 and 414. Thus, the advantage of graduated opening of the motor valve 412 is achieved and the classic motor valve is retained in the system, a device familiar to well operators thus enhancing their competence in the control arrangement. As before, the controller 402 will be seen to be readily adapted for this control function without time consuming reprogramming procedures or the like. Variable valve opening control also is achieved with the motor valve 412 without undue consumption of the limited electrical power supply available for the controller 402.

Figure 11:
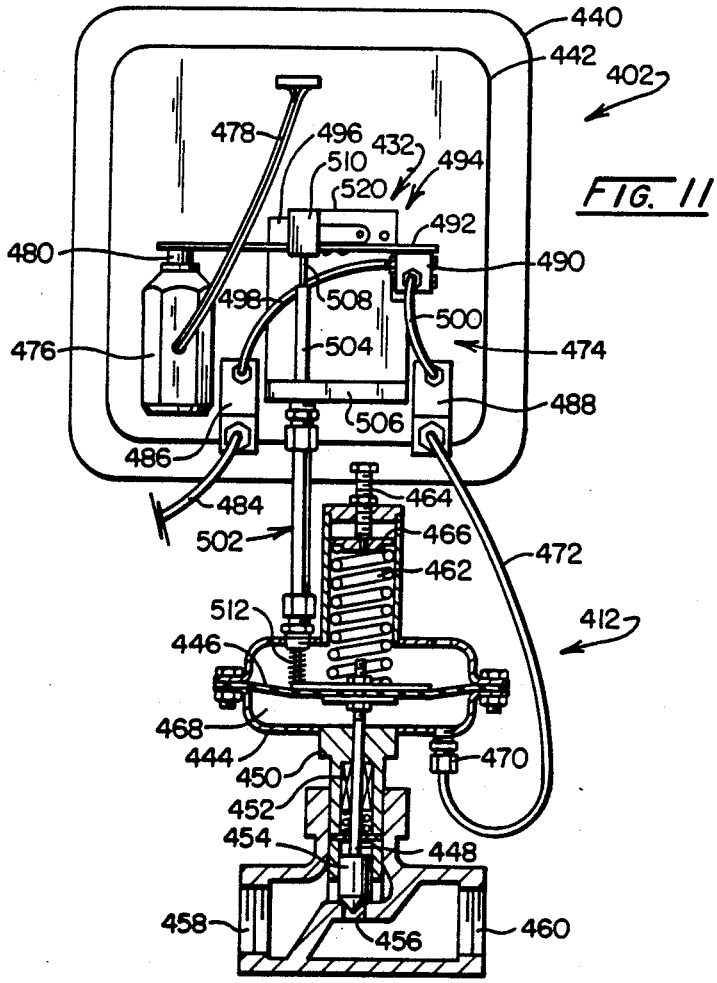
FIG. 11 is a partially sectional view of a motor valve and control components associated thereith for providing variable opening control.

Referring to FIG. 11, a more detailed representation of a controller as at 402 as it is associated with a control for effecting a variable opening of the motor valve 412 is revealed. In the figure, the controller principal housing is shown at 440 extending to a rear face 442. Housing 440 is mounted by brackets (not shown) or in a suitable mounting arrangement such that it is positioned above the diaphragm chamber 444 of a motor valve such as that schematically portrayed at 412 in FIG. 9 and identified in general by the same numeration in FIG. 11. Motor valves as at 412 may take any of a wide variety of configurations, however, this form of valve and the actuation thereof is a familiar component in the oil field industry. Generally, the valve will include a flexible diaphragm 446 within the diaphragm chamber 444. Attached centrally of the diaphragm 446, is a valve stem 448 which slideably extends through a support component 450 containing packing and the like 452 and which is attached at its lowermost portion to a plug 454. Plug 454 is movable with respect to a valve seat or opening 456. The latter opening is arranged so as to provide a fluid control between conduit sides 458 and 460. Diaphragm 446 and, thus, stem 448 and plug 454 are biased into a seating engagement with seat 456 by a coil spring 462 having a compressive adjustment provided by bolt assembly 464 adjusting the relative position of a spring seat 466. By applying pressurized gas to the lower chamber portion 468 of diaphragm chamber 444 through a connection as at 470, the position of plug 454 with respect to seat 456 may be adjusted. In typical motor valve operations for sales lines, solenoid actuated valves provide a 20 to 30 psi gas input through such connections at 460 to either fully open or fully close the plug 454 with respect to seat 456. However, with the instant control arrangement, a variable and controllable pressure is available for assertion through connection 470 via its linkage through gas conduit 472 to a stepper motor actuated proportional controller represented in general at 474. The stepper motor of this control is shown at 476 which is controllably powered from the control circuitry of controller 402 via lead assemblage 478 extending therebetween. For the instant embodiment, the output of motor 476 is linear, being provided, for example, by a worm gear drive to move a linear output shaft 480 inwardly and outwardly from the motor. The proportional controller is represented generally at 482 and functions to receive input instrument gas, for example at 30 psi, via conduit 484 which is connected to an L-shaped connector 486 and, in turn, provide proportionately controlling or amplified gas output at a corresponding L-shaped connector 488 coupled to conduit 472.

Proportional controller 482, for the instant embodiment, is of a "block and bleed" variety having an orifice-nozzle assembly 490 which performs in conjunction with an actuator or flapper 492 which is coupled to a compound pivotal linkage 494 pivotally connected, in turn, to an L-shaped rear support 496. Support 496, in turn, is fastened to face 442 of the housing 440.

With the arrangement shown, movement of the output shaft 480 of stepper motor 446 will cause the flapper 492 to be pivoted into or away from an orifice formed within the upwardly disposed surface of orifice-nozzle assembly 490. That assembly is seen to be supplied with instrument supply gas from tube 498 extending from connector 486 and provides controlling output gas via tube 500 extending to connector 488. The latter controlling output will position the diaphragm 446 and, thus, stem 448 and plug 454 with respect to seat 456. Additionally asserted at flapper 492, however, is a feedback representative of the position of diaphragm 446 and thus plug 454. This feedback is developed from a positioner linkage 502 which includes a tubular support 504 connected to outwardly extending ledge 506 of L-shaped support 496. Within the support 504 there is positioned a stiff positioner rod 508 which extends from an L-shaped contact 510 within compound linkage 494 to an abutting location against diaphragm 446. The rod 508 is shown biased against diaphragm 446 by a light helical spring 512. Thus, the position of flapper 492 with respect to the orifice-nozzle assembly 490 also is adjusted with respect to the position of the diaphragm 446 and plug 454.

Figure 12:
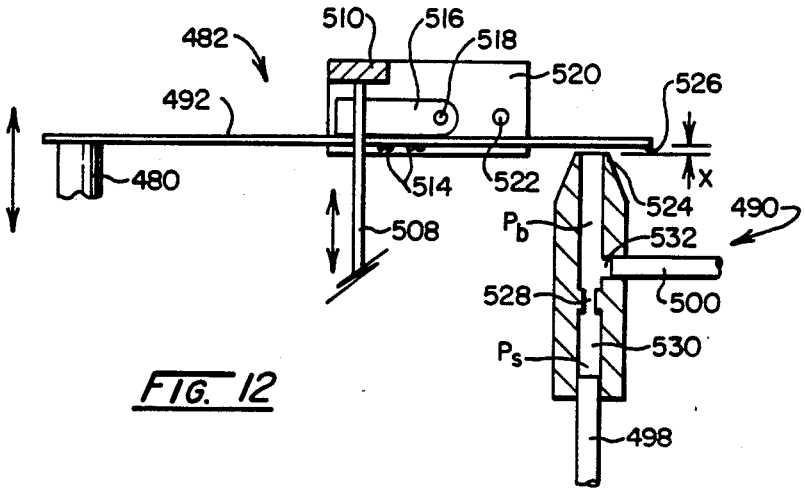
FIG. 12 is a schematic representation of a pneumatic proportional control arrangement.

Looking additionally to FIG. 12, proportional controller 482 is shown in broken away and schematized fashion in the interest of clarity. In the figure, it may be observed that the flapper 492, which may be fashioned of a thin sheet of spring steel or the like, is coupled by screws 514 to an arm 516 which is pivotally mounted at 518 to a second arm 520. Arm 520, in turn, is pivotally mounted to back support 496 at a pivoting axis 522. The L-shaped contact member 510 is shown in section extending from and integrally formed with arm 520 so as to provide an abutting contact with the positioner rod 508.

Orifice-nozzle assembly 490 is shown in schematized fashion as including a nozzle portion having a diameter, for example, of 0.015 in. spaced a distance, X, away from the bottom surface 526 of flapper 492. The nozzle extends through a bore to restriction or orifice 528 which will be of smaller diameter, for example 0.010 in. Supply gas is provided, as described above, from a conduit 498 for example at 30 psi to chamber 530 adjacent the orifice 528. The output of the assembly 490 is provided at tap 532 which is coupled with the output tube 500 and thence to the diaphragm chamber 468 through connection 470, conduit 472 and connector 488 (FIG. 11). In generalized operation, pressurized gas is fed through the orifice 528 from chamber 530 and is ejected from nozzle 524 towards the underside 526 of flapper 492. This gas will have a supply pressure, for example, as labelled "$P_s$." As is apparent, the nozzle 524 diameter must be larger than the orifice 528 diameter for proper functioning of the device which serves an amplification function. With the nozzle downward surface 526 positioned adjacent but spaced from the bottom surface 526 of flapper 492, a nozzle back pressure $P_b$ is developed which is controlled by the nozzle 524-flapper surface 526 distance, X. As the flapper surface 526 approaches the nozzle 524, the opposition to the flow of gas through the nozzle increases, with the result of the nozzle back pressure $P_b$ increasing. If the nozzle is completely closed by the flapper, the nozzle back pressure $P_b$ becomes equal to the supply pressure $P_s$. When the flapper surface 526 is moved away from the nozzle 524, the restriction to flow diminishes and the nozzle back pressure, $P_b$ takes on a correspondingly minimal value depending upon the device at hand. Thus, the pressure of gas at tap 532 and conduit or tube 500 is controlled by the position of the flapper on surface 526.

By combining the above form of pneumatic amplifier with a feedback developed from the positioner rod 508, a technique is provided for opening and closing motor valve 412 to seat plug 454 against seat 456 in a manner dictated by the controller 402 output to stepper motor 476. Any variations in pressure and the like which may otherwise alter the valve setting will be accommodated for with this arrangement. Of particular value in the arrangement shown, the stepper motor 476 only is energized for a particular setting and then holds that setting without further energization. Thus, the limited electrical energy resources of the controller 402 are conserved. Further, should any breakdown occur in the controlling operation, the well will continue to produce at the fixed stepper motor 476 setting.

Figure 3:
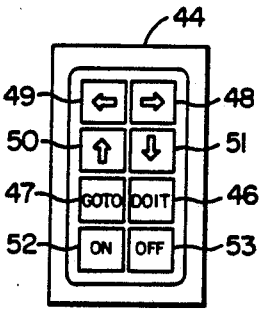
FIG. 3 is an enlarged view of the keypad of the controller shown in FIG. 1.

The circuitry employed by the controller of the invention utilizes a CMOS 8-bit microprocessor, for example a type CDT 1802 marketed by RCA, Inc. and which performs in conjunction with varity of peripheral components. Looking to FIG. 13A, the microprocessor is shown at 540 having its data ports DP0–DP7 coupled to an 8-bit bidirectional data bus 542 and its memory terminals MA0–MA7 coupled to an 8-line memory address bus 544. Status (flag) information is transferred to the processor 540 at four input terminals EF1–EF4 as shown at line grouping 546. Timing pulse terminals, TPA–TPB are shown coupled via lines 548 and 549 extending to the corresponding terminals of a type 1853 decoder 550. Decoder 550 responds to output signals at the N0–N2 terminals of microprocessor 540 at line grouping 552 to provide a corresponding sequence of eight output lines shown grouped at 554 and labelled IO1–IO7 for carrying out necessary strobing of output devices such as valve drivers and the like. Read states are indicated at the $\overline{MRD}$ terminal as developed at line 556 while corresponding write pulses are provided at the $\overline{MWR}$ terminal at line 558. An interrupt input is provided at the $\overline{INT}$ terminal via line 560 and the two-level state code outputs are provided at terminals SC0 and SC1 as shown at lines 562 and 564. A set-reset output can be provided at the Q terminal of device 540 as developed at line 566 and a power-up reset network is provided at 568 having an output at line 570 coupled to the $\overline{RST}$ terminal. Network 568 is formed having an R-C network comprised of resistor 572 and capacitor 574 coupled between source VDD and ground and tapped at line 576 which, in turn, is coupled to the inputs of a two input NAND Schmitt trigger 578, the output of which at line 580 is coupled to a second such NAND Schmitt trigger 582 having an output at line 584 labelled $\overline{RESET}$ and extending to line 586. Line 586 also extends to the output of another NAND Schmitt trigger 588 which responds to develop a reset signal upon the occurrence of depression of the right arrow and GOTO switches represented at key components 47 and 48 (FIG. 3). Finally, the source VDD is shown coupled to line 570 in conjunction with resistor 590 and filtering capacitor 594. A clock input to the microprocessor 540 is provided from line 596 and is developed from oscillator components described later herein. Finally, the timing pulses TPA and TPB are shown directed to the circuitry from respective lines 598 and 600.

Figure 13B:
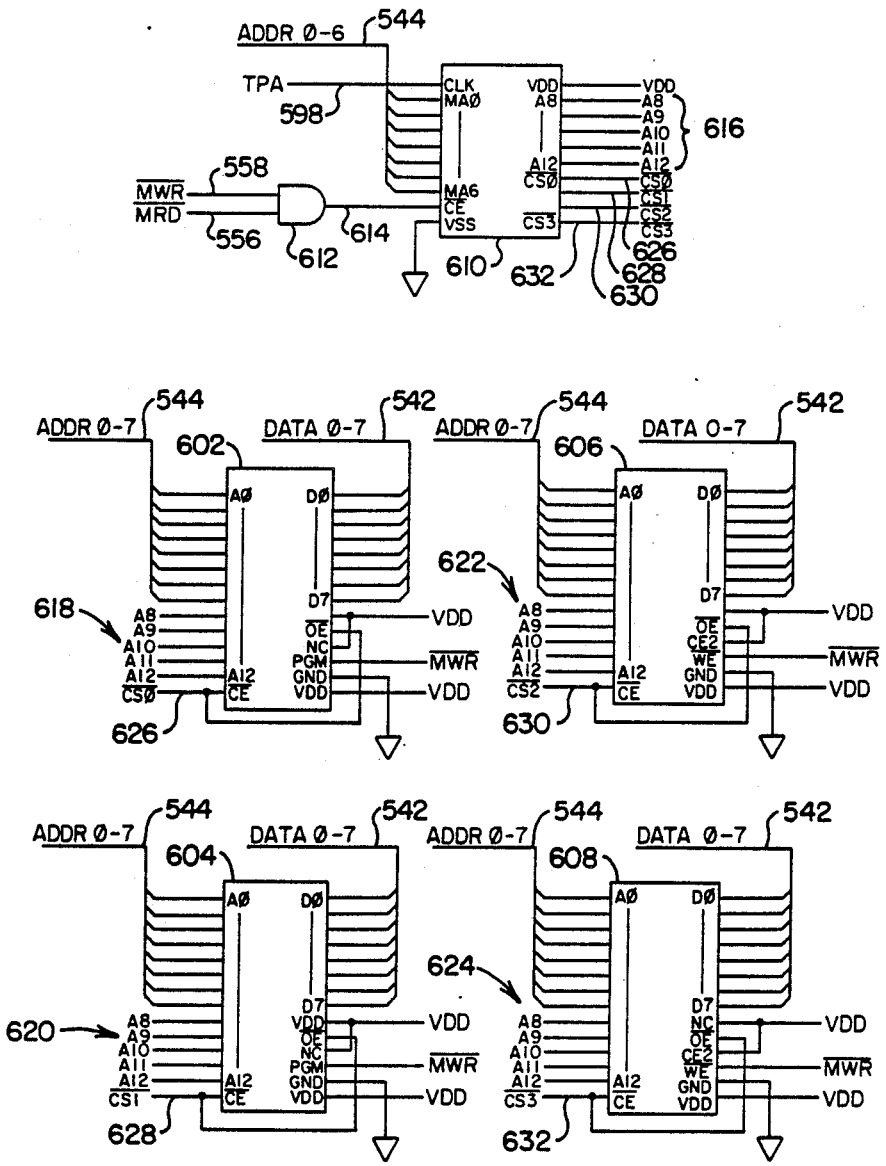

Looking additionally to FIG. 13B, the memory architecture associated with microprocessor 540 is revealed. This memory includes two 8K×8-bit, 16K read only memories (ROM) 602 and 604 which may be provided, for example, as type 27C64 and two 8K×8-bit random access memories (RAM) 606 and 608 which may be, for example, provided as type CDM 6264 LSI static ram devices. Accessing of the memory devices is provided from a CMOS 7-bit latch and decoder memory interface 610 which may be, for example, a type CDT 1883. Decoder 610 is enabled from the read-write outputs of microprocessor 540 via earlier described lines 558 and 556 which are logically ORed at gate 612 to provide an input at line 614. The clock input terminal of the device is coupled for response to timing pulse TPA at line 598 of microprocessor 540 and the memory address terminals MA0–MA6 thereof are coupled with address lines 0 through 6 of address bus 544. Decoding outputs are provided at terminals A8–A12 so labelled and coupled to line grouping 616. These outputs are directed to corresponding terminals at line grouping 618 which is directed to ROMs 602, line grouping 620 directed to ROM 604, line grouping 622 directed to RAM 606, and line grouping 624 directed to RAM 608. Chip select terminal CS0 at line 626 is seen directed to the corresponding chip enable input of ROM 602, while, correspondingly, chip select line CS1 at line 628 is seen directed to the corresponding chip enable terminal of ROM 604. Chip select terminal CS2 at line 630 is shown correspondingly directed to the chip enable terminal of RAM 606, while chip select terminal CS3 at line 632 is shown directed to the corresponding chip enable terminal of RAM 608. Each of the memory devices 602, 604, 606 and 608 is shown having address terminals A0–A7 coupled to address bus 544 and having data terminals D0–D7 coupled to data bus 542 in conventional fashion.

Looking to FIG. 13C, the data bus 542 including leads DATA0–7 is shown being directed both to the transmit terminals TB0–TB7 and receive terminals RB0–RB7 of a programmable universal asynchronous receiver/transmitter (UART) 636. Provided, for example, as a type CDT1854, serial data in is received by the device at its SDI terminal via line 638 while, correspondingly, serial data out is provided from the SDO terminal thereof at line 640. The device is cleared from the reset signal described in conjunction with FIG. 13A at line 584, which line is shown directed to the $\overline{CLR}$ terminal of device 636. Strobing is provided by signals which are combined from the N0, N2 and TPD terminals of microprocessor 540 and shown, respectively in FIG. 13C at lines 642, 644 and 600. Similarly, the N2 terminal output of device 540 is seen directed to the CS2 terminal of UART 636 via line 646 and a UART interrupt signal (UINT) is shown provided at the INT terminal thereof and line 646.

Two clock inputs are made available for UART 636. Looking additionally to FIG. 13D, an oscillator-divider arrangement is revealed generally at 646. A principal frequency for the UART 636 is generated by a crystal containing oscillator network 648 including crystal 650, resistors 652 and 654 and capacitors 656 and 658. Network 648 is coupled with the PI and $\overline{PO}$ terminals of a 14-stage ripple-carry binary counter/divider 660. The counter 660 may be provided, for example, as a type CD4060 and functions to provide a UCLK1 output at line 662 extending from the Q4 terminal of device 660 and providing a 4800 Hz signal for 300 baud. The PO terminal of counter 660 is tapped at line 664 to provide a CLK2 signal which is directed as labelled to the clock input of a type D flip-flop 666. The Q output of flip-flop 666 at line 668 is directed to the corresponding clock input of another type D flip-flop 670, having an output at its Q terminal at line 672 labelled UCLK2 which functions to provide a 1200 baud signal for alternate presentation as labelled to the TCLK and RCLK terminals of UART 636 (FIG. 13C).

Figure 13F:
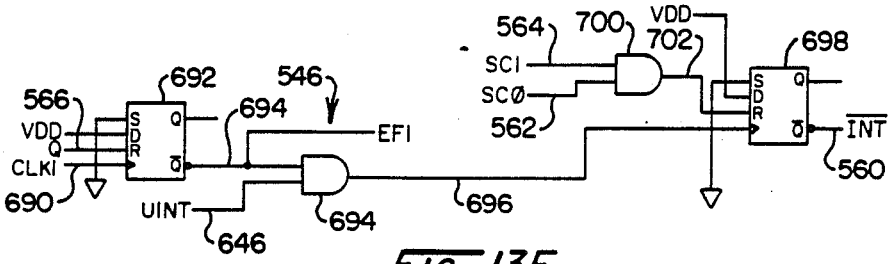
Figure 13D:
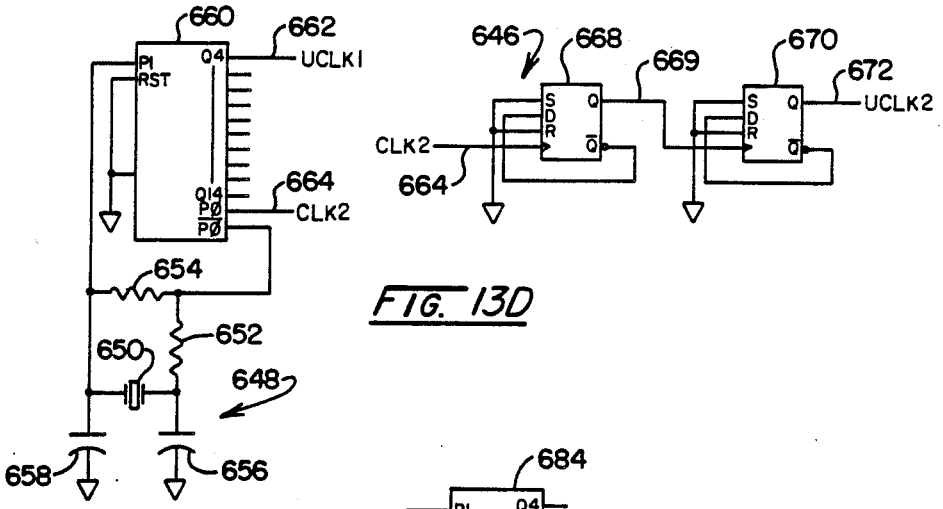
Figure 13E:
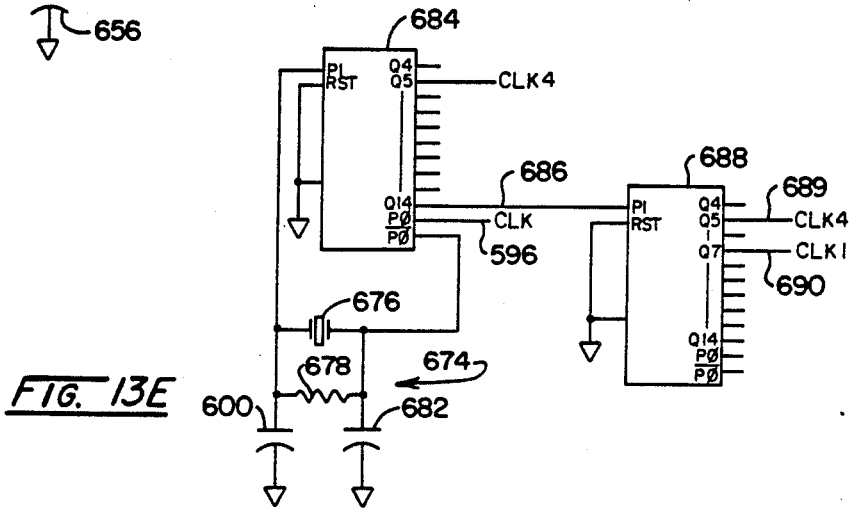

Turning to FIG. 13E, the principal clock for the microprocessor 540 is shown to include a crystal oscillator network 674 including a quartz crystal 676 operating in conjunction with resistor 678 and capacitors 680 and 682 which is coupled to the PI and $\overline{PO}$ terminals of another 14-stage ripple-carry binary counter/divider 684. The PO terminal of counter 684 provides the earlier-described CLK signal input to microprocessor 540 at lines 596 as labelled in FIG. 13E. The Q14 terminal of counter 684 is coupled via line 686 to the P1 input of another type PD4060 counter 688 to provide a CLK1 signal at the Q7 terminal thereof at line 690 which functions to provide an interrupt signal of convenient duration, for example 4 seconds employed by the microprocessor 540. Terminal Q5 at line 689 provides a CLK4 signal providing a one-fourth second timing pulse.

Turning to FIG. 13F, the treatment of the two interrupt signals employed with microprocessor 540 for purposes of identifying the particular interrupt signal at hand is revealed. In this regard, line 690, carrying the earlier described CLK1 interrupt signal (FIG. 13E) is shown directed to the clock inputs of a D-type flip-flop 692, the $\overline{Q}$ output thereof at line 694 being directed to one input of an NAND gate with Schmitt trigger action switch 94. The opposite input to gate 694 is the earlier-described UART interrupt signal deriving from line 646 (FIG. 13C) and correspondingly labelled herein. As part of the decoding feature, when a CLK1 interrupt signal is impressed from line 690, then the flag signal, EF1, assumes a logic low which is impressed via line 694 and the labelled line of grouping 546 to microprocessor 540 (FIG. 13A). The output of gate 694 at line 696 is directed to the clock input of D-type flip-flop 698 to provide a latched interrupt signal $\overline{INT}$ at the $\overline{Q}$ terminal thereof as represented at line 560 which extends to microprocessor 540 (FIG. 13A). Thus, a distinguishment can be developed between the two interrupt signals, one from UART 636, the other from the four-second clock interrupt impressed from line 690. Because the circuit must also unlatch the identified and latched interrupt, flip-flop 698 functions to respond to the output of AND gate 700 at line 702 extending to the reset terminal, R, thereof. Gate 700 is coupled to respond to the SC0 and SC1 signals from microprocessor 540 as developed at earlier-described respective lines 562 and 654.

Figure 13G:
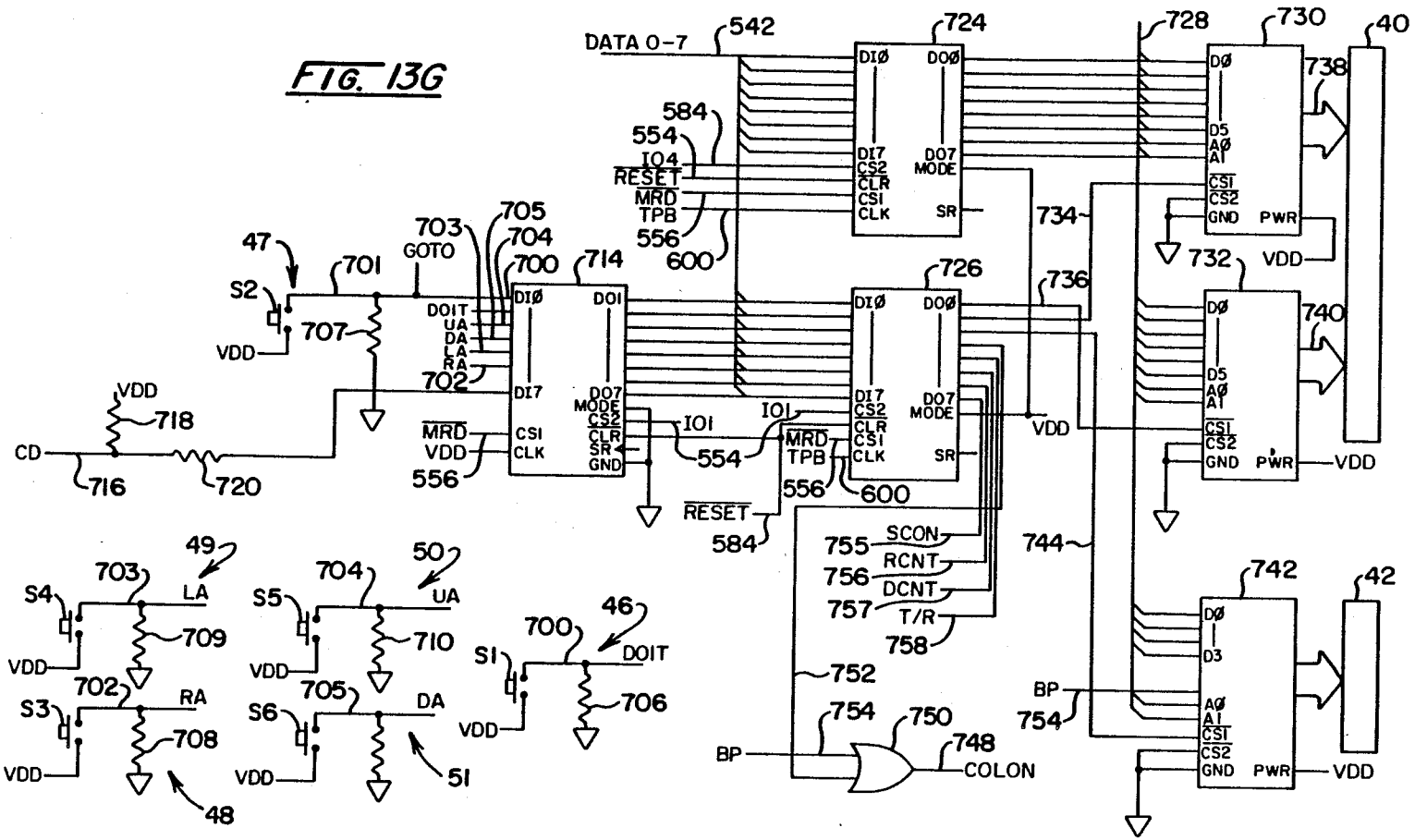

Referring to FIG. 13G, an input latching arrangement for treating the key actuations at keypads 44 (FIG. 3) are revealed and, additionally, the driving arrangement for the displays as at 40 and 42. Keys 46–51 are represented in the drawing by respective switches S1–S6 which are coupled between source VDD and respective lines 700–705. These lines are maintained in a normally low logic condition by virtue of the coupling thereof through respective resistors 706–711 to ground. Lines 700–705 are seen coupled to the data in inputs of an input latch 714 having its dta out outputs, DO0–DO7 coupled to data bus 542. Additionally, a carrier detect (CD) input is provided to latch 714 via line 716 incorporating resistors 718 and 720. The carrier detect signal is employed for response to an inputted telephonic signal, deried from a modem. Control over the latch 714 from microprocessor 540 is provided from the $\overline{MRD}$ output to the CS1 terminal thereof as well as an output IO1 from line grouping 564 to decoder 550. the latter signal, identified by the same line grouping numeration is shown extending to the CS2 terminal of latch 714.

FIG. 13G also shows output latches 724 and 726 coupled to data bus 542 at data input terminals DI0--DI7, each being provided as the eariler-noted type CDP1852. Latch 724 is seen to be controlled from the microprocessor 540 by coupling of its clock CLK terminal to the TDP terminal of microprocessor 540 via line 600, the coupling of its CS1 terminal to receive the $\overline{MRD}$ signal at line 556 and to receive signals at its CS2 terminal via terminal R4 of line grouping 554, here represented by the same grouping numeration with the appropriate label. Resetting of the device is from the $\overline{RESET}$ signal developed from line 584. In similar fashion, control is over output latch 726 from microprocessor 540 is provided from terminal IO1 of line grouping 554, the $\overline{MRD}$ signal from line 556 and a clock inpupt pulse from the TPD terminal at line 600.

The data out terminals DO0–DO7 of latch 724 are directed to a data send bus 728, eight leads of which are directed tot he D0–D5 and A0–A1 input terminals of LCD decoder/driver 730. A corresponding input from bus 728 is directed to the corresponding terminal of an identical driver 732. Provided, for example, as type ICM 7233, the drivers are enabled at their $\overline{CS1}$ terminals from the DO0 and DO1 terminals of driver 726 via lines 734 and 736. The outputs of drivers 730 and 732, as represented by respective arrows 738 and 740 are directed to the inputs of a liquid crystal display providing an eight-digit output as earlier-described in FIG. 1 at 40, that same numeration being employed inthe instant figure. The liquid crystal display may be provided, for example, as a type ICN7200 eight-digit CMOS display marketed by the Intersil Division of General Electric Company, Inc. Data send bus 728 also extends to connection with the D0–D3 and A0–A1 input terminals for an LCD driver 742, the chip select, $\overline{CS1}$ terminal which is controlled from latch 726 via line 744. The output of driver 742 is represented at arrow 746 shown extending to an LCD readout earlier identified in connection with FIG. 1 at 42 and identified in similar fashion herein. The colon input to display 42 is provided from line 748 extending from or OR gate 750 one input to which is provoided from latch 726 via line 752 and the other input of which is to the back plane signal deriving from latch 742. Driver 742 may be provided, for example, as a type ICM 7211, while the four digit display 42 may be provided, for example, as a type ICM 7211. Finally, output lines 755–758 of latch 726 provide frequency related control and the like as labelled, respectively, SGON, RCNT, DCNT, and T/R.

Figure 14B:
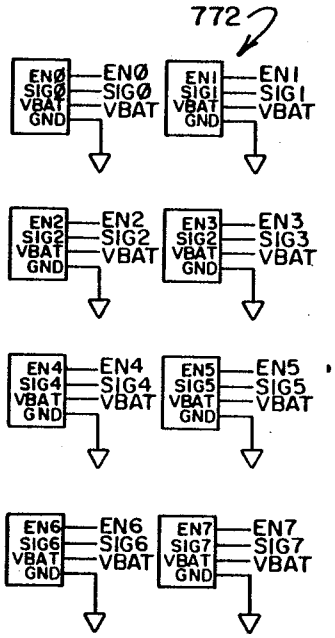
FIGS. 14A–14E provide a schematic representation of another control circuit of the controller of the invention.
Figure 14A:
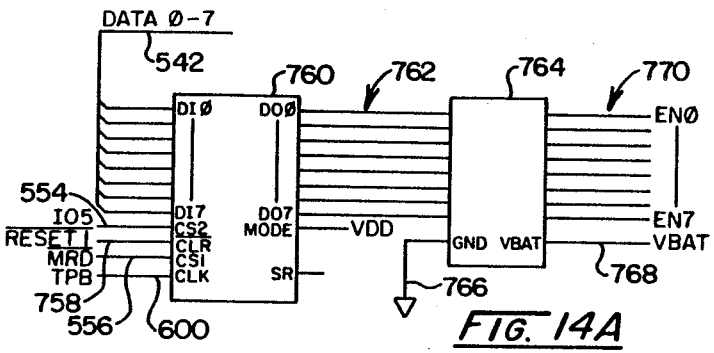
Figure 14C:
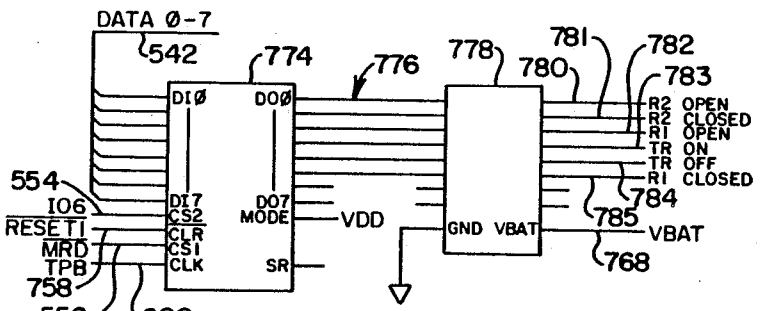

Turning to FIG. 14A, output circuitry for carrying out the polling of transducers is revealed. Data bus 542 is shown coupled to the data input ports DI0–DI7 of an output latch 760 which may be provided, as above, as a type CDT 1852. Latch 760 is controlled by receipt of the output of the TPB terminal of microprocessor 540 at line 600 at its CLK input. Additionally, the device is controlled at a CS1 terminal from the $\overline{MRD}$ terminal of the microprocessor as at line 556 and further through the signal applied from line grouping 554 as IO5 to its CS2 terminal. Clearing of device 760 is provided from the $\overline{RESET1}$ signal at line 758. The DATA OUT signals at terminals DO0–DO7 from latch 160 are provided at line array 762 for presentation to the input of a high-voltage, high-current Darlington transistor array 764. Device 764 is coupled to grouon through line 766 and receives energizing power labelled VBAT at line 768. Provided, for example, as a series ULN-2800A, device 764 provides eight transducer enabling signals, EN0–EN7, at array 770. The leads of array 770 are coupled to terminal outputs of the controller 10 for field connection to transducers. In this regard, looking to FIG. 14B, such terminals are revealed generally at 772 as labelled for each of the enabling output signals from line array 770. Note, that in addition to receiving the enabling signals, the terminals at 772 also carry the return leads for redirecting frequency constituted data from the individual transducers. These frequency signals are represented by the labels SIG0–SIG7. In general, all of these signals are joined together, inasmuch as the transducers are polled individually by the noted enablement. The terminals also uniformly receive power as labelled VBAT and are coupled in common to groun as labelled GND. The voltage applied for transducer activiation is temporary in nature as controlled from a relay. Ap Referring to FIG. 14C, the output circuitry for carrying out general relay control is revealed. In this regard, data bus 542 is shown directed to the data input terminals DI0–DI7 of ouput latch 774. Latch 774, which may be of the earlier-described type CDP1852 is controlled from terminal IO6 of lead grouping 554 as labelled thereon and is reset at is $\overline{CLR}$ terminal from $\overline{RESET1}$ line 758, while further control is provided at is CS2 and CLK terminals respectively from $\overline{MRD}$ at line 556 and TTB at line 600 emanating from microprocessor 540. The data out terminals, DO0–DO7 at lead array 776 are directed to the input of a high-voltage, high current Darlington transistor array 778 which may be of the earlier-described series ULN-2800A. Array 778 is powered from the VBAT input developed at line 768 and provides open collector outputs for relay actuation to opened and closed conditions at lines 780–785. Of the relay actuating outputs, lines 783 and 784 labelled, respectively. TRON and TROFF provide for selectively actuating the common VBAT terminal power supply at terminal array 772.

Figure 14D:
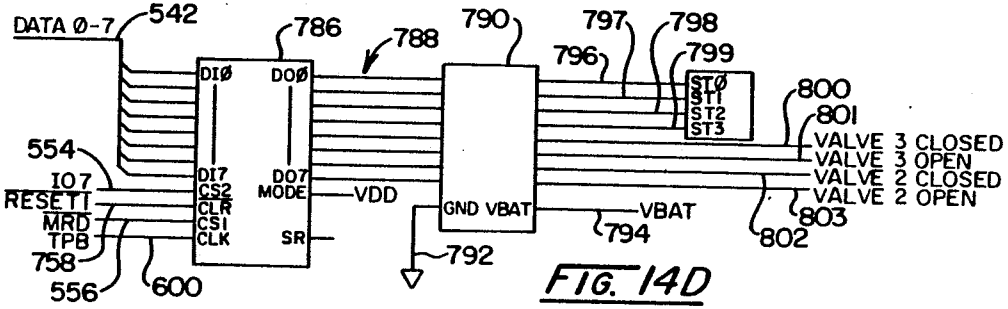

Referring to FIG. 14D, still another output latching arrangement is revealed. In this regard, data bus 542 is seen being directed to the data input terminals DI0–DI7 of output latch 786. Latch 786 may be a type CDP1582 and, as above, is seen receiving the output of the TPB terminal at line 600 from microprocessor 540 as directed to its CLK terminal input. Further, its chip select input CS1 is controlled from line 556 coupled to the $\overline{MRD}$ terminal of the processor and its chip select 2 terminal, CS2 is controlled from lead IO7 of lead array 554. The device is cleared at its CLR terminal from line 758 carrying the $\overline{RESET1}$ signal. The output of latch 786 at lead array 788 is directed to a high-voltage, high current Darlington transistor array 790 which is coupled to ground through line 792 and receives VBAT power input at line 974. The open collector outputs of device 790 are provided at lines 796–803. Of those lines, lines 796 through 799 provide signals ST0–ST3 employed for asserting control to stepper motor 476 (FIG. 11). Lines 800–803 provide for the opening and closing of three, two-position valves which may be employed with the controller of the ivention.

Looking to FGI. 14E, the derivation of the reset signal, $\overline{RESET1}$ is revealed. In this regard, locig supply voltage VDD is seen coupled to an RC network 804 including resistor 806 and detector 808 which are connected between the noted source and ground. The common connection between the components 806 and 808 is linked by dual leads 810 to both inputs of a dual input NAND gate 812. The output of gate 812 is coupled via line combination 814 to the corresponding dual input of NAND gate 816, the output of which is provided at earlier-described line 758. With the arrangement shown, a short power-up delay is provided by network 804 to permit integrated circuit power as a preliminary to activating output components.

Figure 15:
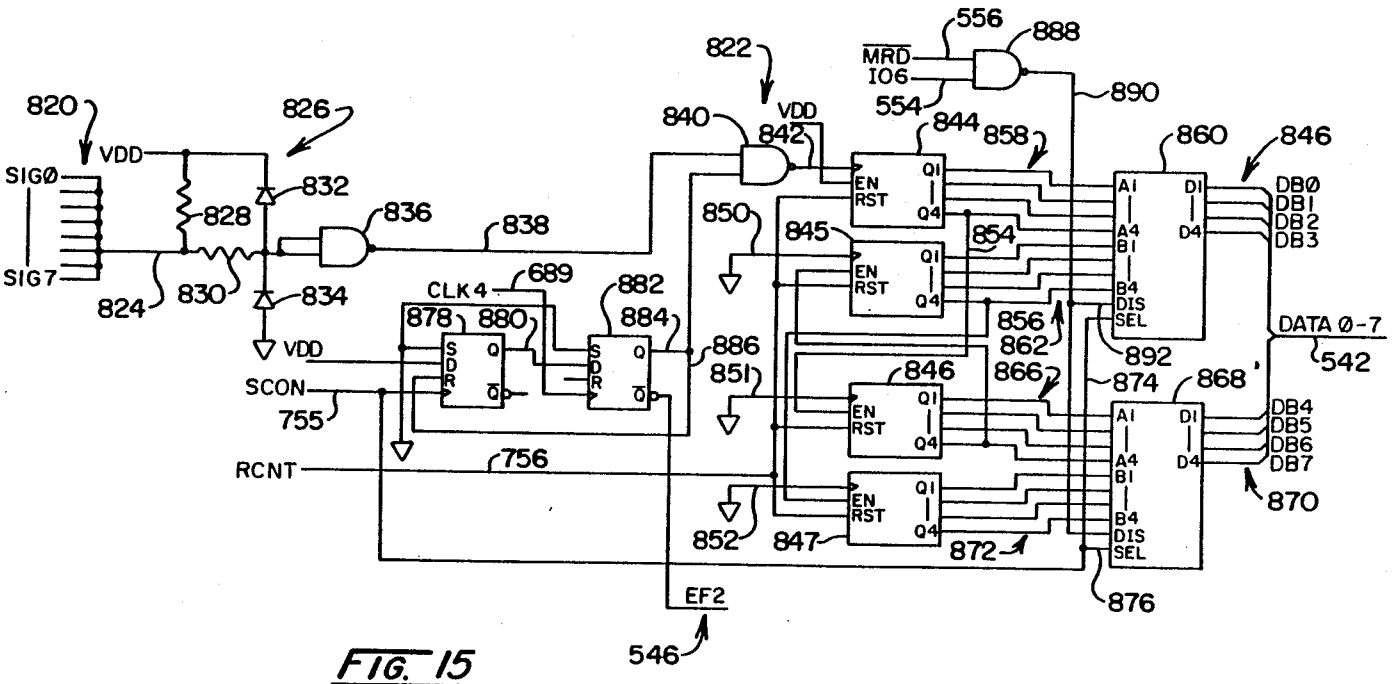
FIG. 15 is a schematic representation of one frequency evaluating circuit employed by the controller of the invention.

As noted in connection with terminal array 772 (FIG. 14B) the frequency charactgerized signals returning from the transducer dispersed within an oil well environment have been identified as SIG0–SIG7. Referring to FIG. 15, the signals SIG0–SIG7 are combined in common as represented by symbol 820 for presentation to a frequency evaluation circuit represented in general at 822. Common coupling of the signals is available due to the enablement logic as described in conjunction with FIG. 14A. From coupling 820, an enabled one of the frequency signals SIG0–SIG7 is directed as represented by line 824 to a signal conditioning network 826 comprised of resistors 828 and 830 in combination with diodes 832 and 834. Network 826 extends to both inputs of a NAND gate 836, the output of which at line 838 extends to one input of NAND gate 840. The output of gate 840 at line 842 is directed to the clock input of a first of four binary up-counters 844–847. These four stage counters may be provided, for example, as type CD4520 maketed by RCA Corporation. The counters can be cascaded in a ripple mode by connecting their Q4 terminal to the enable input of a subsequent counter while the clock input of the latter is held low. Thus, it may be observed that the clock inputs of counters 845–847 are coupled to ground through respective lines 850–852, while the Q4 terminal of counter 844 is coupled to the enable terminal of counter 846 by line 854 and the corresponding Q4 terminal of counter 845 is coupled to the enable terminal of counter 847 by line 856. Additionally, the Q1–Q4 terminals of counter 844 are coupled by four lead line array 858 to the A1–A4 terminals of a 2-line-to-1-line data selector 860. Correspondingly, four-lead array 862 is coupled to the D1–D4 input terimals thereof. The resultant four line output at terminals D1–D4 thereof is provided at lead array 862 labelled DB0–DB3.

In similar fashion, the Q1–Q4 output terminals of counter 846 at four-lead array 866 are coupled to the corresponding A1–A4 input terminals of 2-line-to-1-line data selector 868, the outputs of which at terminals D1–D4 are provided at four-lead array 870 labelled DB4–DB7. Finally, output terminals Q1–Q4 of counter 847 are coupled via four-lead array 872 to the corresponding input terminal D1–D4 of selector 868. A 16-bit word is developed for each frequency count, however, it must be asserted to an 8-bit data bus 542. Therefore, a demultiplexing function is employed with selectros 860 and 868. Data selectors 860 and 868 may, for example, be provided as type CD40257 marketed by RCA, Inc.

Selection of response to the A series terminals or B series terminals of data selectors 860 and 868 is predicated upon the logic level present at their select (SEL) terminals as established by lines 874 and 876. Line 876 is seen to extend to line 755 which carries the SCON or start conversion signal derived from earlier-described output latch 726 (FIG. 13G). The signal is seen in FIG. 15 to be directed to the clock input of a flip-flop 878. Provided, for example, as a type 4013, the Q terminal of flip-flop 878 is coupled by line 880 to the D input terminal of an identical flip-flop 882. The clock input of flip-flop 882 is coupled by earlier-described line 689 to the CLK4 time output of the microprocessor timing network described in conjunction with FIG. 13. As noted in connection therewith, this output provides a clock pulse at about a one-fourth second interval which is selected for the instant purpose of counting the pulses of the frequency signal at line 838. Thus, the Q input of flip-flop 882 is coupled by lines 884 and 886 to the opposite input of NAND gate 840. Additionally, line 886 is seen to be directed to the R input terminal of flip-flop 878 to effect resetting thereof. The $\overline{Q}$ output of flip-flop 882 provides one of the flags, EF2 asserted at microprocessor 540 from line grouping 546, the latter line grouping numeration being shown in the instant figure. Thus, the microprocessor is given information as to the presence of a counting condition. The same microprocessor is capable of controlling the output of data collectors 860 and 868 by virtue of assertion of the $\overline{MRD}$ signal at line 556 and the IO6 output from line groups 890 and 892 of which is seen to be directed to the output disable (DIS) terminals of the data selectors 860 and 868. Counters 844–847 are reset from the RCNC sitgnal developed from latch 726 and line 756.

Figure 16:
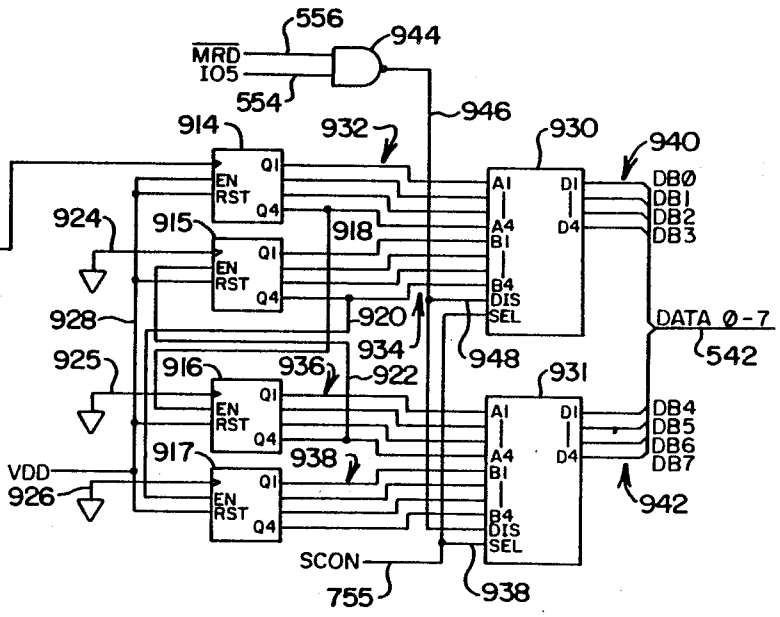
FIG. 16 is a schematic representation of another frequency signal counting circuit employed by the controller of the invention.

Referring to FIG. 16, another frequency signal counting circuit is revealed, however, the circuit of this figure is one which is free running in nature, being provided to monitor gas flow output signals and the like, for example a turbine meter 134 described in conjunction with FIG. 5.

Looking to the figure, frequency data from a given monitoring device is introduced to the circuit (FIN) at line 898. The pulse signal is conditioned at a network 900 comprised of resistors 902 and 904 operating in conjunction with diodes 906 and 908. Such conditioning sharpens the pulse edges. Following such conditioning, the signal is introduced to one input of NAND gate 910, the opposite input thereto being the disable count or enabling input DCNT described earlier in conjunction with latch 726 in FIG. 13G at line 757, which line is reproduced in the instant figure. The output of gate 910 at line 912 is directed to the clock input of a binary up-counter 914 provided as the first of a group thereof 914–917 which are cascaded in riple mode by connecting their Q4 terminals to the enable input of a subsequent counter while the CLK input of the latter is held low. Thus, the Q4 terminal of counter 914 is coupled by line 918 to the clock input of counter 916 and the Q4 terminal of counter 915 is coupled by line 920 to the clock input of counter 917. Additionally, the Q4 terminal of counter 916 is coupled by line 922 to the enable input of counter 915. The clock inputs of counter 915–917 are held to ground by respective lines 924–926 and the reset terminals of each of the counters 914–917 are shown to be coupled to source VDD inter alia by line 928. Thus, the counted 16-bit full count of the counter is directed to an 8-bit data bus 542. A demultiplexing function is carried out by data selector at 931 which may be of the earlier-described type 40257. In this regard, the four lead ouput 932 of counter 914 is directed to the A1–A4 terminals of selector 930, while the four lead output of counter 915 is directed by lead array 934 to the D1–D4 terminals of that selector device. In similar fashion, the four lead output 936 of counter 916 is directed to the A1–A4 terminals of selector 931 and the four-lead array output of counter 917 is directed by lead array 938 to the D1–D4 terminals of selector 931. Selection of the corresponding output for selectors 930 and 931 is provided by assertion of the select conversion (SCON) signal developed from latch 726 (FIG. 13G) at line 755 which line is shown directed to the SEL terminal of line 930 and additionally through line 940 to the corresponding terminal of selector 931. The four-lead ouput from selector 930 is represented at array 940 and that of selector 931 is shown at 942 being directed to 8-bit data bus 542. The enablement of selectors 930 and 931 is provided by the logic combination of the $\overline{MRD}$ signal of microprocessor 540 as described in conjunction with line 556 and the IO5 signal from lead array 554 as directed to NAND gate 944. The output of gate 944 is shown being directed to the DIS terminal of selector 931 via line 946 and by that line in combination with line 948 to the corresponding terminal of selector 930.

Figure 17B:
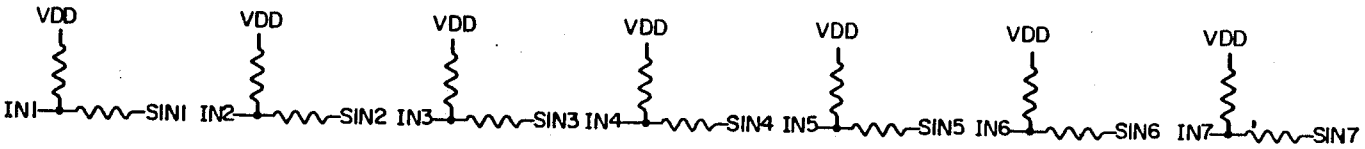
FIGS. 17A–17B provide a schematic representation of a circuit for monitoring switch contacts employed by the controller of the invention.
Figure 17A:
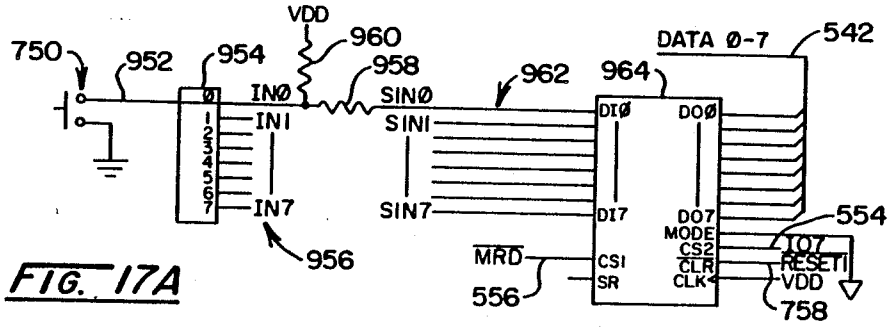

Controller 10 also responds to data in the form of external switch contact actuation. Referring to FIG. 17A, the input components associated with the monitoring of such switch contacts are revealed. In this regard, a switch is represented symbolically at 950 providing for the closure to ground of a switching line 952 of a line coupled to the zero connector of a wiring terminal 954. the resultant inputs are represented at line array 956 as labelled IN0–IN10. Each of these lines of array 956 are coupled to a resistor as at 958 and pull-up resistor 960 extending to source VDD. A result is the conversion of the signal to a switching in signal SIN0–SIN7, as represented at lead array 962. The corresponding pull-up resistor arrangements for each of the remaining lines IN1–IN7 are revealed with appropriate labels in FIG. 17B. Returning to FIG. 17A, the array of leads 962 carrying signals SIN0–SIN7 is shown directed to respective input terminals DI0–DI7 of an input latch 964. Provided, for example, as the earlier-described type CDP 1852, latch 964 is controlled from microprocessor 540 by application of the earlier-noted $\overline{\text{MRD}}$ signal to the CS1 terminal thereof as represented at earlier-described line 556; the position of signal IO7 from line grouping 554 as provided additionally in the figure leading to the CS2 terminal and a clear input from the earlier-noted $\overline{\text{RESET1}}$ signal provided from line 758. The D0–D7 data output terminals are shown coupled to data bus 542.

Figure 18:
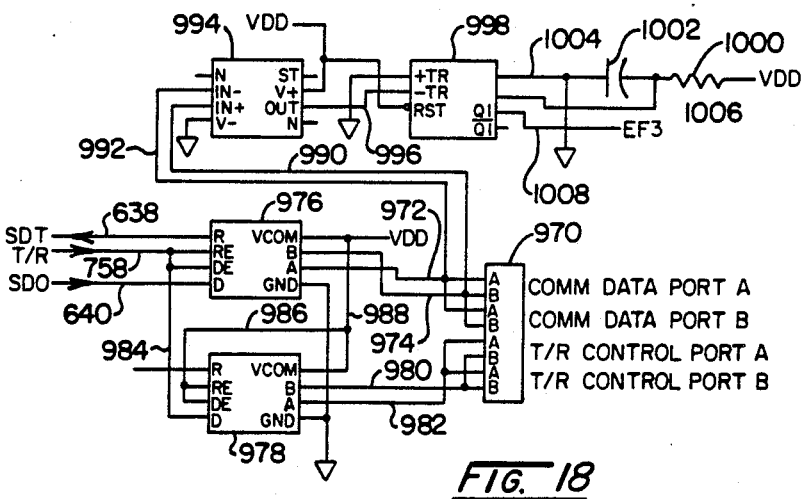
FIG. 18 provides a schematic representation of communication circuitry employed by the controller of the invention.

Referring to FIG. 18, the communications components of the controller 10 are revealed. The figure shows a terminal 970 having communications connectors for a data port A and data port B along with transmit/receive control output connectors for these ports. The communications data ports A and B are seen to be coupled via lines 972 and 974 to the respective A and B input terminals of a line driver 976 while the corresponding A and B terminals of the transmit/receive control ports A and B are coupled to the A and B terminals of a slaved line driver 978 by respective lines 980 and 982. Drivers 976 and 978 may, for example, be provided as type 96176 and it may be observed that the serial data input to UART 636 is provided as earlier-described at line 638 from driver 976 while the transmit/receive (T/R) signal derived at line 758 from output latch 726 is directed to the RE terminal of driver 976. Similarly, the serial data out (SEO) output from UART 636 as described at line 640 is represented at that same line identification in FIG. 18. The RF and DE terminals of driver 976 are seen to be coupled with the D terminal of driver 978 via line 984 and the RE and DE terminals of the latter driver 978 are seen to be coupled via lines 986 and 988 to the voltage source VDD. Where appropriate, a specific communication voltage level may be employed.

The communication data ports A and B additionally are tapped by lines 990 and 992 to provide activity status information. In this regard, the latter lines are directed to the inputs of an operational amplifier 994 which may be provided as a type 3160. The resultant output of amplification stage 994 is present along line 996 to the −TR input terminal of a one-shot multivibrator 998 which may be provided, for example, as a type 4538. One shot 998 is coupled with an RC circuit comprised of resistor 1000 and capacitor 1002 within line 1004, the center point of which is tapped by line 1006. The RC network is employed for pulse stretching purposes such that the data monitored either incoming or outgoing at terminal 970 will cause a constant high value to occur at line 1008 emanating from the Q1 terminal of multivibrator 998. Line 1008 is directed to the EF3 flag input to microprocessor 540 at line grouping 546.

Figure 19:
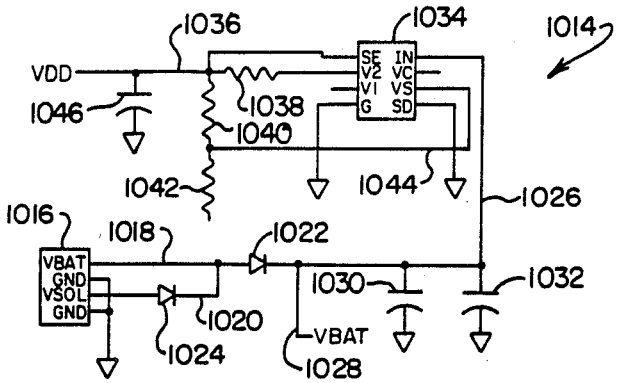
FIG. 19 provides a schematic representation of a voltage regulator network employed by the controller of the invention.
Figure 14E:
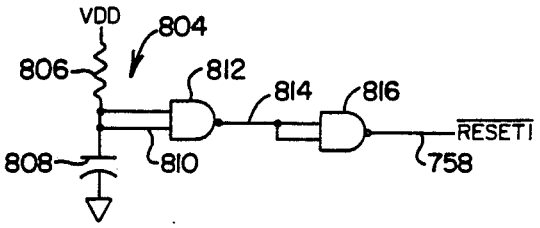

Referring to FIG. 19, a voltage regulator network of the controller 10 is revealed generally at 1014. Network 1014 employs the unregulated output from the battery source of the system as represented at terminal 1016 which is presented along lines 1018 and 1020 containing respective diodes 1022 and 1024 for presentaion to line 1026. The voltage VBAT is provided by line tap 1028 and line 1018 also may be seen to be coupled with filtering capacitors 1030 and 1032. Line 1026, in turn, is directed to the input terminals, IN of a programmable positive voltage regulator 1034. Regulator 1034 may, for example, be provided at type ICL 7663 and provides an output at its D2 terminal at line 1036 through resistor 1038. The voltage at line 1036 is monitored by divider resistors 1040 and 1042 operating in conjunction with center tap line 1044 which is directed to the DS terminal of regulator 1034. A capacitor 1046 provides a filtering function to line 1036 with the resultant logic voltatge VDD employed within the circuit as heretofore described.

Figure 20:
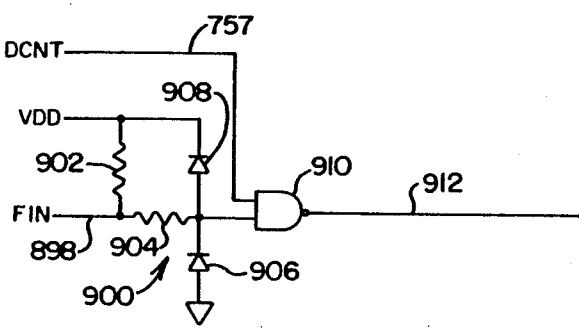
FIG. 20 provides a schematic representation of a battery voltage monitor network employed by the controller of the invention.
Figure 20:
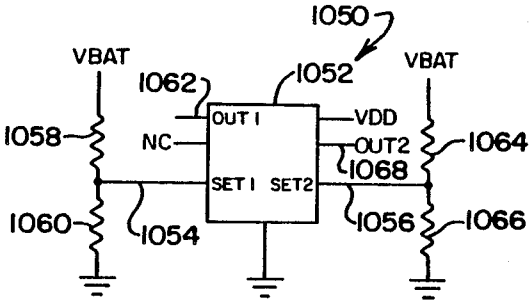

Rerferring to FIG. 20, a battery voltage monitor network is represented at 1050. This network is centered about anohter of the type ICL 7663 prgrammable positive voltage regulators as represented at 1052. The device 1052 is employed at its set points 1 and 2 terminals to receive an appropriately divided VBAT voltage from respective lines 1054 and 1056. The set 1 input responds to the voltage at the junction of divider resistors 1058 and 1060 to determine when the battery of the controller 10 has reached a fully charged condition such that charging should discontinue. When such occasion occurs, then an appropriate signal is provided at output line 1062. Resistos 1064 and 1066 form a voltage divider network responsive to VBAT to provide a signal level at line 1056 to set point 2 (SET2) representing a voltage level point for the battery wherein recharging should commence. At such level, an appropriate logic level is provided at output 2 (OUT2) line 1068.

To achieve a very high level of control by the controller 10 in its stand-alone status with a given well or oil field support installation a control system is developed wherein essentially all encountered variables or parameters of control initially are identified and listed. These listed variables or parameters then are treated in terms of an updating on a minute-to-minute basis such that the somewhat exhaustive compilation of parameters represent a current status of the well or installation being controlled. Subsets or menus of this listing then are treated in an expert approach wherein masking and pattern matching are carried out following which a processing of pattern matched variables is effected to achieve a control program unique for any given well. Because of this masking and pattern matching approach, a significant control capability is achieved employing conventional microprocessor driven components.

The following tabulation provides a listing of the variables or control parameters which are employed with the instant control system, the variable identification being associated with a variable number in hex format followed by a cursory description of each parameter represented by the variable.

TABLE 1

| Variable | Variable No. | Description |
|---|---|---|
| Group 1 | | |
| TOD | 01 | Time of day,hours, minutes, seconds |
| DAY | 02 | Day of the year number |
| CSG | 03 | Current casing pressure-PSI |
| TBG | 04 | Current tubing pressure-PSI |
| LINE | 05 | Current line pressure-PSI |
| FLOW | 06 | Current flow rate-inches water |
| TANK1 | 07 | Tank level |
| TANK2 | 08 | Tank level |
| TANK3 | 09 | Tank level |
| TANK4 | 0A | Tank level |
| CTDIF | 0B | Casing-tubing difference |
| Group 2 | | |
| CTD24 | 0C | Casing-tubing difference at turn-on-24 hr. avg. |
| CTD7D | 0D | Casing-tubing difference at turn-on-7 day avg. |
| CTD24T | 0E | Casing-tubing difference 24 hr. trend |
| CTD7DT | 0F | Casing-tubing difference 7 day trend |
| C24H | 10 | Casing 24 hr.avg.-tops of curves |
| C7DH | 11 | Casing 7day avg.-top of curve |
| C24HT | 12 | Casing 24 hr. tops trend |
| C7DHT | 13 | Casing 7 day tops trend |
| TLDIF | 14 | Tubing-line difference |
| TBR24 | 15 | Time between runs-24 hr.avg. |
| TBR24T | 16 | Time beteen runs-24 hr.trend |
| TBR7D | 17 | Time between runs-7 day avg. |
| TBR7DT | 18 | Time between runs-7 day trend |
| Group 3 | | |
| EXT1CNT | 19 | External 1 input counter |
| EXT2CNT | 1A | External 2 input counter |
| EXT3CNT | 1B | External 3 input counter |
| EXT4CNT | 1C | External 4 input counter |
| EXT5CNT | 1D | External 5 input counter |
| EXT6CNT | 1E | External 6 input counter |
| EXT7CNT | 1F | External 7 input counter |
| EXT8CNT | 20 | External 8 input counter |
| Group 4 | | |
| SPARE35 | 21 | Spare location |
| SPARE36 | 22 | Spare location |
| CSGB | 23 | Casing pressure at turn-off of V2 |
| TONCTR | 24 | Length of time to turn-off of V2 |
| LOADMN | 25 | Load menu-variable subset |
| SPAN | 26 | Span factor of transducer |
| EXTERNA | 27 | Status of external contacts |
| AVGTM | 28 | Time of day to average log reading |
| Group 5 | | |
| TON24S | 29 | Total on time last 24 hrs-S valve |
| TON7DS | 2A | Total on time in last 7 days-S valve |
| TOFF2S | 2B | Total off time in last 24 hrs-S valve |
| TOFF7S | 2C | Total off time in last 7 days-S valve |
| TOTP2 | 2D | Total plunger runs in last 24 hrs |
| TOTP7 | 2E | Total plunger runs in last 7 days |
| TOTBAT | 2F | Total battery time since power down |
| Group 6 | | |
| SONT | 30 | On time for cycle-S valve |
| SOFFT | 31 | Off time for cycles-S valve |
| DEL1 | 32 | Delay 1 value-time |
| DEL2 | 33 | Delay 2 value-time |
| DEL3 | 34 | Delay 3 value-time |
| DEL4 | 35 | Delay 4 value-time |
| TONT | 36 | Total on time-T valve |
| TOFFT | 37 | Total of time-T valve |
| VONT | 38 | On time for cycles-V valve |
| VOFFT | 39 | Off time for cycles-V valve |
| Group 7 | | |
| CSGHI | 3A | Casing high set point |
| CSGLO | 3B | Casing low set point |
| TBGHI | 3C | Tubing high set point |
| TBGLO | 3D | Tubing low set point |
| LINEHI | 3E | Line pressure high set point |
| LINELO | 3F | Line pressure low set point |
| FLOWMAX | 40 | Flow rate maximum set point |
| FLOWMIN | 41 | Flow rate minimum set point |
| CTDIF1 | 42 | Casing-tubing difference high set point |
| CTDIF2 | 43 | Casing-tubing difference low set point |
| TLDIF1 | 44 | Tubing-line difference high set point |

TABLE 1-continued

| Variable | Variable No. | Description |
|---|---|---|
| TLDIF2 | 45 | Tubing-line difference low set point |
| Group 8 | | |
| COUNT1 | 46 | Set point for event counter |
| COUNT2 | 47 | Set point for event counter |
| COUNT3 | 48 | Set point for event counter |
| COUNT4 | 49 | Set point for event counter |
| COUNT5 | 4A | Set point for event counter |
| COUNT6 | 4B | Set point for event counter |
| COUNT7 | 4C | Set point for event counter |
| COUNT8 | 4D | Set point for event counter |
| Group 9 | | |
| STATV1 | 4E | Status-valve 1 |
| STATV2 | 4F | Status-valve 2 |
| STATV3 | 50 | Status-valve 3 |
| STATC1 | 51 | Status-contacts 1 |
| STATC2 | 52 | Status-contacts 2 |
| TOFCTR | 53 | Total off counter |
| CLEAR | 54 | Clear a set of totals by number |
| MAXTRS | 55 | Maximum scanned transducers |
| Group 10 | | |
| CSGN | 56 | Casing null factor |
| CSGS | 57 | Casing scaling factor |
| TBGN | 58 | Tubing null factor |
| TBGS | 59 | Tubing scaling factor |
| LINEN | 5A | Line null factor |
| LINES | 5B | Line scaling factor |
| FLOWN | 5C | Flow null factor |
| FLOWS | 5D | Flow scaling factor |
| TK1N | 5E | Tank 1 null factor |
| TK1S | 5F | Tank 1 scaling factor |
| TK2N | 60 | Tank 2 null factor |
| TK2S | 61 | Tank 2 scalling factor |
| TK3N | 62 | Tank 3 null factor |
| TK3S | 63 | Tank 3 scalling factor |
| TK4N | 64 | Tank 4 null factor |
| TK4S | 65 | Tank 4 scaling factor |
| Group 11 | | |
| SYNCH | 66 | Production authorization window |
| Group 12 | | |
| DIF1 | 67 | Difference required before log |
| LLCSG | 68 | Last log casing pressure |
| DIF2 | 69 | Difference required before log |
| LLTBG | 6A | Last log tubing pressure |
| DIF3 | 6B | Difference required before log |
| LLLINE | 6C | Last log line pressure |
| DIF4 | 6D | Difference required before log |
| LLFLOW | 6E | Last log flow |
| DIF5 | 6F | Difference required before log |
| LLTNK1 | 70 | Last log tank 1 |
| DIF6 | 71 | Difference required before log |
| LLTNK2 | 72 | Last log tank 2 |
| DIF7 | 73 | Difference required before log |
| LLTNK3 | 74 | Last log tank 3 |
| DIF8 | 75 | Difference required before log |
| LLTNK4 | 76 | Last log tank 4 |
| Group 13 | | |
| ACT1 | 77 | Activity flag-general purpose |
| ACT2 | 78 | Activity flag-general purpose |
| ACT3 | 79 | Activity flag-general purpose |
| ACT4 | 7A | Activity flag-general purpose |
| SPARE15 | 7B | Spare location |
| SPARE16 | 7C | Spare location |
| SPARE17 | 7D | Spare location |
| SPARE18 | 7E | Spare location |
| Group 14 | | |
| TON24T | 7F | Total on time-24 hrs-T valve |
| TON7DT | 80 | Total on time-7 days-T valve |
| TOFF24T | 81 | Total off time-24 hrs-T valve |
| TOFF7DT | 82 | Total off time-7 days-T valve |
| READLOG | 83 | Local datalog readout |
| SEEK | 84 | Flag to cause V1 to seek a value |
| Group 15 | | |
| FS1 | 85 | Full scale factor for transducer 1 |
| FS2 | 86 | Full scale factor for transducer 2 |
| FS3 | 87 | Full scale factor for transducer 3 |
| FS4 | 88 | Full scale factor for transducer 4 |
| FS5 | 89 | Full scale factor for transducer 5 |

TABLE 1-continued

| Variable | Variable No. | Description |
|---|---|---|
| FS6 | 8A | Full scale factor for transducer 6 |
| FS7 | 8B | Full scale factor for transducer 7 |
| FS8 | 8C | Full scale factor for transducer 8 |
| Group 16 | | |
| CTR1 | 8D | Down counters for events |
| CTR2 | 8E | Down counters for events |
| CTR3 | 8F | Donw counters for events |
| CTR4 | 90 | Down counters for events |
| CTR5 | 91 | Down counters for events |
| CTR6 | 92 | Down counters for events |
| CTR7 | 93 | Down counters for events |
| CTR8 | 94 | Down counters for events |
| Group 17 | | |
| TONTS | 95 | Current 24 hr on time-S valve |
| TOFFTS | 96 | Current 24 hr off time-S valve |
| TONTT | 97 | Current 24 hr on time-T valve |
| TOFFTT | 98 | Current 24 hr off time valve |
| Group 18 | | |
| TIMER5 | 99 | Timer-datalog entry control |
| TIMER6 | 9A | Timer-datalog entry control |
| TIMER7 | 9B | Timer-datalog entry control |
| TIMER8 | 9C | Timer-datalog entry contro |
| TIMER9 | 9D | Timer for cycles-down each minute |
| TIMER10 | 9E | Timer for cycles-down each minute |
| TIMER11 | 9F | Timer for cycles-down each minute |
| TIMERI2 | A0 | Timer for cycles-down each minute |
| VlPOS | A1 | Valve 1 position current |
| Group 19 | | |
| SPARE24 | A2 | Spare locations hex numbers A2- B5 |
| Group 20 | | |
| SN | B6 | Controller serial number |
| GP1 | B7 | Group serial number 1 |
| GP2 | B8 | Group serial number 2 |
| GP3 | B9 | Group serial number 3 |
| SENDHLP | BA | Alarm message |
| SENDLOG | BB | Send log command |
| SENDIND | BC | Send all variables |
| Group 21 | | |
| AUTO | BD | 0 = datalog only,1 = control + log |
| LOADPRO | BE | Load program |
| ERROR | BF | Error indication |
| VNMAXM | C0 | Coputern number for editing |
| DLOG | Cl | Causes a variable to be logged |
| C | C2 | Communicating indicator |
| SPARE30 | C3 | Spare location |
| SPARE31 | C4 | Spare location |
| LTDIF | C5 | Line-tubing difference |
| Group 22 | | |
| SETPNT | C6 | Seeks set point for variable valve |
| SF1 | C7 | Seeks first factor |
| SF2 | C8 | Seeks second factor if needed |
| Group 23 | | |
| ZERO | C9 | Zeros designated transducer |
| V2POS | CA | Valve 2 current position |
| V3POS | CB | Valve 3 current position |
| C1POS | CC | Contact 1 current position |
| C2POS | CD | Contact 2 current position |
| Group 24 | | |
| TR0 | CE | Transducer 0 raw count diagnostics |
| TR1 | CF | Transducer 1 raw count diagnostics |
| TR2 | D0 | Transducer 2 raw count diagnostics |
| TR3 | D1 | Transducer 3 raw count diagnostics |
| TR4 | D2 | Transducer 4 raw count diagnostics |
| TR5 | D3 | Transducer 5 raw count diagnostics |
| TR6 | D4 | Transducer 6 raw count diagnostics |
| TR7 | D5 | Transducer 7 raw count diagnostics |
| Group 25 | | |
| POSI1 | D6 | Position 1 for stepping valve |
| POSI2 | D7 | Position 2 for stepping valve |
| POSI3 | D8 | Position 3 for stepping valve |
| POSI4 | D9 | Position 4 for stepping valve |
| POSI5 | DA | Position 5 for stepping valve |
| POSI6 | DB | Position 6 for stepping valve |
| POSI7 | DC | Position 7 for stepping valve |
| POSI8 | DD | Position 8 for stepping valve |
| Group 26 | | |

TABLE 1-continued

| Variable | Variable No. | Description |
|---|---|---|
| CONONE | DE | Constant one |
| CONZERO | DF | Constant zero |
| DLOG1 | E0 | Additional datalog insertion |
| DLOG2 | E1 | Additional datalog insertion |
| DLOG3 | E2 | Additional datalog insertion |
| DLOG4 | E3 | Additional datalog insertion |
| DLOG5 | E4 | Additional datalog insertion |
| DLOG6 | E5 | Additional datalog insertion |
| DLOG7 | E6 | Additional datalog insertion |
| DLOG8 | E7 | Additional datalog insertion |
| CONST2 | E8 | Predetermined constant |
| CONST3 | E9 | Predetermined constant |
| CONST4 | EA | Predetermined constant |
| CONST5 | EB | Predetermined constant |
| CONST6 | EC | Predetermined constant |
| CONST7 | ED | Predetermined constant |
| CONST8 | EE | Predetermined constant |
| CONST9 | EF | Predetermined constant |
| CONSTA | F0 | Predetermined constant |
| CONSTB | F1 | Predetermined constant |
| CONSTC | F2 | Predetermined constant |
| CONSTD | F3 | Predetermined constant |
| CONSTE | F4 | Predetermined constant |
| CONSTF | F5 | Predetermined constant |
| Group 27 | | |
| CSGA | F8 | Casing pressure prior to turning on V2 |
| CTDIFA | F7 | Casing-tubing difference prior to turn on of V2 |
| TBRCTR | F8 | Time between runs counter |
| TPLCTR | F9 | Time to plunger arrival counter |

The variables or parameters of the above tabulation form the somewhat extensive data compilation by which the controller 10 carries out essentially any desired control program for a given well installation and within a given well field. An efficient, rapid, pattern oriented expert data treatment system permits this logically powerful control over the well installation and, additionally, permits the system to give the well operator either at the site of the well or at a conventient location, the type of data or information heretofore provided, for example, by 7-day, two-pen charts and, additionally, helpful information now available from the computational facility of the microprocessor of the controller. Control may be effected not only by response to time-outs and switch closures but also to the information received from transducers actually measuring instantaneous pressure at various locations about the oil field. Of the above listing of variables, some will be seen to have direct application to well control, while others function in an archival sense to trace the history of the well to give the operator an indication of how the well should be controlled in the future. Access to the variables is by the noted hex number identification and, for purposes of convenience and conservation of available memory, the variables preferably are arranged in menus or subsets, principal ones or more of which may be employed for any given control program but all of which are accessible at the desire of the operator. Where a variable or parameter is intended to be changeable on the part of the operator, such as time or pressure set points or the like, then the display of the instant of the instant value of the variable will "wink" or oscillate on and off at display 42.

Considering the above groupings, TOD, Group 1 shows time of day and DAY, day of the year, are employed in generating the noted datalog as well as for comparison at the preset average time AVGTM, variable 28 at which various averages are taken. Group 1 also looks to the important variables as casing pressure, tubing pressure, line pressure, flow rates and tank levels as well as casing tubing differential, CTDIF, a value corresponding with the level of fluid in the tubing and which becomes quite important in developing precise control programs.

Group 2 of the parameters or variables looks more to the development of important historical data such that the operator can analyze a well on-site, through networking or through the telephone communication facilities which may be employed. For example, CTD24 provides the casing-tubing pressure differential at the turn-on of a well, i.e. beginning of a production cycle, as a 24 hour average. Correspondingly, the CTD7D variable gives a 7-day average for the above values. For production means or averages particularly involving plunger lift wells, the peaks of the curves are more important to the operator and, thus, the instant variables are recorded. Trending of the casing-tubing pressure differences both for 24 hours and 7 days are provided, respectively, by the CTD24T and CTD7DT variables, again quite imporant for on-site analysis. The variable C24H, C7DH, C24HT and C7DHT provide extensive information as to casing pressure activity looking to 24 hour averages 7 day averages and the trends for those averages. For general information, TLDIF, tubing line differential, is recorded. However, this particular variable will not have the importance and immediate control evaluation as the above. The variables TDR24, TDR24T, TDR70 and TDR7DT analyze the time between runs of the plunger, i.e. the average of the times it took for the plunger to surface. Thus, the operator may look to averages and trends to observe whether this time interval is increasing or decreasing and thus determine whether the well performance is degenerative or improving.

In addition to the eight analog or transducer readings made available to the controller 10, it also includes the capability for monitoring switch contacts, for example determining when a plunger surfaces. The variables of Group 3 keep track of such switch closure with the counters of this grouping and such data are employed by other variables later in the listing.

Further valuable information for a well operator is provided by the CSGB variable which logs the value of casing pressure just before the well is turned off such that this value will represent in most cases, a lowest pressure. The TONCTR variable provides the total on time for cycles, while the remaining variables of Group 4 look more to servicing in their nature. In this regard, LOADMN permits the operator to load any given subset or menu into RAM for accessing, SPAN provides for the calibration or span factor of a transducer. EXTERNA provides the current status of the external contacts, each bit of a given byte for this variable indicating whether an external switch is open or closed. External input counters may be incremented where appropriate based upon the current status represented by this variable. The variable, AVGTM, provides the averaging time for the operator. For example, it a well is generally visited by the operator at a given time of day, for example 8:30 A.M., the operator may arrange that the statistics are compiled just before that visitation time. Thus, all of the averaging which is carried out will be quite current as of the time well vistation is made. Further, the operator will always be aware of the time averages are made.

Group 5 of the variable listing provides further averaging for total on-off times in 24 hour and 7 day spans. Additionally, total plunger runs in the last 24 hours and the last 7 days will give the operator an indication as to how the well is performing upon any given visitation of upon accessing the well through networking or the like. The information as to battery time is helpful in determining when maintenance may be appropriate.

Group 6 of the variables looks to set points, for example, the on time for the sales valve on as well as the off time. Additionally, general purpose delay inputs are provided as well as time selections for the cycling of a valve into a tank. VONT and VOFFT variables provide time cycles for the variable opening valve aspect of the invention as discussed in conjunction with FIGS. 11 and 12.

Group 7 of the variables or parameters looks to the set point, for example, for casing, tubing, and line pressures. Additionally, flow rate maximum and minimum values are set as well as casing-tubing differences for both high and low set values. Further, tubing and line pressure difference high and low set points may be established with the variables.

Group 8 of the variable listing provides set points for counters such that control can be based upon the total number of events that occur. For example, the operator may determine to shut a well in following 1,000 cycles of production, thus to enforce plunger maintenance at certain points in time.

Group 9 of the variable or parameter listing provides for status information for the valves involved as well as two relay contacts which are operated with the controller. The latter devices may be employed for shutting motors down or turning on pumps and like, where a relay output is required rather than a pulsed output. The CLEAR variable functions to clear values for a number of variables such that upon manipulating this variable at the display of the controller, the operator will be allowed to input a sequence of numbers to clear out datalog information and the like. The MAXTRS variable simply accounts for the number of transducers which are operating with the controller. This minimizes requisite duty times for computational circuitry.

The variables or parameters for Group 10 function to service transducers and the like providing scaling and null factor data. Generally, scaling and nulling will involve numerator and denominator products and appropriate computation tracking null values and the like. Of importance, the procedure is digital as opposed to analog in nature and thus may be carried out with the computational capabilities of a microprocessor.

The SYNCH variable at Group 11 functions to provide a window of operational time allocated to a given well within a well field. For example, it may not be desirable that two wells commence production at the same instance or that all wells be in an off cycle at the same time.

Group 12 of the variables or parameters looks to accommodating for minor fluctuations in pressure in conjunction with using memory for the datalog function. For example, if the current reading differs from a last log reading by a greater amount than is set forth in the required difference established by the variable, then a sufficient change is present to warrant logging the data. On the other hand, if the operator wishes to watch pressure very carefully, a very low differential may be employed with the variables. While this form of variable may be used for control, in most instances it will be employed for logging purposes.

Group 13 of the variables or parameters provides for setting general activity flags, for example, indicating when a plunger is up even though a delay interval may be following such surfacing status.

Group 14 of the variables describe total on time and off time for the tank valve for 24 hour periods and 7 day periods. The READLOG variable is used to readout the datalog locally on the display of controller 10. For example, when variable number 83 is accessed, the display shows READLOG, the operator positions a 1 in the display, and actuates the GOTO key whereupon the datalog commences to be read out. The SEEK variable of this grouping pertains to the variable output valve described in conjunction with FIGS. 11 and 12. When this variable is employed, the variable output valve is forced to home in on a particular pressure reading by opening or closing, for example, to cause casing pressure to match a seek set point.

Group 15 of the variables provides scaling factors for the transducers, the factor involved being used in a denominator position.

Group 16 contains those variables used in down incrementing type counters which are of a general purpose in the control field.

Group 17 of the variables collects the total on times and off times for the sales valve and tank valve operations from the given instantaneous time back in time to the last averaging time, AVGTM variable 28. Thus, when the instantaneous time equals average time the values in this group are transferred to the appropriate 24 hour and 7 day accumulative variables.

The TIMER5 through TIMER8 variables of the Group 18 are employed as timers for datalog entry control, while TIMER9 through TIMER12 are employed for cycle timing, being incremented each minute. The latter timers will be seen to be employed in the control programs to a considerable extent. The V1POS variable provides the current status of valve 1 or the sales valve of the system. This current status will be seen to be employed in the controlling technique wherein a desired status of the valve is compared with this current status and where a difference is found then, a pulsing or the like is carried out to bring the valve into an appropriate orientation. The altered status then becomes the current status of the instant variable. Desired valve orientation and the current valve orientation generally are identical except during a processing of control variables to carry out a program maneuver.

Group 19 provides a compilation of secondary and primary variables to provide specific control flexibility that may be desired by a a particular operator.

Group 20 of the variables deals with communication. In this regard, for networking and general communication purposes, each controller 10 is given a serial number as retained at the variable SN. Also, groups of controllers may be given a serial number and, in this regard, three variables are assigned to that purpose, GT1, GT2, and GT3. Where groupings are provided, for example, commands can be asserted to each of the controllers within a group thereof. The SENDHLP variable provides for alarm type messages which will force the serial communications to be activated over the network. The SENDLOG variable provides for outputting the datalog, while the SENDIND variable provides for transmitting the entire listing of variables and their valuations as set forth in the above tabulation.

Variables within group 21 include an auto-manual variable, identified as number BD. This variable, when a zero, will cause the controller to only carry out datalogging. On the other hand, if a value of the variable is a 1, then the controller will carry out full operation. The LOADPRO variable provides for the loading of any of several control programs into RAM which may be retained with the device in ROM. Generally, to simplify earliest usage of the devices 10, several such programs will be provided to the user notwithstanding the broad range of available programs which can be developed quite easily for the device. The error variable provides an indication of the presence of any of a number of errors which may occur, for example, a transducer providing an improper frequency level or the like. DLOG is a variable which may be employed to insert a value in the datalog. For example, this variable may be accessed at the site by the operator by inserting the C1 variable number in decimal form. The message in display 40 will show "DATALOG" and an appropriate number value plus actuation of the GOTO key will cause the elected variable value to be placed in datalog. In effect, the variable functions as an electronic notebook. The "C" variable is employed to provide a message, for example, communicating of display 40 at such time as the unit is receiving or transmitting data from the communicating ports.

Grouping 22 provides three variables which are employed in conjunction with the seek function (variable 84) control. The SETPNT variable provides for seeking a particular set point while the seeking factors SF1 and SF2 are employed by a seek control program in the manner of a process control loop.

Group 23 of the variables includes a ZERO varaible which is employed for zeroing out the transducers in terms of their frequency valuations. The remaining variables of this grouping are concerned with the current positions of valves 2, 3 and contacts 1 and 2. They are used for comparison purpose in the control scheme.

Group 24 of the listing provides the "raw" count output for transducers 0 through 7 without correction with respect to engineering units. The variables are sued for diagnostic purposes.

Group 25 sets forth eight positions predefined for setting the position of stepper motor 476 in conjunction with the variable output valve described in conjunction with FIGS. 11 and 12.

Group 26 includes the CONONE and CONZERO variable which simply define the constant, one and the constant, zero for use by the control program. The DLOG1–DLOG8 variables provide for supplementary entries into the datalog. The CONST2–CONSTF variables provide for the definition of any various constants which may be desired in carrying out a given program. Finally, Group 27 provides a CSGA variable which is the casing pressure just prior to turning on the sales valve, thus representing another peak value that is placed in memory prior to turning the valve on. Similarly, the CTDIFA variable provides the casing-tubing pressure differences just prior to turning on the sales valve and the TPLCTR variable provides interval counting determining interval required for the plunger to surface.

Figure 21:
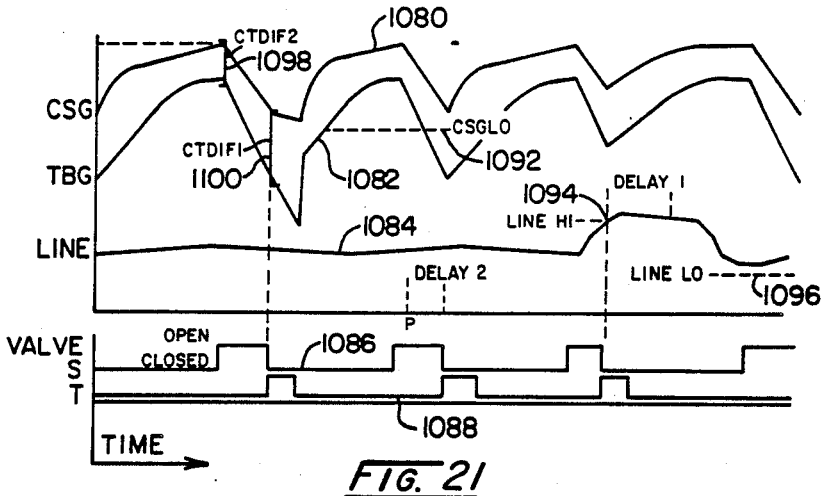
FIG. 21 is a non-scale graph showing operational parameters and illustrating control features of the controller of the invention.

Referring to FIG. 21, an example of how a well installation may be programmed employing the variables of the above tabulation is presented schematically. The program developed in connection with the figure would, for example, be used with an installation having the sales line valve 328 and tank line valve 342 of the facility shown in FIG. 8 in addition to a transducer monitored line pressure. Additionally, the surfacing of the plunger as at 324 by contact device 370 is employed. In the figure, the variations of casing pressure (CSG) are represented at curve 1080. Corresponding tubing pressures encountered during operation of the well are represented at curve 1082 and the line pressure is represented at curve 1084. Opening and closing of the sales valve 328 is represented at curve 1086 and the corresponding opening and closing of the tank valve 342 is represented at curve 1088. The abscissa of FIG. 21 is considered to be a time base as labelled and also shown in dotted line fashion is the casing high set point (CSGHI) at 1090 and the corresponding casing low set point (CSGLO) at 1092. Correspondingly, the line high set point (LINEHI) is represented at dashed line 1094 and the line low set point (LINELO) is represented at dashed line 1096. The casing-tubing difference low set point (CTDIF2) is represented at bracket 1098, while the corresponding casing-tubing difference high set point (CTDIF1) is represented at bracket 1100. Plunger arrival is shown in the time chart by the letter "P" and two delays are shown, one labelled "DELAY1" and the other "DELAY2".

The program represented by the figure functions to turn the sales valve, S, on when the casing pressure as at curve 1080 reaches the casing high set point 1090 and the casing-tubing difference in pressure is less than the low set point represented at bracket 1098. Sales valve S remains on until a straightforward time-out occurs or the plunger surfaces. Further, the S valve closes when the casing-tubing differences set point is exceeded. In the event the plunger does not arrive within the sales valve on time, then that valve will close and the tank valve, T, will open to divert well output to the tank as at 348 if FIG. 8. The tank valve, T, will remain open until the plunger arrives or until a delay following plunger arrival times out. In FIG. 21, such a delay is represented at "DELAY2". Additionally, the tank valve may remain open until the casing pressure as at curve 1080 reaches the casing low set point as at 1092. FIG. 21 further shows a control instituted in conjunction with the line pressure. Note that the line pressure as represented at curve 1084 is seen to exceed the line pressure high set point 1094. As a consequence, the sales valve, S, closes and the tank valve, T, opens. Further, a delay as shown as DELAY1 may be imposed before any activity interms of opening the sales valve S ensues. A highly efficient technique by which the above form of control is programmed is described later herein.

Figure 22:
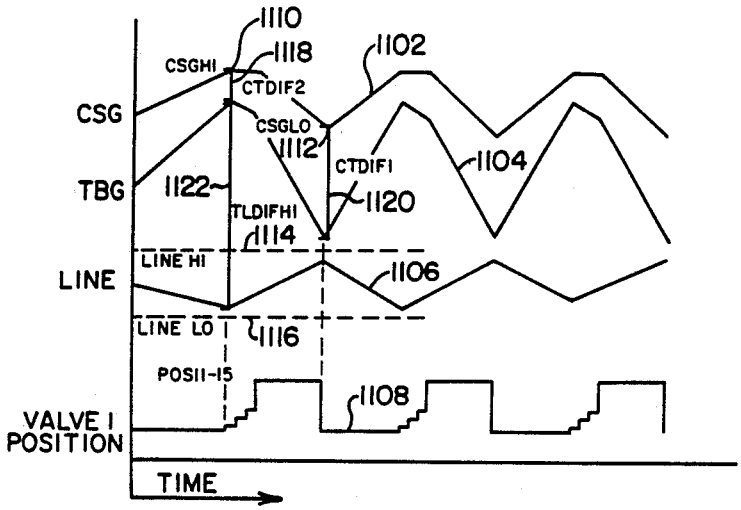
FIG. 22 is a non-scale graph showing operational parameters employed in controlling a gas well installation having a variable opening motor valve under the control of the controller of the instant invention.

Looking to FIG. 22, a similar program representation for the operation of a well installation is portrayed. However, for the arrangement of FIG. 22, it is assumed that the variably opening valve or functional variations thereof described in conjunction with FIGS. 11 and 12 is employed. In the figure, the casing pressure (CSG) profile is represented at curve 1102; the tubing pressure profile (TBG) at curve 1104; the line pressure profile at curve 1106; and the valve opening position (VALVE1 POS11–15) at curve 1108. The casing high (CSGHI) pressure level is represented at dotted line 1110 and the corresponding casing low pressure (CSGLO) is represented at dotted line 1112. Correspondingly, the line high set point is represented at dotted line 1114 and the line low (LINELO) at dashed line 1116. The low set point for casing-tubing difference (CTDIF2) is represented at bracket 1118 and the corresponding high set point for that variable (CTDIF1) is represented at 1120. The control program represented in FIG. 22 provides that, at the satisfaction of casing pressure at curve 1102 being equal to or greater than the casing high set point 1110 and the further condition that the casing-tubing difference is below the low set point represented at bracket 1118 and under the conditions that the tubing pressure-line pressure difference is greater than a given set point such that the tubing pressure is significantly above line pressure to deliver a slug of liquid, then the sales line valve commences to open. However, a sequence of counter delays ensures in which the VALVE1 position gradually opens from the variable positions POS11 to that at 15. This will permit the passage of gas to the line without surges or the like and in an efficient manner. As the VALVE1 reaches an open or substantially open position, then the standard cycle timing may be applied. However, the program permits override based on other transducer inputs. For example, the program may watch casing pressure as at curve 1102 such that it will avoid falling below the casing low set point 1112. Further, should the casing-tubing difference become greater than the high set point, an indication that excessive fluid is accumulating may be present and that condition may occur before the casing pressure falls below a set point. Thus, VALVE1 is shown closing as these conditions occur. As is apparent, wells may be efficiently controlled with the wide range of parameters and parameter controls available to the controller 10 of the instant invention.

Figure 23A:
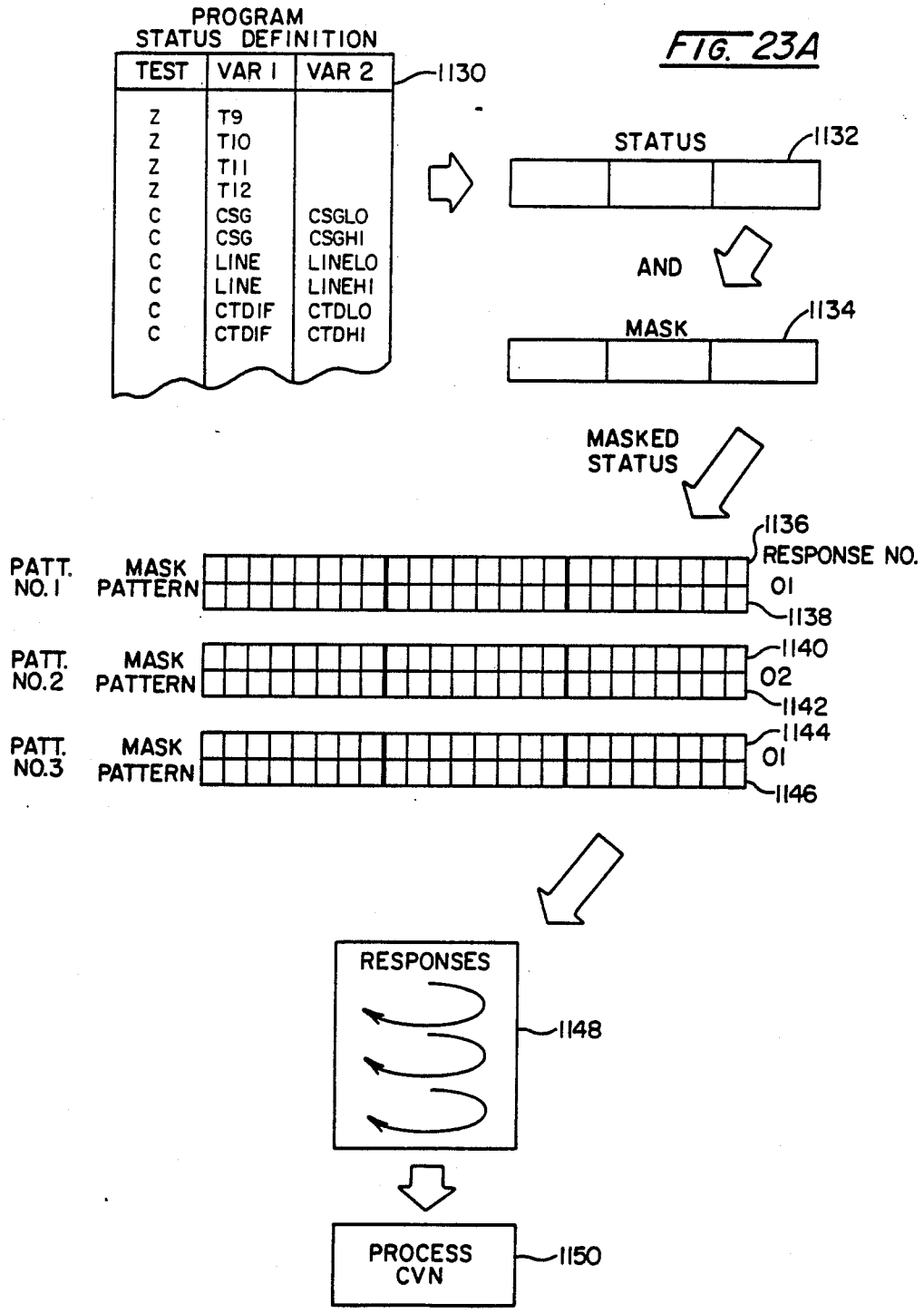
FIG. 23A is a schematic representation of program operation of the controller of the invention.

Looking to FIG. 23A, the overall program by which the above listing of varaibles or parameters are treated and manipulated to carry out efficient programming and control is illustrated in schematic fashion. In general, the variables, when updated, may be considered an instantaneous status of the well being controlled and that status is updated either by comparisons to determine, for example, whether set points have been reached, or further determinations are made as to whether the values are zero or above, showing the timing out of the timer or an open or closed situation with respect to valves or switches. Generally, updating of the variables occurs each minute of time with the exception that the variable valve of FIGS. 11 and 12, when in a seek mode, is continuously updated in closed loop control fashion. In designing any program, only those variables considered pertinent to a given program are evaluated from a program design standpoint and a variety of subsets or menus of the variables can be developed in the interest of program simplicity. FIG. 23A and the tabulations of FIG. 23B look to the development of an exemplary program in connection with the control discussed in connection with FIG. 21. Looking to the figure, program status definition is carried out as represented at block 1130 by evaluating certain variables with respect to zero, by carrying out comparisons, and by identifying presence or absence. Certian of these variables are shown in block 1130, the complete listing thereof along with variable hex number identification being set forth in FIG. 23B. Block 1130 shows that in building well status as a sequence of binary values, four timing functions abbreviated "T9" through "T12" are tested with respect to a determination as to whether they have reached a zero or time-out status. Thus, the test indicated in block 1130 is designated "Z". Additionally, to carry out the program of FIG. 21, casing pressure (CSG) is evaluated with respect to high and low points as shown at CSGLO and CSGHI. The test associated with this type of status development is one of comparison as represented by "C" in block 1130. Other variables employed with the program of FIG. 21 will include line pressure set points, casing-tubing difference set points, the status of the tank valve and sales valve as abbreviated "SV2" and "SV3," the use of activity variables ACT1–ACT3, and the sales valve (VALVE2) off times and on times as represented at SONT and SOFFT. As these variables are upgraded or the status of the well is developed with each minute of operation, a three byte status for the elected subset of variables is developed as represented at block 1132. The thus-current status then is evaluated by a three byte mask which functions to provide an election for steps in the program of those variables then deemed pertinent. This is carried out by a logical ANDing of the predetermined mask with status as represented by the ANDing of the three byte status represented at block 1132 with the three byte mask represented at block 1134. Thus, the mask will have carried out a classification of the variable data such that only that of interest for one phase of control is made available. The ANDing procedure is quite simple and rapid and, thus, a significant amount of data as presented by the listing of variables is evaluated very efficiently. The binary sequence masked status represented by the logical ANDing then is compared with a predetermined pattern representing a control condition. For example, in FIG. 23A, a pattern No. 1 shows a mask represented by the three byte sequence of blocks 1136 compared with a pattern of three bytes represented at blocks 1138. Where the mask status 1136 is identical to the pattern 1138, then a control acitivity is called for which is defined as a response number 01 for the example at hand. Similarly, as represented at three byte sequence of blocks 1140, a mask status of three bytes is compared with a second pattern represented by the three byte sequence of blocks (bits) 1142. Where equivalence between the two three byte bit strings is obtained, then a response number 02 will be carried out representing a control activity. In similar fashion, a three byte mask status is represented at sequence of block 1144 which is shown being compared with a thrid pattern represented by three byte blocks, i.e. bit string 1146. Where a response is called for in conjunction with the comparison of a given mask status and pattern, then as represented at block 1148 a simple shifting or "shuffling" of variables takes place as defined by the response number. For example, a 0 or 1 may be moved into the valuation of a given variable. Thus, the valuation for any of the variables may change due to this response and the variables then are processed as represented at block 1150 to effect the carrying out of a control procedure, for example, closing a valve or the like.

Looking to FIG. 23B, a listing of variables along with the hex identification of them is provided along with a sequence of three byte masks and patterns carrying out a control. For example, the mask for the first control level is identified by the three byte hex number "80 02 A0." The corresponding pattern is positioned adjacent thereto which, for the instant illustration, is identical. The fourth hex identification in the pattern represents the response which is to be carried out which is a shifting of the value of one variable into the position of another.

Looking to Table 2, the responses corresponding with the pattern matching represented at FIG. 23B are set forth at hex 1 through 0D. Each of the responses is maintained in memory and separated by 00 as indicated. Two responses not shown in FIG. 23B are at 0A and 0B, respectively, representing an actuation of on key 52 and off key 53 (FIG. 3). It may be observed in FIG. 23B that certain responses, for example, 01, 02, 06, 07, 08 and 09 are repeated, thus indicating the desirability of providing a response number and a table look-up approach to carrying them out.

TABLE 2

| Response | PATTERNS AND MASKS | | | |
|---|---|---|---|---|
| | | | 00 | |
| 1 | 1 | S V2 | DE | 4F |
| | SONT | T9 | 30 | 9D |
| | ϕ | ACT2 | DF | 78 |
| | ϕ | ACT3 | DF | 79 |
| | | | 00 | |
| 2 | ϕ | STV2 | DF | 4F |
| | SOFRT | T9 | 31 | D9 |
| | ϕ | ACT2 | DF | 78 |
| | ϕ | ACT3 | DF | 79 |
| | | | 00 | |
| 3 | ϕ | S V2 | DF | 4F |
| | DEC3 | T12 | 34 | Aϕ |
| | 1 | ACT3 | DE | 79 |
| | | | 00 | |
| 4 | 1 | T VLV | DE | 50 |
| | TONT | T9 | 36 | 9D |
| | ϕ | ATC3 | DF | 79 |
| 5 | DEL2 | T11 | 33 | 9F |
| | 2 | ACT2 | DE | 78 |
| | | | 00 | |
| 6 | ϕ | T VLV | DF | 5ϕ |
| | SOFFT | T9 | 31 | 9D |
| | ϕ | ACT2 | DF | 78 |
| | | | 00 | |
| 7 | 1 | ACTl | DE | 77 |
| | DEL1 | T1ϕ | 32 | 9E |
| | | | 00 | |
| 8 | ϕ | S VLV | DF | 4F |
| | 1 | ACT1 | DE | 77 |
| | SOFFT | T9 | 31 | 9D |
| | | | 00 | |
| 9 | ϕ | ACTl | DF | 77 |
| | | | 00 | |
| OA | 1 | SV | DE | 4F |
| | SONT | T9 | 30 | 9D |
| | ϕ | ACT2 | DF | 78 |
| | ϕ | ACT3 | DF | 79 |
| | | | 00 | |
| OB | 0 | SV | DF | 4F |
| | 0 | TV | DF | 50 |
| | SOFFT | T9 | 31 | 9D |
| | ϕ | ACT2 | DF | 78 |
| | ϕ | ACT3 | DF | 79 |
| | | | 00 | |
| OC | 2 | SONT | E8 | 30 |
| | | | 00 | |
| OD | 2 | SOFFT | E8 | 31 |

Figure 24A:
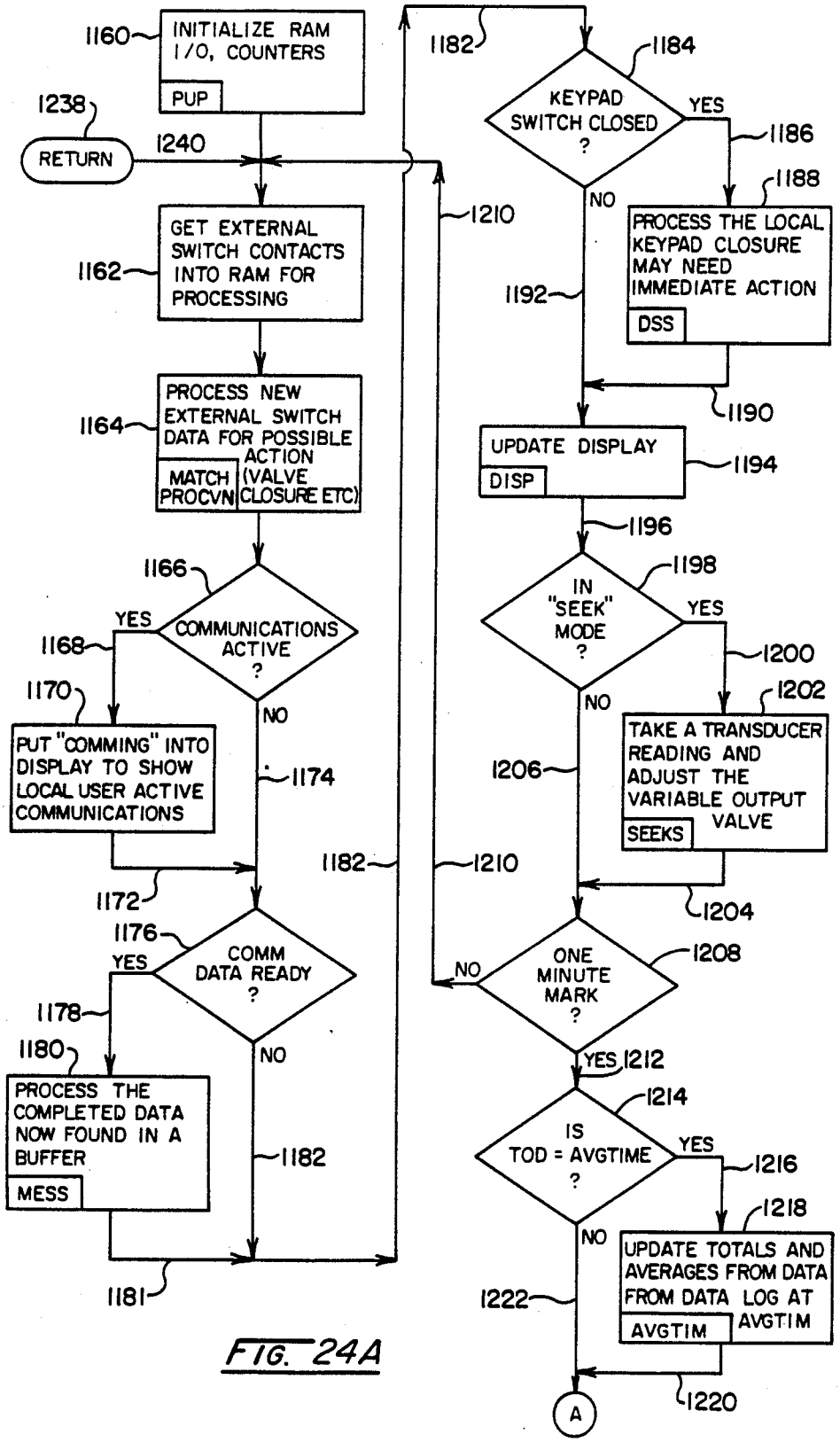
FIGS. 24A and 24B comprise a flow diagram of general program control provided by the controller of the invention.
Figure 24B:
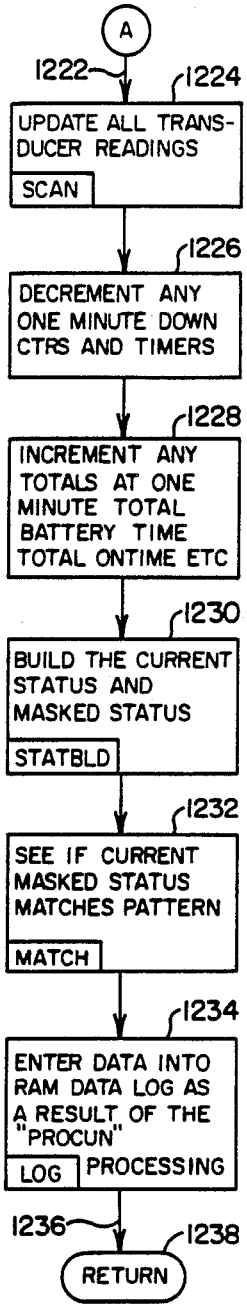

Referring to FIGS. 24A and 24B, a general control flow chart is revealed showing the control program to commence at block 1160 with an initialization of random access memory, input/output ports, counters and the like wherein all control variables are set to their initial values. This initialization, also involves power up processing (PUP). THE controller also may respond at this time to keypad input from the operator providing such data as time of day, year and set points. Following this initialization, as represented at block 1162, the switch contacts are read and the data as to their status are placed in RAM for later control action. Then as represented at block 1164, any required control action will be undertaken as discussed above in conjunction with FIG. 23. As discussed in connection therewith, the final control activity is identified by the block "PROCESS CVN." hereafter identified as "PROCVN."

With the conclusion of any required control, as represented at block 1166, a determination is made as to whether the communication components of the controller are active. In this regard, the communication with UART 636 (FIG. 13C) may be telephonic through a modem or generated by controller to controller networking in a given field installation. In the event a determination is made that communications are under way, then as represented by line 1168 and block 1170, a message to that effect is placed into the display 40, for example "coming" and the program continues as represented by line 1172. For the instant device, the communications will be received as a formatted stream of ASCII characters commencing with the ASCII symbol for "N" and ending with a signal corresponding with the letter "L." This arrangement is made such that the controller 10 is not responding to individual characters but only responds after termination of receipt of the character string. Thus, at the end of a communications active character string or where no communications have been observed to be active, as represented at line 1174, the program then proceeds to the inquiry at block 1176 determining whether the communication data are ready. In the event of an affirmative determination, an "L" being received, then as represented at line 1178 and block 1180, a message routine is called (MESS) which operates upon the received message. The program then continues as represented at line 1181 or, in the event the data are not ready, then as represented at line 1182.

Line 1182 is seen leading to the inquiry at block 1184 serving to determine whether or not a keypad switch is closed representing an intervention on the part of the operator. In the event of an affirmative determination, as represented at line 1186 and block 1188, the keypad activation is processed with a routine identified as "DSS." The program then continues as represented at 1190 or int he event no key switches have been closed as represented at line 1192. Next in the program, the display is updated as represented at block 1194, a routine identified as "DISP" being called. The latter routine functions to place a message in the eight character display 40 and depending upon the type of data to be displayed, i.e. hours, minutes, type of variable or variable value, a fourth character output is provided at display 42(FIG. 1).

The program then continues as represented at line 1196 to the inquiry at block 1198 in determining whether or not the program is in a "SEEK" mode concerned with one aspect of the variable value operation described in conjunction with FIGS. 11 and 12. If the SEEK mode is at hand, then as represented at line 1200 and block 1202, an appropriate transducer reading is taken and the variable output value is adjusted accordingly. The program then continues as represented at line 1204. In the event that the seek mode is not at hand, then the program continues as represented at line 1206 and a determination is made as represented at block 1208 as to whether one minute in time-out has occurred. For the instant controller 10, a one minute cycling time has been found to be appropriate. Where that one minute period has not occurred, then as represented at line 1210, the program returns in loop fashion to commence again at block 1162. Where the one minute mark has been identified, then as represented at line 1212 and block 1214, a determination is made to whether the then current time of day is equal to the value of the average time variable (variable number 28). In the event that the values are equivalent, then as represented by line 1216 and block 1218, all those variables which are updated and averaged as of the elected average time are treated in updating fashion. A subroutine for this operation is seen lablled "AVGTIME." The program then continues as represented at line 1220. In the event that average time is not at hand, then the program continues as represented at line 1222 and looks to the instructions at block 1224 (FIG. 24B) wherein an updating of all transducer readings is carried out employing the subroutine entitled "SCAN." To save power, power-up to the transducers only occurs during the updating on one minute intervals unless the "SEEK" program is invoked which may cause an early reading of the transducer. The program then continues as represented at block 1226 wherein instructions to decrement any one minute down counters and timers are provided. Following such timer adjustment, as represented at block 1228, the program then increments any totals with respect to the elapsed one minute. Inasmuch as the variables employed are two bytes in extent, a theoretical capacity for 3,200 minutes exist with the system. The program then continues to block 1230 wherein the status of the variables is developed as described in conjunction with blocks 1130 and 1132 in FIG. 23A. The updated status then is logically ANDed with a predetermined mask as represented at block 1132 of the latter figure and the instructions of block 1230 are seen to be implemented by a routine identified as "STATBLD." The program then continues as represented at block 1232 wherein a determination is made as to whether the current mask status is matched by an associated control pattern. A routine for carrying this out is identified as "MATCH." This routine also will be seen to include the shuffling or moving of data from one position in RAM to the other in order to develop a revised status whereupon a processing step takes place. Finally, as represented at block 1234, data are entered into the RAM datalog as a result of processing, updating occurring at the end of each minute or at other times that are called for the program. A routine identified as "LOG" carries out this activity and a variation thereof, DLOG, may be called upon by the operator in the course of key actuation with appropriate variables. It may be recalled that an appropriate difference value is required from one reading to the next to provide LOG type entries in datalog for several variables. The program then continues as represented at line 1236 and node 1238 to return to the input leading to block 1162 (FIG. 24A) as represented at line 1240.

Figure 25:
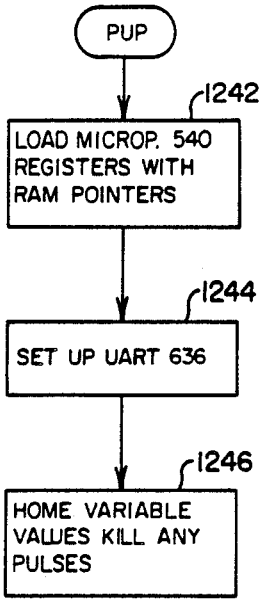
FIG. 25 is a flow diagram of a power-up subroutine employed by the controller of the invention.

Looking to FIG. 25, the power up processing (PUP) routine involving the initialization procedures as described in conjunction with block 1160 in FIG. 24 is revealed. The program commences with block 1242 providing for the loading of microprocessor 540 registers with RAM pointers as appropriate. The process of power up procedures then include the setting of UART 636 as set forth at block 1244 and the homing of any variable values as well as negating any spurious pulse inputs at this position in the commencement of the control procedure.

Now considering the processing procedures described in conjunction with block 1164 in FIG. 24A, a control function is carried out which generally includes calls to routines which update the current transducer readings, increment or decrement any timing functions or counters as may be required, generate the current status of the controller, and carry out the earlier-described ASCII and pattern matching following which, if determined appropriate, responses are per-formed wherein data are manipulated in accordance with a predefined instruction. Where such responses are carried out, then a processing of the revised status of the variable with respect to valve changes or the like may be carried out. Looking to FIG. 26, the routine earlier identified as "MATCH" which, in effect, is a process control procedure, is illustrated in flow diagrammatic form. This routine is shown entered at line 1250 whereupon as represented at block 1252, a routine referred to as "SCAN" is called such that all transducers are read to update their current output value. The program then proceeds as represented at block 1254 to call the routine for updating the status of all variables of the system. This routine is referred to as "STATBLD." With all data then current, as represented at block 1256, the register is set to the bottom of the program at hand inasmuch as the program is a stepwise procedure. A masked status then is derived from the variables as represented at block 1258, as described earlier in conjunction with FIG. 23A then is developed as a logical AND-ing of a mask and variables. The result is referred to as "MSTATUS". This latter three byte masked status bit assemblage or sequence then is compared with an associated pattern as represented at block 1260. Where a correspondance or a "match" is found, as represented at block 1262 and line 1264, a response designated for the pattern at hand then causes the movement of the value of one variable to another as represented at block 1266. The latter operation is given the program term "SHUFL." Inasmuch as a change in variable values may have occurred, the program then proceeds to update the status of the variables at hand by calling the earlier-noted STATBLD program as represented at block 1268. Following such variable status updating, as represented at line 1270 and block 1272 a determination is made as to whether all patterns in the program have been checked. This same determination is made if a match is not found as called for at block 1262 and the program directly looks to the querry at block 1272 as represented at line 1274. Where all patterns have not been checked, then as represented at line 1276 adn block 1278, the program increments to the next pattern/mask combination and, as represented at line 1280 a next comparison of mask status and pattern is carried out as represented at block 1260 and the program continues. Where all patterns haveen checked, then as represented at line 1282 and block 1283 the processing routine, "PROCVN" is called to process the control variables if any have changed after the alteration carried out as referred to as "SHUFL." This processing will alter the status of valves and the like as called for. The routine then returns as represented at node 1284.

Figure 26:
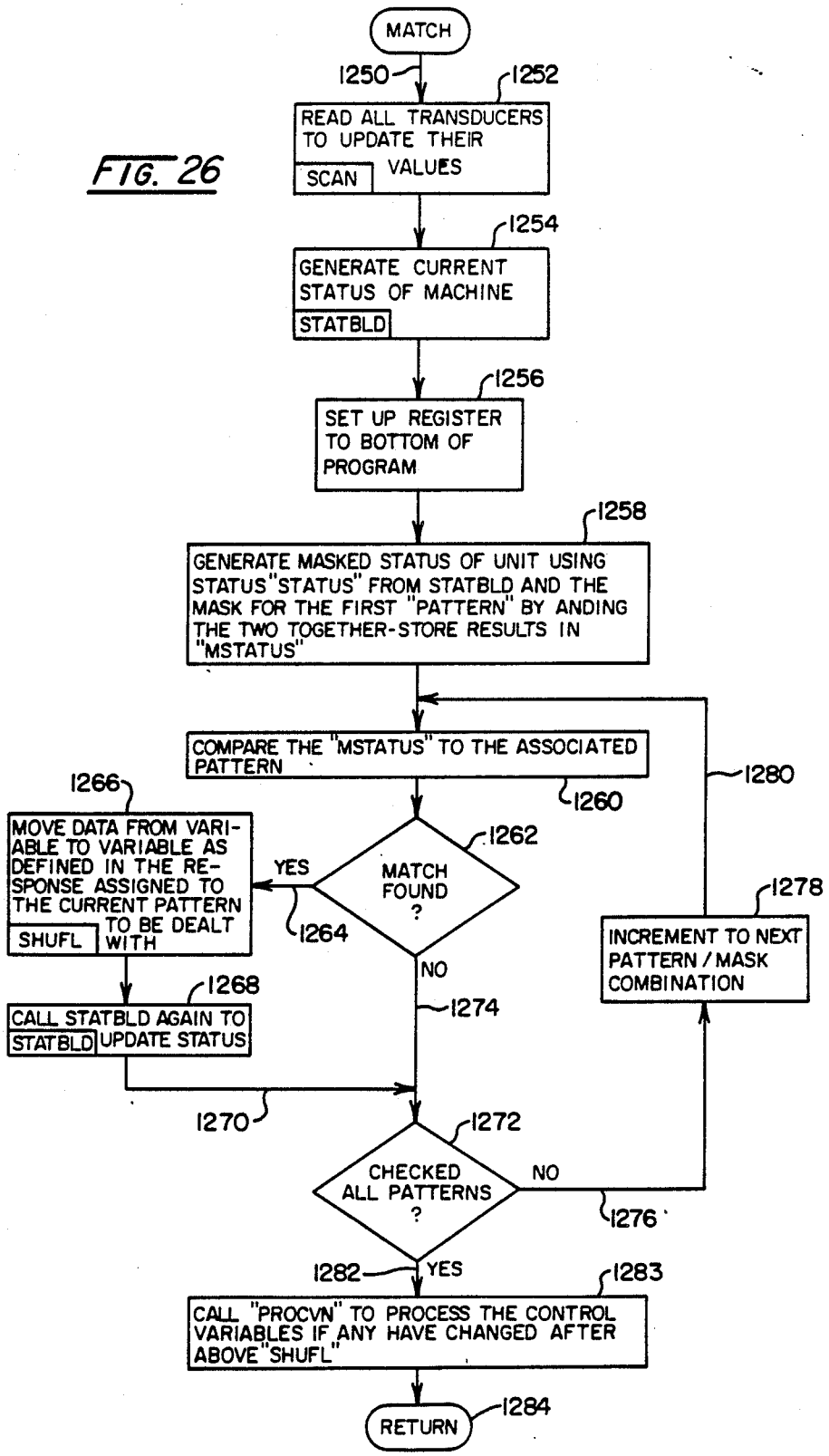
FIG. 26 is a flow diagram of a MATCH subroutine employed by the controller of the invention.

Looking to FIG. 27, the SCAN program discussed in connection with block 1252 in FIG. 26 is illustrated. This routine is entered as represented at node 1286 and line 1288 leading to a first instruction at block 1290 providing for the enabling of a next transducer positioned within the pertinent oil well installation. This enablement has been described in conjunction with FIG. 14A and signals ENO-EN7. Following the enablement of an elected transducer, as represented at line 1292 and block 1294, a determination is made as to whether gate 840 as described in conjunction with FIG. 15 is at a high or forward conducting condition as determined by the value of flag EF2 at line 546. In the event that the gate is not enabled, then as represented by loop line 1296, the routine dwells. Where the noted gate is accepting input frequency signals, then as represented by line 1298 and block 1300, the counter represented in FIG. 15 as counters 844–847 counts pulses asserted thereto and, as represented by line 1392 and block 1304, a determination is made as to whether the counting interval is up, as represented by the noted flag condition. In the event that the counting interval is not up, as represented by loop line 1306, the program again dwells, Where an affirmative determination is made at block 1304, then as represented at line 1307 and block 1308, the reading developed at demultiplexing devices 860 and 868 is inputted to RAM. The program then continues as represented at block 1310 wherein a determination as to whether the frequency so collected is within a range considered valid. In the event that it is not, then as represented at line 1312 and block 1314, an error flag is set and the program continues as represented at line 1316. In the event the range is okay as determined from block 1310, then the program continues as represented at line 1318 to the inquiry at block 1320 determing whether all transducers as have been employed with the oil well installation have been read. Variable number 55, MAXTRS is employed in the latter regard. In the event they have not, then as represented by loop line 1322, the program continues to enable the next transducer. In the event all transducers are read, the routine returns as represented by node 1324.

Referring to FIG. 28A, the status build (STATBLD) routine as discussed in conjunction with blocks 1254 and 1266 of FIG. 26 is illustrated as commencing with node 1326 and line 1328 leading to block 1330. The instructions in block 1330 provide for setting up a bit counter and initialization of the status following these initialization procedures. As represented at line 1332 and block 1334, either the first or next byte from the program memory is accessed. Generally, this byte will represent a test to be carried out with subsequent bytes. Looking additionally to FIG. 28B, a memory map illustration of the sequence of events evolved is shown, the memory positions being represented as extending from a program top (TOPPROG) to a program ending (BOTPROG) corresponding with the subset of variables assigned for a given control program. Following the access of this initial byte, as represented by line 1336 and block 1338 a determination is made as to whether the test definition is 01. In the event that it is, then as represented by line 1340 and block 1342, the next byte accessed in memory, for examplle 9D, will have a value which is tested for zero. Where that is the case, then a logic high bit will be positioned in memory to represent the status for that variable. If the value of the variable is not a zero, then the status for the variable is established as a logic zero. Thus, for example, in the initial test at the commencement of the program mapped in FIG. 28B, TIMER9 or hex 9D is tested for having been decremented to zero. The next sequence in memory shows that TIMER 10 is similarly evaluated. Following the updating of status, as represented at line 1344, node A which is seen to reappear at line 1346 leading to block 1348 the routine increments to a next evaluation.

Where the inquiry at block 1338 as to the test definition results in a determination that a 01 test is not at hand, then as represented at line 1350 and block 1352 a determination is made as to whether the test is identified by a 02 designation. In the event that it is, then as represented by line 1354 and block 1356 the subsequent next two bytes in memory are accessed for a comparison in conjunction with a greater than or equal to evaluation.

For example, in FIG. 28B, a 02 test definition provides for the comparison of variable hex 03 (CSG) with the value of variable hex 3B (CSGLO). A current bit status of "1"is set if the first variable is greater than or equal to the second accessed variable. Otherwise, a logic zero is provided, i.e. the flag is cleared. Following such test, as represented by line 1358 and node A, the routine continues as represented by line 1346 and block 1348 to increment to a next test.

Where the inquiry at block 1352 determines that a 02 test definition is not present, then as represented at line 1360 and block 1362, a determination is made as to whether the test definition byte is 03. In the event that it is, then as represented at line 1364 and block 1366, the next byte is accessed which will represent an external switch port of the controller. Where such switch is closed, the current bit in the status is set, otherwise it is cleared. The program then continues as represented by lines 1368 and 1346 to increment to a next test as represented at block 1348. Where the incrementation reaches the bottom of the program, then as represented by line 1370 and block 1372 a determination to that effect is made and in the event of a negative such determination, then as represented by line 1374 and node B the program loops as set forth in line 1376 to obtain the next byte from the program memory as represented at block 1334. On the other hand, where the bottom of the program is reached, then as represented by line 1378 and node 1380 the STATBLD routine returns.

Figure 29A:
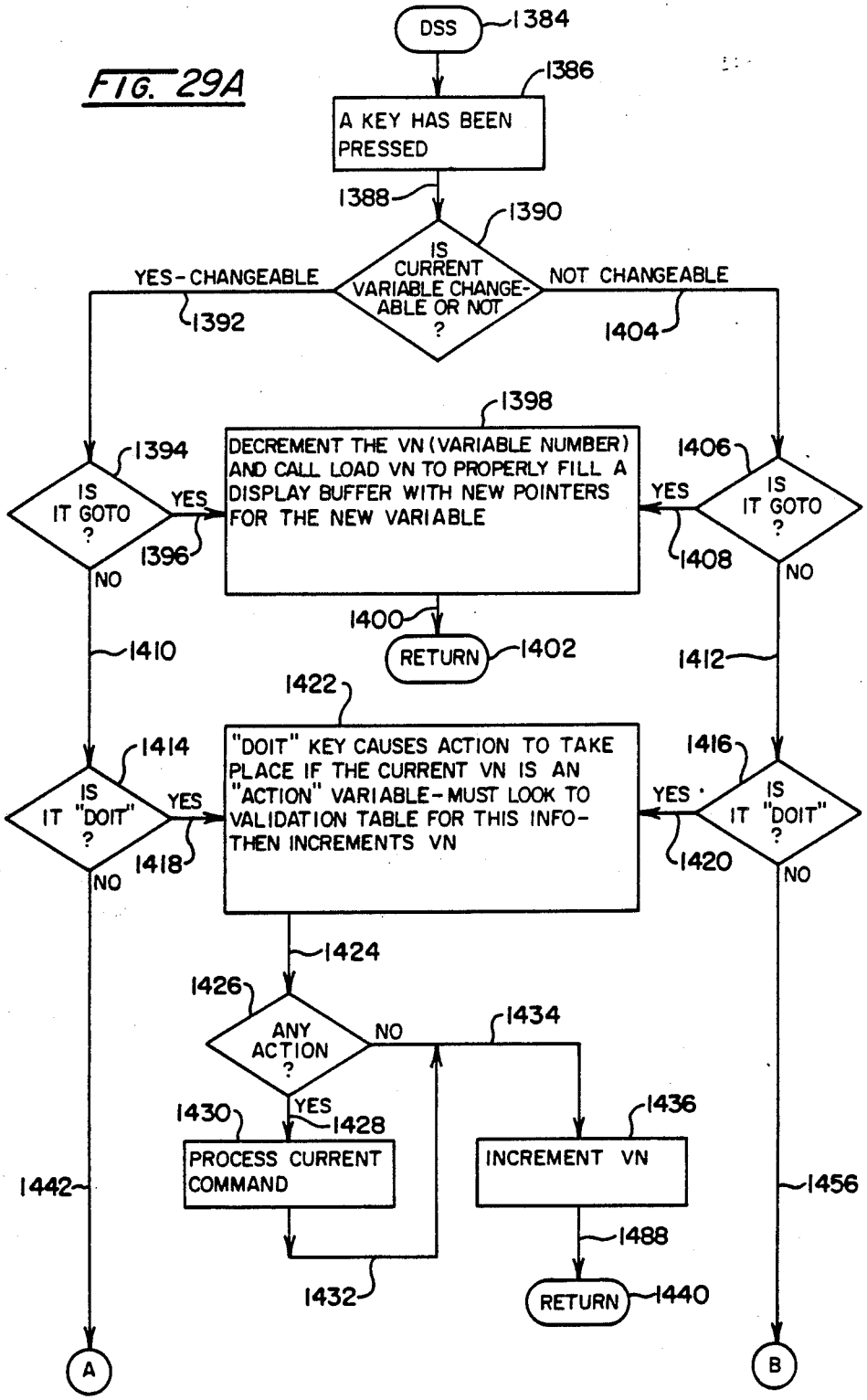

Referring to FIGS. 29A and 29B, a display and set service routine is portrayed. This routine is called to run the operating system when a key has been actuated at upon controller 10 at keypad 44. The displays 40 and 42 of the controller 10 will displaying a message or a variabl and its value at any given operational time. The variables involved will be present for purposes of information only or will represent a controlling variable. For example, an informational variable will include CSG or casing pressure which is a pressure reading. On the other hand, the status of a valve, if altered from the keypad, will cause the valve to open or close. Thus, variables displayed at display 40 and 42 may be changeable at the keypad or non-chgangeable therefrom. It may be recalled that the entire assemblage of variables or parameters are divided up into a subsets, for example 16 such subsets or menus. Should the operator wish to look at menus other than that current in RAM, then a LOAD MENU instruction is presented at the end of each such variable assemblage. By inserting the number of a next desired menu, that subset then will be available for display. Looking to FIG. 29A, the display and set servicing routine is represented being entered as at node 1384 upon the actuating or pressing of a key within key grouping 44 as represented at block 1386. From block 1386, as represented by line 1388 and block 1390, the routine makes an initial determination as to whether the variable associated with the key depression is one which is changeable or not. If it is changeable, then as represented at line 1832 and block 1394 a determination is made as to whether the GOTO key has been depressed. In the event that it has, then as represented by line 1396 and block 1398, the variable number is decremented and new pointers are developed at a display buffer for showing the new variable represented the decrementation. As represented then at line 1400 and node 1402, the routine returns. It may be observed that where the determination at block 1390 shows that the variable is not changeable, then as represented at line 1404, block 1406, and line 1408, the same decrementation as described in conjunction with block 1398 occurs. Similarly, where the determination at block 1394 or 1406 is that the GOTO key has not been actuated, then as represented by lines 1410 and 1412 leading, respectively, to blocks 1414 and 1416, a determination is made as to whether the DOIT key has been actuated. In the event that it has for either case, as represented by respective line 1418 and 1420 the instructions represented at block 1422 are carried out. In this regard, the DOIT key causes action to take place. If the then displayed variable is an action type of variable, a validation table is accessed for such action information. The variable display then increments one step. Accordingly, as represented at line 1424 and block 1426, a determination is made as to whether an action variable is at hand. In the event that it is, then as represented at line 1428 and block 1430, that current command is processed and, as represented at lines 1432 and 1434, the routine then progresses to the instructions at block 1436 for carrying out in incrementing of the variable number. Then, as represented at line 1438 and node 1440, the routine returns.

Where the DOIT key now has been actuated with respect to a changeable variable, then as represented at line 1442, node A, line 1444 (FIG. 29B) and block 1446, a determination is made as to whether the left arrow key has been actuated. In the event that it has, then as represented at line 1448 and block 1450, the cursor pointer is adjusted one digit to the left or if at its far left location, it is wrapped around to the units value location or rightmost position. The cursor is identified to the user by a flashing of the digit involved. Following such manipulation, as represented at line 1452 and node 1454, the routine returns.

Returning to FIG. 29A, where a determination is made at block 1416 that the DOIT key was not actuated with respect to a non-changeable variable, then as represented at line 1456, node B, line 1548 (FIG. 29B) the right and left and up and down arrow keys 48–51 are, in effect, disabled. In this regard, it may be observed from blocks 1460–1463 and the reverse loop lines associated therewith respectively at 1464–1467 leading to negative determination path lines shown respectively at 1468–1471, that the routine, in effect, returns as represented at node 1472.

Where a determination is made at block 1446 that the left arrow has not been actuated in conjunction with a changeable variable, then as represented at line 1474 and block 1476, a determination is made as to whether the right arrow key has been actuated. In the event that it has, then as represented at line 1478 and block 1480, the cursor pointer is adjusted one digit to the right, the cursor location being represented by a flash type output. The cursor wraps around to the far left if currently at the far right location. Following this adjustment, as represented at line 1482 and node 1484, the routine returns.

In the event the determination made at block 1476 shows that the right arrow has not been actuated, then as represented at line 1486 and block 1488 a determination is made as to whether the up arrow key 50 has been actuated. In the event that it has, then as represented at line 1480 and block 1492, the digit currently under evaluation and flashing is incremented by one unit. The program looks to a validation table to determine the quantity for the variable, looking to whether it is decimal time or hex unit to make an appropriate adjustment.

Following the noted incrementation, as represented at line 1494 and node 1496 the routine returns.

Where the determination at block 1488 is that the up arrow key 50 has not been actuated, then as represented at line 1498 and block 1500, a determination is made as to whether the key which has been actuated is the down arrow key 51. In the event of an affirmative determination, then as represented at line 1502 and block 1504 a current digit is decremented by an appropriate unit. The program looks to the noted validation table as discussed in conjunction with block 1492 to determine the quantity involved, for example, decimal, time of hex units. Following appropriate decrementation, as represented at line 1506 and node 1508, the routine returns. Where the determination at block 1500 is that the down arrow key has not been actuated, then as represented at line 1510 and node 1512, the routine returns.

Figure 30A:
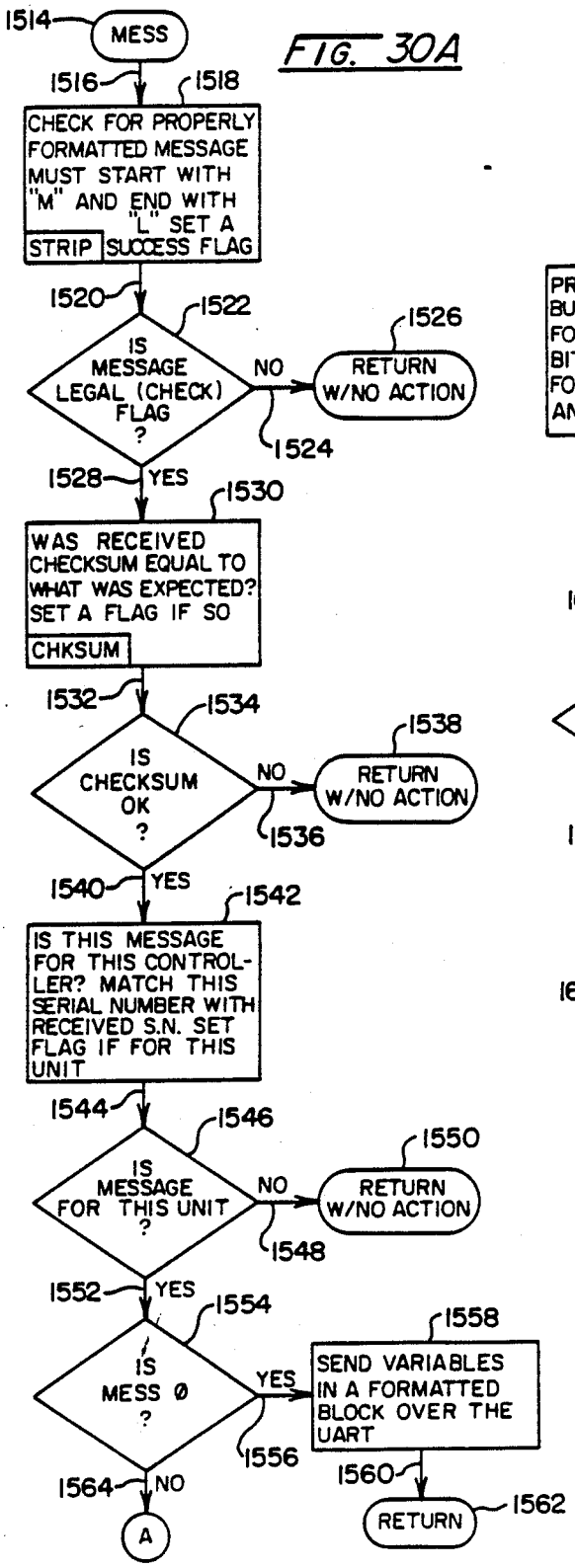
FIGS. 30A–30B provide a flow diagram of the message processor routine employed by the controller of the invention.
Figure 30B:
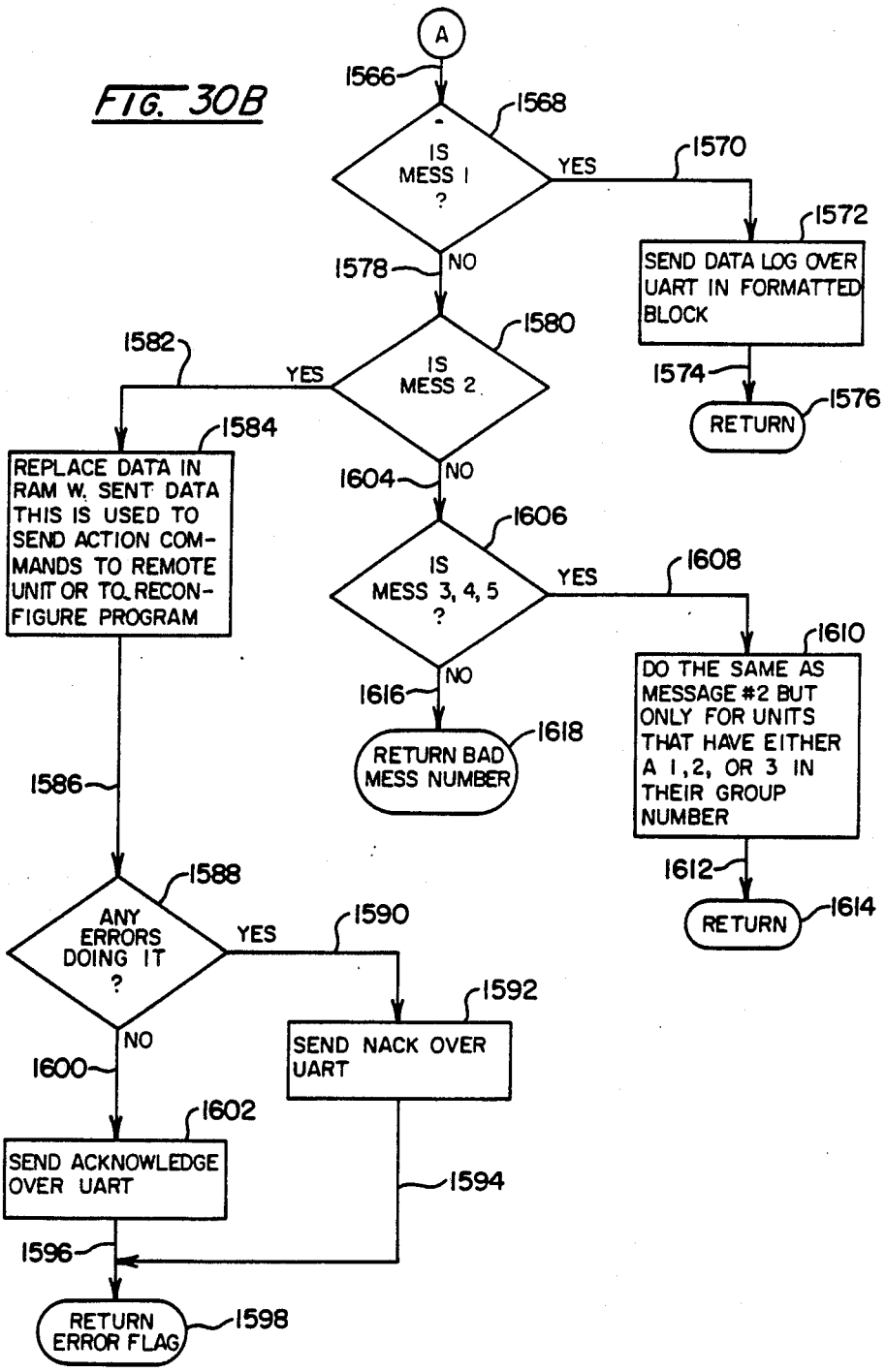

Referring to FIGS. 30A and 30B, the message processor routine (MESS) as discussed in conjunction with block 1180 is set forth in flow chart fashion. This routine is called after a serial message has been received at UART 636 (FIG. 13C) whether from a network of controllers 10 or by telephone coupling. As noted earlier, any message is bracketed by an M and an L in ASCII format. FIG. 30A shows the routine entry at node 1514 and line 1516 leading to the instructions as represented at block 1518 wherein a check is made for the properly formatted message carrying the noted "M" and "L." In effect, a subroutine identified as "STRIP" is called. As represented at line 1520 and 1522, a determination then is made as to whether the message is legal with respect to its terminal identifiers. In the event that it is not, then as represented at line 1524 and node 1526 where the terminal components of the received message are in proper order, then as represented at line 1528 and block 1530 a checksum is carried out with respect to the last four bytes of the message in conventional fashion, a checksum subroutine being employed. Then, as represented at line 1532 and block 1534, a determination is made as to whether the checksum is appropriate, and in the event that it is not, then as represented by line 1536 and node 1538 the routine returns with no action. Where the checksum is in order, then as represented by line 1540 and block 1542 a check is made to see if the incoming message is for the instant controller or for another. Each of the controllers 10 is assigned a unique serial number in ROM. Inasmuch as many controllers may be connected to a single communication network, some addressing scheme is required to ascertain that only the targeted controller reacts to a given message. Each message has included therein a receiver serial number and is sent to all controllers within a given network. The routine at this position takes the received serial number and compares it to the ROM retained serial number. In the event of a match, then a flag is set authorizing the controller to further process the message. In the event there is not match of the two serial numbers, then no further action takes place for the current message. Accordingly, as represented at line 1544 and 1546, a determination then is made as to whether the serial number of the message and unit match, and in the event that they do not, then as represented at line 1548 and node 1550, the routine returns with no action. Where the message received indeed is for the unit at hand, then as represented at line 1552 and block 1554, the first of a series of determinations as to certain types of messages is made. The messages themselves are designated by numbers 0 through 5. Thus, where a message identification of 0 is present, then as represented line 1556 and bloc 1558 the variables are sent in a formatted block through UART 636. Thus, the current status of the controller 10 may be sent over the local network or through a telephone communication link. Following sending the message, as represented at line 1560 and node 1562, the routine returns. Where the message determination made at block 1554 shows that it is not a zero designated message, then as represented by line 1564, node A, line 1566 (FIG. 30B) and block 1568, a determination is made as to whether the message is designated as number 1. In the event that it is, then as represented by line 1570 and block 1572, the datalog is sent over UART 636 in formatted fashion. The routine then returns as represented at line 1574 and node 1576. In the event of a ngative determination at block 1568, then, as represented line 1578 and block 1580, an inquiry is made as to whether the message is given message number 2. In the event that it is, then as represented at line 1582 and block 1584, a command will have been received at the controller 10 to replace certain of its RAM contained data with data being transmitted to UART 636. Thus, commands from remote locations can be received to change such things as time of day, on commands, high and low set points, as well as to initiate any number of functions. Following this reconfiguration of the program, as represented at line 1586 and block 1588, a determination is made as to whether any errors ensued in the message reception procedure. In the event that errors were involved, then as represented at line 1590 and block 1592, a no acknowledgement (NACK) message is returned over UART 636 to the sender and, as represented at lines 1594, 1596, and node 1598, the routine returns in conjunction with the presentation of an error flag. Where the determination at block 1588 shows no error in the received message, and as represented at line 1600 and block 1602, an acknowledge signal (ACK) is transmitted to the sender over UART 636 and the routine returns as represented at line 1596 and node 1598.

Where the determination at block 1580 is that a number 2 message has not been received, then as represented at line 1604 and block 1606, a determination is made as to whether the message is number 3, 4 or 5. In the event that it is, then as represented at line 1608 and block 1610, a message will have been delivered which is associated with a group of controllers within a network. The message will be the same as message 2 at block 1584 but will be simultaneously asserted to several controllers. Thus, more than one controller within the network may react simultaneously to a received message and common commands can be employed by the operator. Following the sending of the message and with appropriate care and determination as represented at block system 1588–1598, the routine returns as represented at line 1612 and node 1614. Where the determination at block 1606 is made that a message 3, 4, 5 has not been received, then as represented at line 1616 and node 1618, that message number will have occurred and the routine returns with information to that effect.

Figure 31:
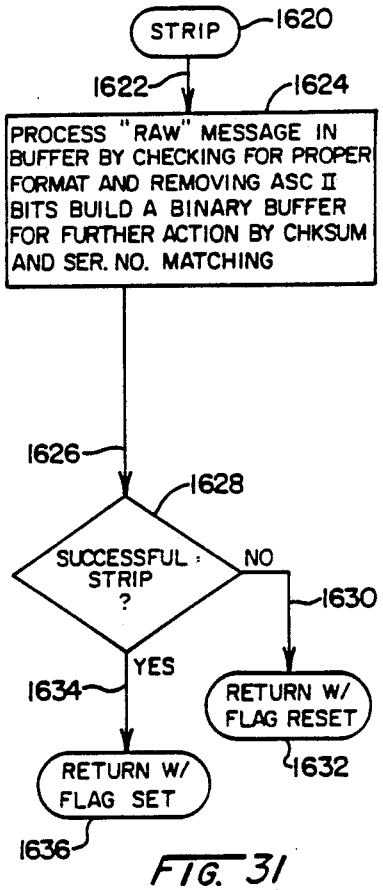
FIG. 31 is a flow diagram of the STRIP subroutine employed by the controller of the invention.

Looking to FIG. 31, a subroutine identified as "STRIP" which is called in conjunction with block 1518 of FIG. 30A is illustrated. The subroutine is shown entered at node 1620 and line 1622 leading to the instructions at block 1624. These instructions provide for processing the "raw" message in buffer by checking for proper format (an "M" and an "L") and by stripping or removing ASCII bits to build a binary buffer for further action by the checksum and serial number matching operations. The subroutine then determines whether this stripping activity was successful as represented at line 1626 and block 1628. In the event that it was not, then as represented at line 1630 and node 1632 the subroutine returns with a flag reset. Alternately, where the strip process is successful, then as represented at line 1634 and node 1636, a return of the subroutine is made with the flag set. Looking to FIG. 32, the checksum subroutine as discussed in conjunction with block 1530 of FIG. 30A is revealed. This subroutine enters as represented at node 1638 and line 1640 to carry out a conventional checksum procedure as represented at block 1642. In this regard, the checksum employed is the sum of the total of all of the ASCII components of each character in the message string. The subroutine then continues as represented by line 1644 and block 1646 to querry as to whether the checksum is correct. In the event that it is not, then as represented at line 1648 and node 1650, the subroutine returns with its flag reset and, conversely, where the checksum is correct, then as represented at line 1652 and node 1654, the subroutine returns with the flag set.

Figures 32, 33A:
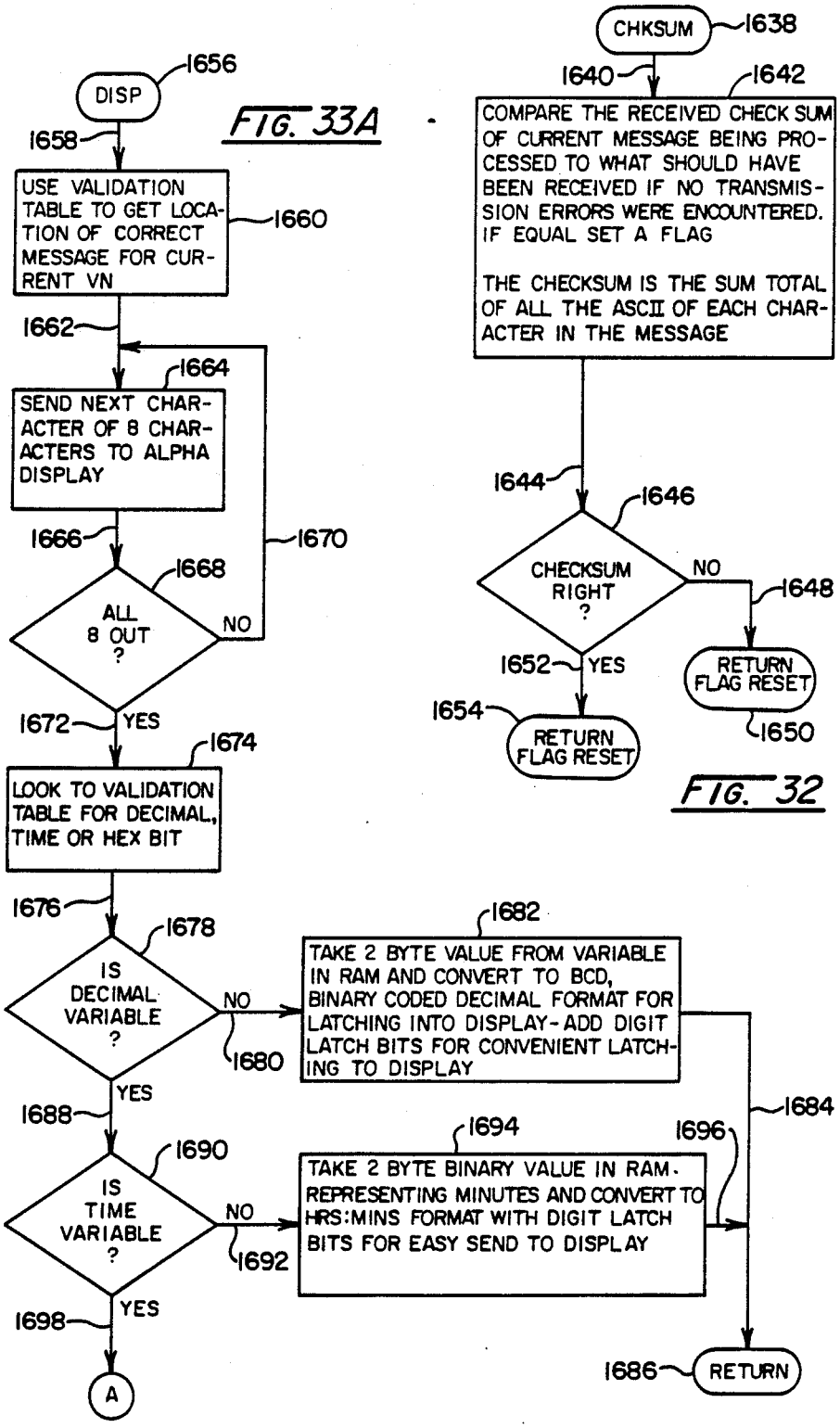
FIG. 32 is a flow diagram of the CHKSUM subroutine employed by the controller of the invention.
FIGS. 33A–33B provide a flow diagram of the DISP subroutine employed by the controller of the invention.
Figure 33B:
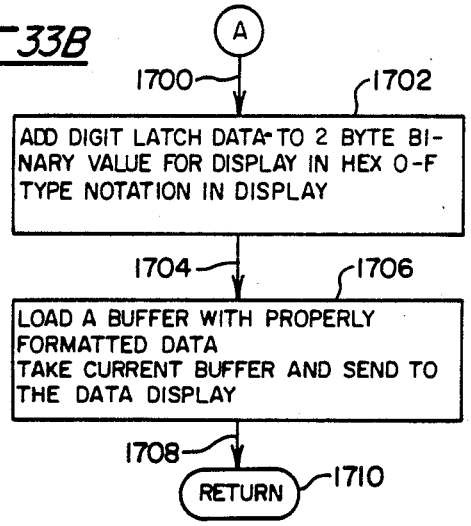

Referring to FIGS. 33A and 33B, the display (DISP) subroutine described in conjunction with block 1194 of FIG. 24 is illustrated in flow chart fashion. The subroutine is shown entered at node 1656 and line 1558 leading the block 1660. Block 1660 instructs the program to use the validation table to obtain the location of the correct message for the variable to be displayed currently. The program then continues as represented at line 1662 and block 1664 to carry instructions to send the next character of eight characters to the alpha display represented at 40 in FIG. 1. the subroutine continues as represented at line 1666 and block 1668 at which time a determination is made as to whether all eight characters have been retrieved. In the event they have not, then the subroutine loops as represented by line 1670 until such time as all eight characters have been placed in display. When all eight characters are out, then as represented at line 1672 and block 1674 the validation table is accessed for decimal, time or hex bit information. The subroutine then continues as represented at line 1676 to the inquiry represented by block 1678 as to whether a decimal variable is at hand. Where such is the case, then as represented by line 1680 and block 1682 a 2-byte value from the variable in RAM is converted to binary coded decimal format for latching into the display 40. Digit latch bits are included for convenient latching to the display 40. The subroutine then returns as represented at line 1684 and node 1686.

In the event a determination is made at block 1678 that no decimal variable is at hand, then as represented by line 1688 and block 1690, a determination is made as to whether the variable in concern is a time variable. In the event that it is, then as represented by line 1692 and block 1694, a 2-byte binary value is accessed from RAM representing minutes which is converted to hours and minutes format for submittal to the display in conjunction with digit latch bits. The subroutine then returns as represented by lines 1696, 1684, and node 1686. Where the inquiry at block 1690 results in a negative determination, then as represented by line 1698, node A, line 1700, (FIG. 33D) and block 1702 a hex number will be at hand and digit latch data is added to the 2-byte binary value for display in hex 0-F type notation in the display. The subroutine then continues as represented at line 1704 and block 1706, the appropriate value data corresponding with the elected variable is loaded to a buffer and sent to the beta data display 42. The subroutine then returns as represented by line 1708 and node 1710.

Figure 34:
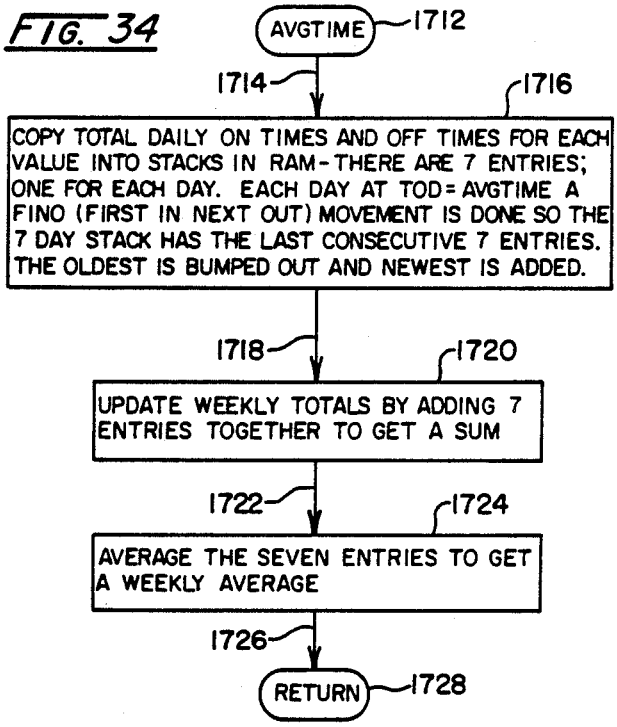
FIG. 34 is a flow diagram of the AVGTIME subroutine employed by the controller of the invention.

Referring to FIG. 34, the average time (AVGTIME) subroutine described in conjunction with block 1218 in FIG. 24 is set forth in diagrammatic fashion. This averaging time is elected by the operator, usually at a point in time just before an expected well visitation is to be made or remote accessing of the controller unit 10 is to be carried out. The subroutine is seen to be entered at node 1712 and line 1714 looking to the instructions of block 1716. The latter block provides for the copying of total daily on times and off times for each valve into stacks in RAM memory. There are seven entries, one for each day and, each day, at a time when the time of day is equal to the elected average time a first in next out movement is carried out such that the 7-day stack has the last seven consecutive entries, the oldest being removed and the newest added. The subroutine continues as represented at line 1718 an block 1720 to porvide for updating weekly totals by adding seven entries together to obtain a sum and, as represented by line 1722 and block 1724, an average of the seven entries is provided to obtain weekly averages of data. The subroutine then returns as represented at line 1726 and node 1728.

Figure 35:
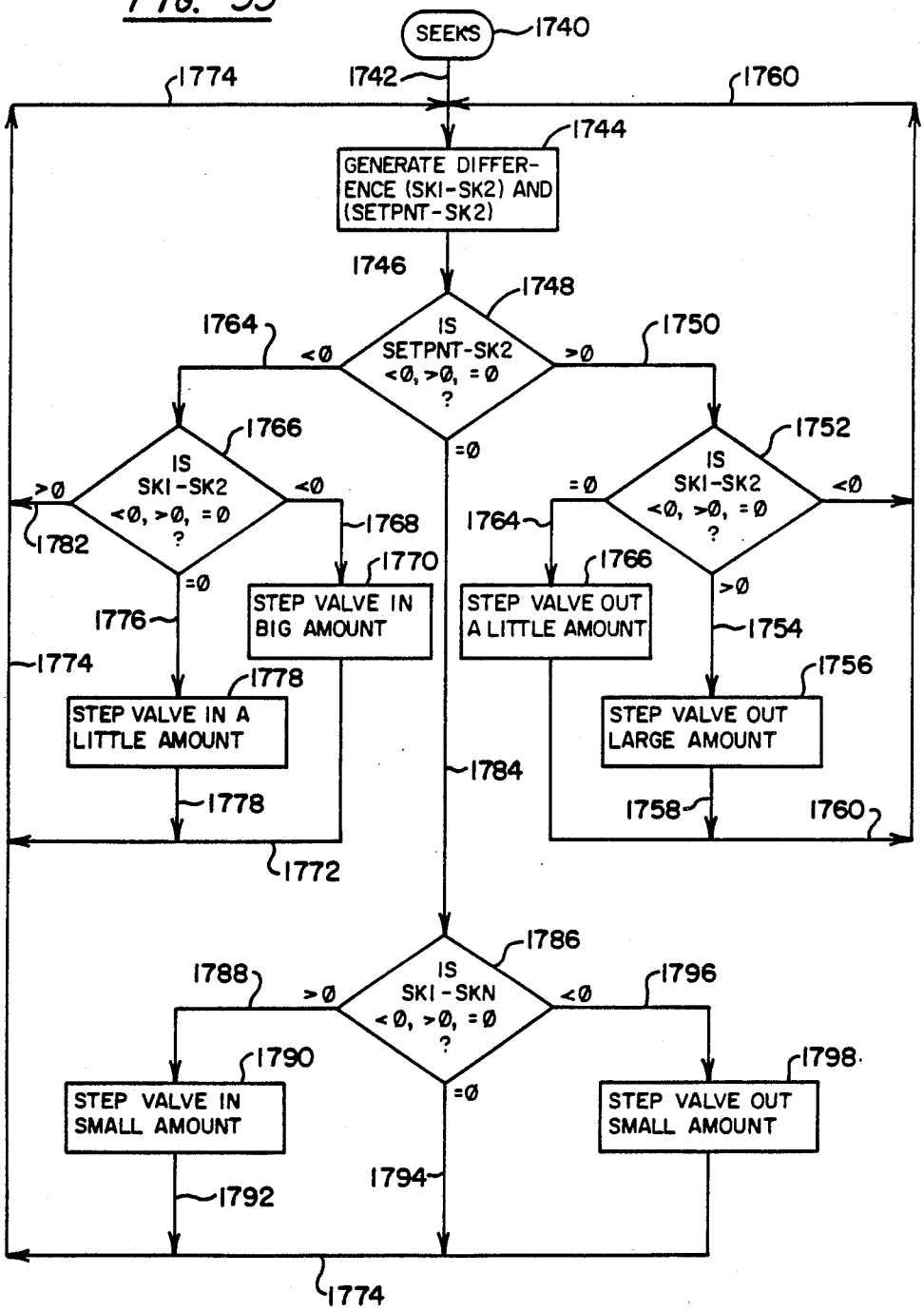
FIG. 35 is a flow diagram of the SEEKS subroutine employed by the controller of the invention.

Referring to FIG. 35, the "SEEKS" program described in conjunction with block 1202 in FIG. 24 and employed for the variable control of a motor valve as described in conjunction with FIGS. 11 an 12 is portrayed. The seeks routine functions to adjust a valve in variable fashion depenent upon some input parameter as developed from a transducer mounted at the well installation. The adjustment then causes the variable output valve to attempt forcing the control pressure to equal some set value. The routine is enabled by setting a flag such as variable or operational parameter number 84, for example, from the keypad 40. Once this flag is established, the seeks control becomes somewhat independent of the earlier-discussed pattern matching and shuffling routines. For example, the routine does not require a response table entry for effective functioning. However, the earlier-described control arrangement has the capability of disabling the seek mode or changing its set point by shuffling data as described. Several additional of the variables are employed with the variable valve, for example, for any desired position of the valve the STATV1 variable 4E is employed. Correspondingly, the current position of the valve at a given time is retained in memory as variables POS11–POS18. Where on and off times are employed, then variables 38 and 39 are employed at the set point to which the instant figure applies is identified as SETPNT at variable C6 which operates in conjunction with scaling factors SF1 and SF2(C7,C8).

FIG. 35 shows the routine being entered at node 1740 and line 1742 with the instructions at block 1744 which generates two different quantities. The first of these quantities is the value SK1−SK2, where SK1 is the last reading of the transducer being employed for valve control and SK2 is the current reading. Additionally, the valve SETPNT−SK2 is computed where SETPNT is the desired transducer reading or set point. The program then is predicated upon a control philosophy wherein if the current reading, SK2, is above or below the set point (SETPNT) and the transducer pressure readout is not moving toward or away from the set point, then a valve change is called for. If the current reading (SK2) is reasonably close to the set point (within a variable difference) then no change is required in valve state.

Upon carrying out the computations at block 1744, as represented at line 1746 and block 1748, an initial determination is made as to whether the computation SETPNT−SK2 is greater than zero, less than zero, or zero. Where that value is greater than zero, then as represented at line 1750, the transducer reading will be below the set point, the difference being a positive value. Accordingly, line 1750 is seen directed to the inquiry at block 1752 determining whether the difference between the last and current reading of the transducer is greater than zero, less than zero, or equal to zero. Where that valve is greater than zero, then as represented by line 1754 and block 1756, the positive valuation indicates that the current setting is moving away from the set point and, thus, a larger out movement of the valve is called for. The routine continues then as represented at lines 1758 and 1760. Where the evaluation at block 1752 indicates that the difference between SK1 and SK2 is less than zero, then as represented at lines 1762 and 1760, the resultant negative valuation indicates that the transducer reading is moving toward the set point and no change is carried out, the routine looping to line 1742 to develop a next difference generation as set forth in block 1744. The latter timing between these discrete difference generations preferably is the earlier-noted four seconds (CLK1, FIG. 13E). Where the determination at block 1752 is that no difference exists between the current and last reading, then as represented at line 1764 and block 1766, the valve is moved out a small amount and the routine loops as described in conjunction with line 1760.

Where the determination as represented at block 1748 is that the difference between the set point and current reading is less than zero, then the transducer reading will be above the set point value and, as represented at line 1764 and block 1766, a determination again is made as to whether the difference between the last reading of the transducer and its current reading is greater than zero, less than zero or equal to zero. Where the difference is less than zero, as represented at line 1768 and block 1770, the transducer value is moving away from the set point and a larger valve movement is called for. The routine then loops as represented at line 1772 to line 1724 to await the next difference generation as represented at block 1744. Where the determination at block 1766 is that the difference between the last and current reading to the transducer is zero, then as represented at line 1776 and block 1778 there is no movement of the transducer reading and a small amount of valve actuation occurs, whereupon the routine loops as represented by lines 1780, 1772 and 1774. Where the determination at block 1766 indicates that the difference between the last reading and the current reading is greater than zero, the transducer monitored pressure is moving toward the set point and as represented by lines 1782 and 1774, no change in valve position is made.

Returning to block 1748, where the difference between the set point and the current reading is equal to zero, then as represented by line 1784 and block 1786, a determination again is made as to whether the difference between the last reading and the current reading is less than zero, greater than zero, or equal to zero. Where the difference between the last reading and current reading is greater than zero, then as represented by line 1788 and block 1790, the transducer monitored pressure is moving across the set point and a small amount of adjustment is carried out. The routine then loops as represented by lines 1792 and 1774. Where the determination at block 1786 is that the current reading and last reading are identical, then as represented at line 1794, the transducer monitored pressure is at the set point and is not changing and, thus, the routine loops as represented at line 1774. Where the determination at block 1786 is that a difference between the last reading and current reading is less than zero, then the pressure monitored by the transducer is again moving across the set point and, as represented by lines 1796 and 1798, a small movement out of the stepper motor driven valve is carried out.

Figure 36:
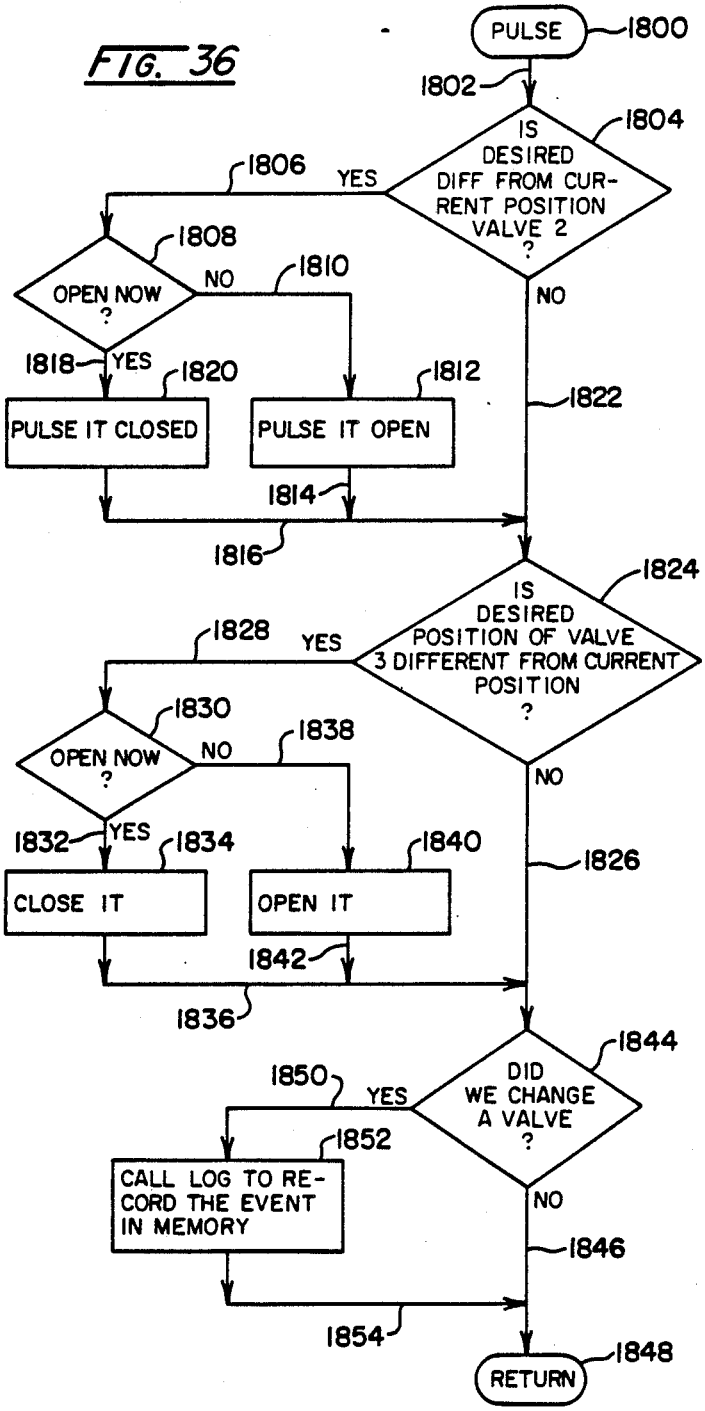
FIG. 36 is a flow diagram of the PULSE subroutine employed by the controller of the invention.

Referring to FIG. 36, a routine for carrying out the pulsing of a solenoid actuated valve to simply open or close valves within the oil well installation is described in block diagrammatic form. This pulsing is described in the variable listing as being associated with valves designated as "V2" and "V3". The pulsing routine can be called by the program in a variety of ways, for example, from the keypad 44 itself, by simple status changes at variable "STATV2"and "STATV3"having respective variable numbers 4F and 50. Further, the routine may be called in the processing operations of the control program. The figure shows the routine being entered at node 1800, line 1802 and block 1804 where a determination is made as to whether the desired position difference varies from the current position for valve 2. The latter current position has been identified in the above listing as variable V2POS at number CA. Where the determination at block 1804 is in the affirmative, then as represented at line 1806 and block 1808 the current position of the valve is determined as to whether it is open. Where it is not open, then as represented by line 1810 and block 1812, the valve is pulsed open and the routine continues as represented by lines 1814 and 1816. On the other hand, where the determination at block 1808 is that the valve is open, then as represented by line 1818 and block 1820 an instruction is provide to pulse the valve closed and the routine continues as represented at line 1816.

Where the inquiry at block 1804 determines that there is no difference between the desired position of the valve and current position, then the routine continues as represented at line 1822 to the inquiry at block 1824. This inquiry determines whether the desired position of valve 3 is different from the current position. In the event that it is not, then as represented at line 1826, the program continues. On the other hand, where the determination at block 1824 is that the desired and current positions are different, then as represented by line 1828 and block 1830, a determination is made as to whether the valve is open now. In the event that it is, then as represented by line 1832 and block 1834 the valve is closed and the routine continues as represented at line 1836. Where the determination at block 1830 is that the valve is not open now, then as represented at line 1838 and block 1840, the valve is open and the routine continues as represented at lines 1842, 1836, and 1826.

The routine then continues to the inquiry at block 1844 wherein a determination is made as to whether a change was carried out in the status of a valve. Where this determination is in the negative, then as represented at line 1846 and node 1848, the routine returns. On the other hand, where a valve status change was made, then as represented at line 1850 and block 1852 that event is recorded in memory in conjunction with time data. The routine then returns as represented at lines 1854, 1846 and node 1848.

Now turning to the datalog routines of the controller 10, it may be recalled that this feature of the controller in one aspect, emulates the two-pen recorder which traditionally recorded casing pressure and tubing pressure and which could be visually analyzed to observe trends on a seven-day basis with respect to these parameters as well as cycling points and the like. The datalog collects important variables in a sequential manner within RAM memory, associating them with time data in a wrap around fashion. Additionally, the datalog responds to inputs from the operator to log specific variable values and to activities including external switch changes, valve changes and the like. The information of the datalog can be read at the site of the well or remotely either from networking or over telephone linkages. It may be recalled that AVGTM (variable number 28) is used to select the time of day for averaging log readings while variables 29 through 2F provide total on time and total off time data, variables 99 through 9C provide datalog entry for timers, the SENDLOG variable number BB provides a local command to transmit the datalog. Additionally, the datalog may be provided as the only operation of the controller 10 by the use of the AUTO variable number BD. The manual inputting of log data has been discussed in connection with DLOG variable C1 as well as DLOG1-8 variables numbered E0-87.

Figure 37:
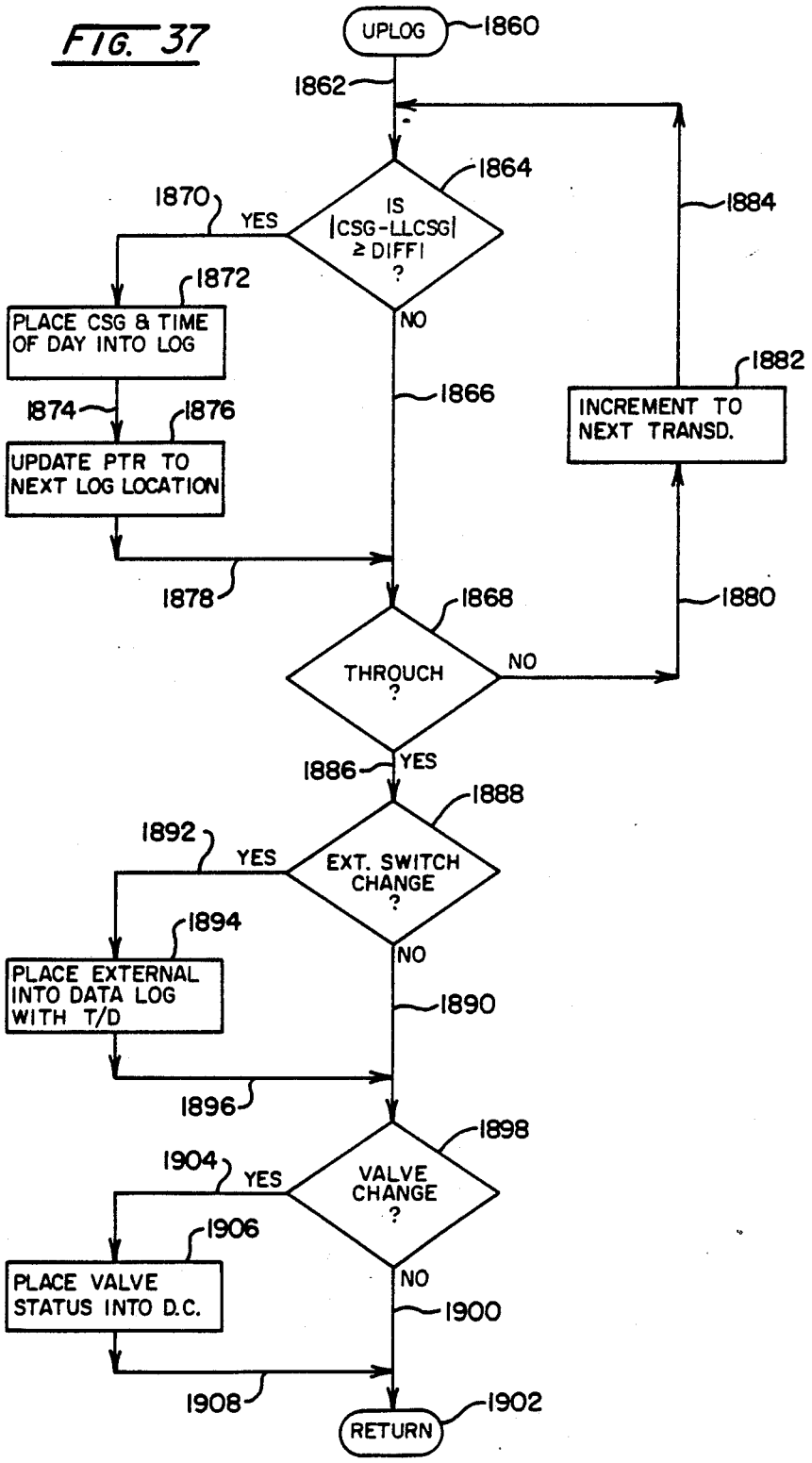
FIG. 37 is a flow diagram of the UPLOG routine employed by the controller of the invention.

The log updating program is shown in FIG. 37 as commencing with the UPLOG node 1860, line 1862 and initial inquiry block 1864. At the latter block, a determination is made as to whether the absolute value of the difference between casing pressure (CSG) and the last logged casing pressure (LLCSG) is greater than or equal to the variable, DIFF1 representing a required variable or parameter change before logging will take place in the interest of conserving memory. A sequence of this type of parameter or variable is tested in the same manner, the listing of variables being the earlier-described sequence variable numbers at hex 67 through 76. Where the difference is insufficient, then as represented at line 1866, the program continues to the inquiry at block 1868 determining whether all variables within the noted sequence have been evaluated. Where the difference criteria established in conjunction with block 1864 are met, then as represented at line 1870 and block 1872, the variable, for example casing pressure (CSG) and the dated time of the day are placed into the datalog. The routine then progresses as represented at line 1874 and block 1876 to update the pointer to the next RAM location for datalog and the routine continues as represented at line 1878 to the inquiry at block 1868 determining whether all parameters or variables of the numbered grouping hex 67-76 have been so processed. As indicated at line 1880 where the determination at block 1868 is in the negative, then as represented at block 1882 the routine increments to the next transducer reading or the like of the noted variables and continues the datalog evaluation as represented at loop line 1884 and extending to line 1862.

Where all of the noted variables representing the transducer readings have been read, then as represented by line 1886, a determination is made as to whether an external switch has changed state. For example, the change in the status variables or parameters STATC1 and STATC2 described as variables hex 51 and 52. In the event no change has been determined, then the routine continues as represented at line 1890. On the other hand, where such a change has been detected, then as represented at line 1892 and block 1894, the switch change is entered into the datalog along with an associated data and time of day. The routine then continues as represented by lines 1896 and 1890 to the inquiry represented at block 1898. This inquiry determines whether any change has been encountered in the valves of the control by the controller 10. For examples, variables or parameters STATV1-STATV3 represented at hex numbers 4E-50 are polled for this information. In the event no change is at hand, then as represented by line 1900 and node 1902, the routine returns. Where a valve change is detected, then as represented at line 1904 and block 1906, the valve status is placed into the datalog memory along with date and time information and the routine returns as represented at lines 1908, 1900 and node 1902.

Figure 38:
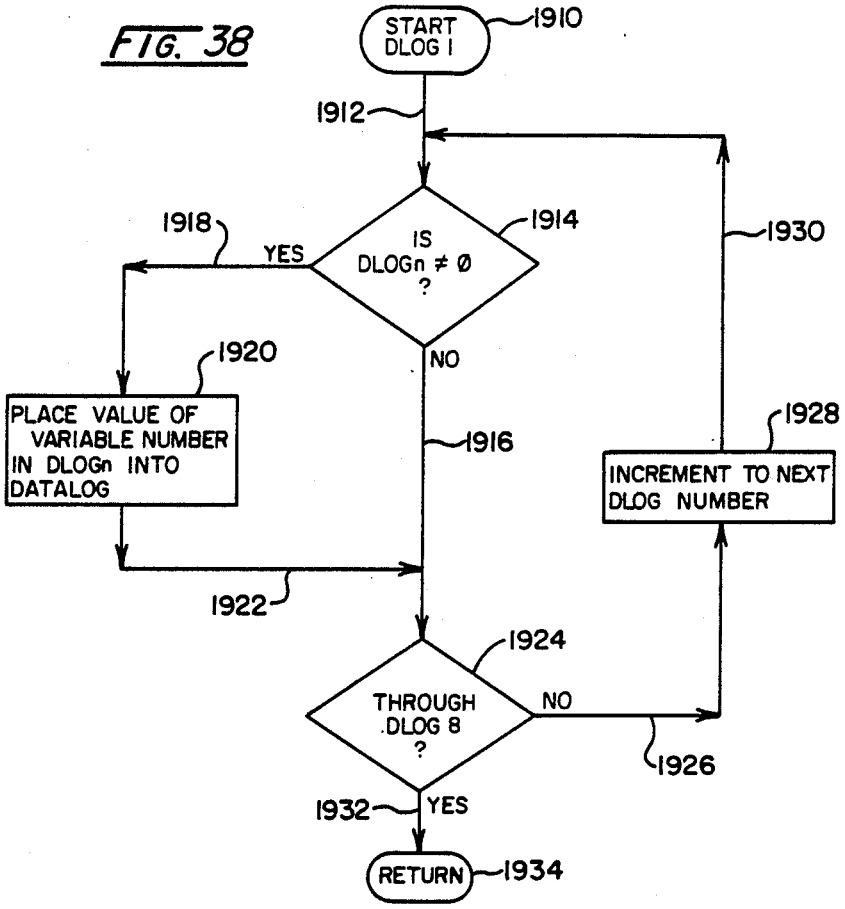
FIG. 38 is a flow diagram of the DLOG routine employed by the controller of the invention.

Looking to FIG. 38, a flow diagrammatic representation of that portion of the datalog feature wherein independent logging can be carried out is portrayed. With the arrangement, the overall control program is given a flexibility for the insertion of any elected variables into the datalog through the datalog variable selections DLOG1-8 identified above as respective variables numbers E0-E7. The routine is shown entered at node 1910 and line 1912 looking to the inquiry represented at block 914 determining whether a given DLOG number, DLOGn is not at a zero level with respect to the value of the variable. In the event of a negative determination, then the program continues as represented at line 1916. On the other hand, where an affirmative determination is made in conjunction with block 1914, then, as represented by line 1918 and block 1920, the value of the variable at hand is placed in the datalog and, as represented at lines 1922 and, 1916, and block 1924, the routine continues to determine whether the last DLOGn input, i.e. DLOG8 has been treated. In the event that it has not, then as represented by line 1926 and block 1928, the routine increments to the next DLOG number and loops to line 1912 as represented by line 1930. Where the determination at block 1924 is that all DLOG numbers within the sequence have been treated, then as represented by line 1932 and node 1934, the routine returns.

Figure 39A:
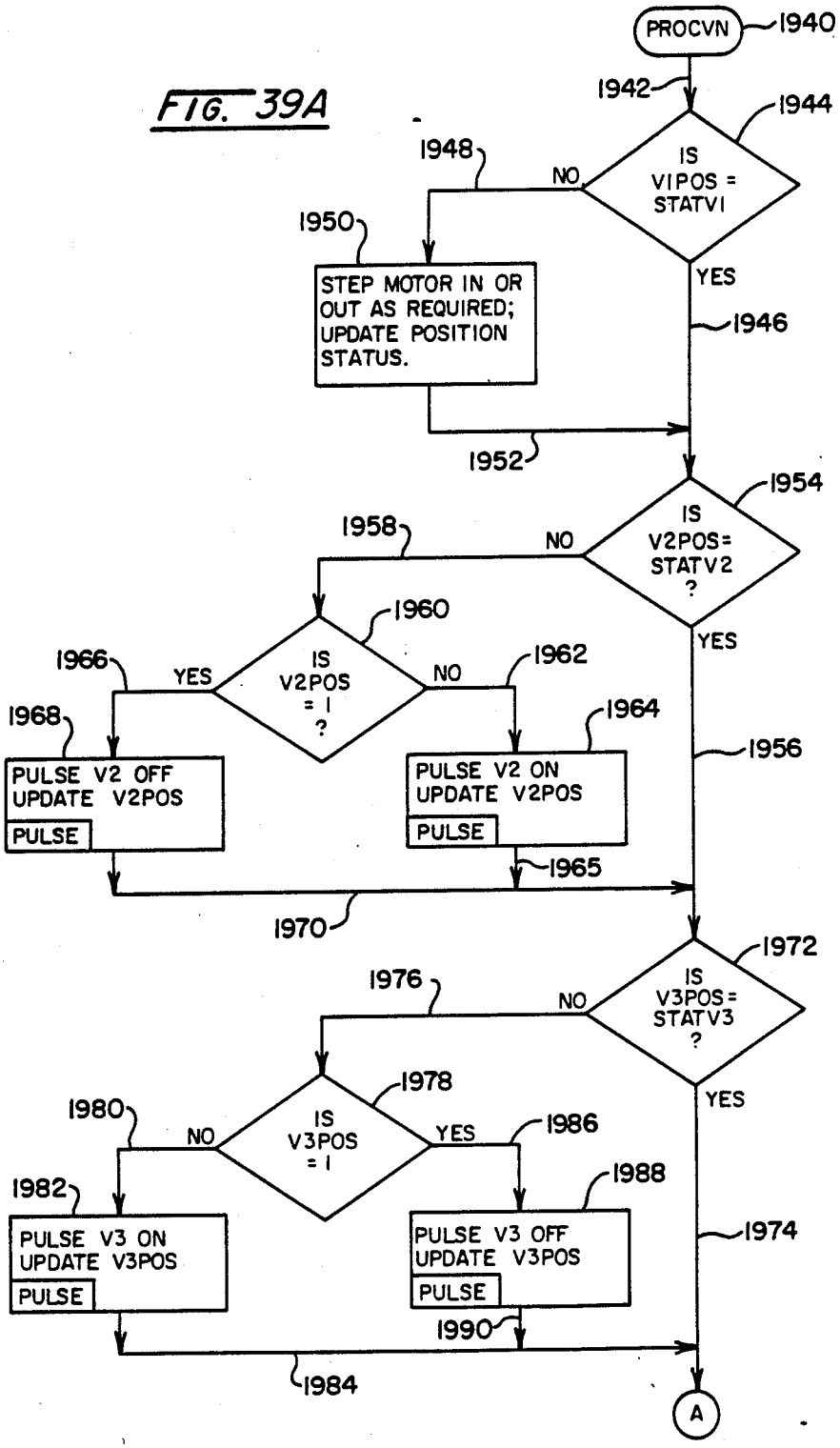
FIGS. 39A and 39B provide a flow diagram of the PROCVN routine employed by the controller of the invention.
Figure 39B:
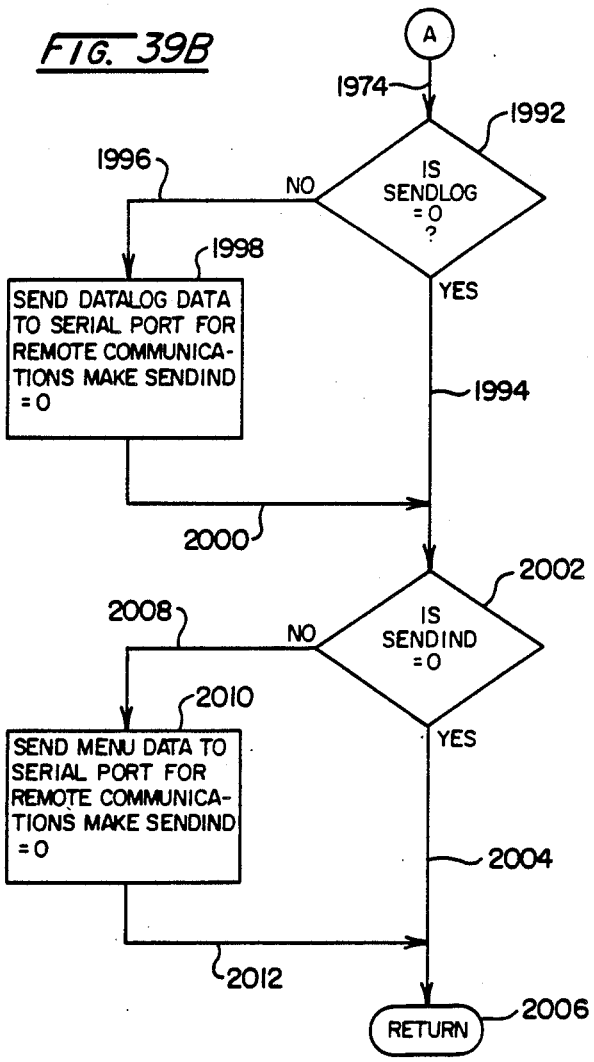

Turning to FIGS. 39A and 39B, a flow chart describing the routine for processing the variables once a revised status has been developed is set forth. Identified as "PROCVN", the routine has been described in general in conjunction with FIG. 23 at block 1150. The routine is seen commencing with the node 1940 and line 1942 looking to the inquiry at block 1944 to determine whether the current position of valve 1 is in accord with the current status (STATV1) for the valve now retained in memory. Valve 1 is the stepper motor actuated variable opening valve described in conjunction with FIGS. 11 and 12. Thus, the current position of the stepper motor 476 and its linear output drive component 480 now is evaluated. Where this is no change in the status for the valve, then the routine continues as represented at line 1946. However, where the current status for the valve is not equivalent with the revised status in memory, then as represented by line 1948 and block 1950, motor 476 is energized in pulsed fashion to step the drive output 480 there in or out as required. The status of the position of the motor then is updated and the routine continues as represented at lines 1952 and 1946 to the inquiry at block 1954. At block 1954, a determination is made as to whether the motor valve identified as "V2" has an open or closed position corresponding with its assigned status, STATV2. For this type vale, a solenoid actuated open or closed valve condition is involved. In the event that the current status and the position of the valve are in accord, then the routine continues as represented at line 1956. However, where no such coincidence is at hand, then as represented at line 1958 and block 1960, a determination as to whether the current position of the valve is open is represented by a binary 1. Where the valve is not open, then as represented at line 1962 and block 1964, the valve is pulsed to an on position and the current memory retained status of the valve is updated. To pulse the valve, the subroutine identified as PULSE is called as has been described in conjunction with FIG. 36. Where the determination at block 1960 is that the valve V2 is in an open orientation, then as represented by line 1966 and block 1968, the valve is pulsed of employing the PULSE routine and the status representation of the valve in memory is updated. The routine then continues as represented at lines 1970 and 1956 to the inquiry at block 1972 wherein a determination as to whether the current status and desired status of valve 3 are equivalent. Valve 3, for example, may be that provided in opening the well to a tank and will be implemented in general as a conventional motor valve having an open or closed orientation. Where the desired and current status of the valves are equivalent, then the routine continues as represented at line 1974. However, where the desired status and current status are not equivalent, then as represented by line 1976 and block 1978, a determination is made as to whether the valve V3 has an open position represented by binary 1. In the event that it does not, then as represented by line 1980 and block 1982, valve V3 is pulsed to an on orientation and the current status of the valve is updated in memory. The PULSE routine is called for this purpose and as represented at lines 1984 and 1974, the routine continues. Where the determination at block 1978 is that the current position of the vale is open, then as represented by line 1986 and block 1988, the valve is pulsed off, the pulse routine being called and the new status of the valve is updated in memory, whereupon as represented by lines 1990, 1984, and 1974, the routine continues to the inquiry at block 1992 where a determination is made as to whether a remote request has been made to transmit the datalog. In the event the SENDIND flag is not zero, then as represented by line 1996 and block 1998, the datalog data are transmitted to UART 636 (FIG. 13C) for serial transmission and, the SENDLOG flag is set to be zero. The routine then continues as represented at lines 200 and 1994 to the inquiry at block 2002. At the latter block, a determination is made as to whether a remote request has been made to transmit all variables, the SENDIND flag being tested for a zero condition. Where the flag is D0, then as represented by line 2004 and node 2006, the routine returns. On the other hand, where such a request has been received, then as represented by line 2008 and block 2010, new data are sent to UART 636 for sirial communications to a remote location. The flag then is set at zero and the routine returns as represented at lines 2012, 2004, and node 2006.

Since certain changes may be made in the above apparatus and method without departing from the scope of the invention herein involved, it is intended that all matter contained in the above description or shown in the accompanying drawings shall be interpreted as illustrative and not in a limiting sense.

I claim:

1. A controller for use in conjunction with the control of well installations wherein control components regulating the production of fluid hydrocarbons are selectively actuated in response to control inputs and wherein monitoring devices provide inputs representing operational parameters of said installations, comprising:

input means responsive to said operational parameter inputs for providing parameter state conditions;

communicators means for providing selectable parameter control conditions;

output means responsive to output control signals for deriving said control inputs;

memory means for retaining a predetermined sequence of values for control state variables, groupings of mask variable selection sequences, pattern control conditions and response data corresponding with said parameter control conditions; and processor means;

responsive to said parameter state conditions and said parameter control conditions for generating said control state variable values for retention by said memory means, responsive to said control state variable and said mask variable selection sequences to derive corresponding sequences of masked control state variable values, responsive to compare said masked control state variable values with said pattern control conditions and, in the presence of correspondence therebetween, to access said response data; and responsive to said accessed response data to derive said output control signals.

2. The controller of claim 1 in which said processor means is responsive to logically AND said control state variable values with said mask variable selection sequences to derive said corresponding sequences of masked control state variable values.

3. The controller of claim 1 in which:

said response data comprises predetermined variables for select control state values; and said processor means is responsive to alter said memory retained values for control state variables to correspond with said response data predetermined values, and is responsive to said altered memory retained control state variable values to derive said output control signals.

4. The controller of claim 1 in which:

said communicator means includes key input means manually actuable for providing select said parameter control conditions; and said processor means is responsive to said actuation to alter said memory retaining values for control state variables to correspond with said select parameter control conditions.

5. The controller of claim 1 in which:

said communicator means includes remote communication means for receiving remotely generated command signals incorporating select said parameter control conditions; and said processor means is responsive to said received command signals for altering said memory retained values for control state variables in correspondence with said received select parameter control conditions.

6. The controller of claim 1 including:

timer means for providing polling signals at predetermined periodic intervals; and said processor means is responsive to predetermined ones of said parameter state conditions on the occurrence of said polling signals for generating said control state variable values for retention by said memory means.

7. The controller of claim 6 in which:

said monitoring devices include transducers energizable for measuring instataneous pressures occurring at said well installations;

said input means is controllable to effect said transducer energization; and said processor means is responsive to said polling signals to control said input means to effect energization of said transducers for deriving corresponding parameter state conditions representing said instantaneous pressures.

8. The controller of claim 1 including:

display means for providing a local visual readout in response to display signals;

said communicator means includes:

key input means manually actuable for providing select said parameter control conditions, and remote communication means for transmitting command communications signals incorporating select said parameter control conditions and for receiving communications signals incorporating values of said control state variables retained in memory of remotely located controllers;

said processor means being responsive to select said key input means actuations to effect reception by said remote communications means of said communications signals from said remotely located controllers and to generate said display signals corresponding therewith.

9. The controller of claim 8 in which said processor means is responsive to select said key input means actuation, when said display signals are generated corresponding with said communications signals, to effect transmission by said remote communications means for said command communications signals corresponding with said select parameter control conditions to effect corresponding alterations of said control state variables retained in the memory of a said remotely located controller.

10. The controller of claim 1 including:

display means for providing a visual readout in response to display signals;

said communicator means includes key input means manually actuable for providing select said parameter control conditions; and said processor means is responsive to said key input means derived select said parameter control conditions to generate display signals corresponding therewith.

11. The controller of claim 10 in which:

each said control state variable retained within said memory means is assigned an identifying number;

said processor means is responsive to a key input means actuation deriving a said select parameter control condition corresponding with a said identifying number to derive said display signals corresponding therewith.

12. The controller of claim 1 in which:

said monitoring devices include transducers energizable for measuring instantaneous casing and tubing pressures occurring at said well installation; and said processor means is responsive to said parameter state conditions corresponding with said casing and tubing pressures to derive said control state variable values corresponding therewith and corresponding to the value of the difference therebetween for retention in said memory means.

13. The controller of claim 12 in which said processor means is responsive to a predetermined sequence of said control state variable values corresponding with said casing and tubing pressures to derive a said control state variable representing the average value of said sequence thereof.

14. The controller of claim 1 including:

display means for providing a local visual readout in response to display signals;

said communicator means includes key input menas manually actuable for providing said parameter control conditions as datalog information requests signals;

time defining means for deriving horologic signals; and said processor means is responsive to predetermined said control state variable values and said horologic signals for recording said control state variable values and said horologic signals in said memory means as datalog signals, and responsive to a said datalog information request signal for deriving said display signals corresponding with said recorded datalog signals.

15. The controller of claim 14 including:

timer means for deriving polling signals at a periodic sampling rate;

said processor means is responsive to said polling signals for recording said datalog signals in said memory means upon the occurrence thereof.

16. The controller of claim 14 in which said processor means is responsive to said actuation of select ones of said control component to record in said memory means predetermined said datalog signals.

17. A method for controlling the operation of a fluid hydrocarbon producing well having a valve connected between a tubing string and a sales line and monitors providing operating parameter readouts including transducers for monitoring instantaneous values of tubing pressure and casing pressure comprising:

scanning said monitors on a predetermined periodic basis and recording the values of the readouts thereof in conjunction with a sequence of variables in memory;

testing select said readout values with predetermined operational criteria to generate an ordered sequence of binary current status values and recording them as part of said sequence of variables;

periodically masking said memory retained values of said sequence of variables to derive a masked status as a binary sequence;

comparing said masked status with a predetermined pattern provided as a binary sequence for coincidence therebetween;

altering predetermined ones of said binary current status values as a response to a said coincidence to derive revised binary status values; and processing said revised binary status values by altering the state of said valve to conform with said binary status values.

* * * * *